US006218095B1

(12) United States Patent
Ohzeki et al.

(10) Patent No.: US 6,218,095 B1
(45) **Date of Patent: *Apr. 17, 2001**

(54) SILVER HALIDE COLOR PHOTOGRAPHIC PHOTOSENSITIVE MATERIAL

(75) Inventors: Katsuhisa Ohzeki; Masahiro Asami; Takuya Yokokawa; Hideaki Naruse, all of Kanagawa (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/281,074

(22) Filed: Mar. 10, 1999

Related U.S. Application Data

(62) Division of application No. 08/959,338, filed on Oct. 28, 1997.

(30) Foreign Application Priority Data

| | | |
|---|---|---|
| Oct. 28, 1996 | (JP) | 8-302496 |
| Jan. 27, 1997 | (JP) | 9-27165 |
| Feb. 10, 1997 | (JP) | 9-41637 |

(51) Int. Cl.[7] ..... G03C 1/46
(52) U.S. Cl. ..... 430/505; 430/567; 430/558
(58) Field of Search ..... 430/567, 203, 430/206, 351, 404, 505, 543, 558

(56) References Cited

U.S. PATENT DOCUMENTS

| | | | |
|---|---|---|---|
| 3,725,067 | 4/1973 | Bailey et al. | 430/476 |
| 4,435,501 | 3/1984 | Maskasky | 430/434 |
| 4,439,520 | 3/1984 | Kofron et al. | 430/434 |
| 4,500,630 | 2/1985 | Sato et al. | 430/386 |
| 4,540,654 | 9/1985 | Sato et al. | 430/381 |
| 5,178,997 | 1/1993 | Maskasky | 430/569 |
| 5,178,998 | 1/1993 | Maskasky | 430/569 |
| 5,185,239 | 2/1993 | Maskasky | 430/569 |
| 5,250,403 | 10/1993 | Antoniades et al. | 430/505 |
| 5,264,337 | 11/1993 | Maskasky | 430/567 |
| 5,292,632 | 3/1994 | Maskasky | 430/567 |
| 5,310,635 | 5/1994 | Szajewski | 430/496 |
| 5,667,945 | 9/1997 | Takeuchi et al. | 430/380 |
| 5,672,466 | 9/1997 | Okamura et al. | 430/336 |
| 5,716,772 | 2/1998 | Taguchi | 430/543 |
| 5,756,269 | 5/1998 | Ishikawa et al. | 430/351 |
| 5,756,275 | 5/1998 | Takizawa et al. | 430/566 |
| 5,773,560 | 6/1998 | Asami | 430/203 |
| 5,776,664 | 7/1998 | Yamashita et al. | 430/405 |
| 5,843,628 | 12/1998 | Taguchi et al. | 430/351 |

FOREIGN PATENT DOCUMENTS

| | | | |
|---|---|---|---|
| 7-120014 | 12/1995 | (JP) | G03C/8/40 |
| WO 94/22054 | 9/1994 | (WO) | G03C/7/30 |

*Primary Examiner*—Geraldine Letscher
(74) *Attorney, Agent, or Firm*—Sughrue, Mion, Zinn, Macpeak & Seas, PLLC

(57) ABSTRACT

Disclosed is a silver halide color photographic photosensitive material in which the photosensitive layer of the photosensitive material comprising a silver halide emulsion, a developing agent and a coupler is put together with the processing layer of a processing material so that these layers are heated to form a color image in the photosensitive material, said silver halide grains in the photosensitive layer having a silver chloride content of 50 mol % or more, wherein (1) the silver halide grains, in which 50% or more of the exterior faces of the grain is made up of a (111) plane, account for 50% or more of the total projected area of the silver halide grains of the emulsion, and the developing agent has a specific molecular structure, or (2) the tabular silver halide grains having an aspect ratio of 2 or more, which have the exterior faces of the grain made up of a (100) plane and a plane of projection of the grain in a shape of a rectangle with a length to width ratio ranging from 1:1 to 1:2, or which have the exterior faces of the grain made up of a (111) plane and a plane of projection in the shape of a hexagon with the ratio of the lengths of the neighboring sides ranging from 1:1 to 1:10, account for 50% or more of the total projected area of the silver halide grains of the emulsion, and the coupler is a pyrazolotriazole coupler having a specific molecular structure.

3 Claims, 1 Drawing Sheet

SILVER HALIDE COLOR PHOTOGRAPHIC PHOTOSENSITIVE MATERIAL

This is a divisional of application Ser. No. 08/959,338 filed Oct. 28, 1997, the disclosure of which is incorporated herein by reference.

BACKGROUND OF THE INVENTION

1. Field of the Invention

The present invention relates to a photographic silver halide photosensitive material. More particularly, the present invention relates to a silver halide color photographic photosensitive material which is useful for the improvement of an image forming technique for high-temperature processing of tabular silver chloride grains or silver halide grains composed of silver chlorobromide, silver chloroiodide or silver chloroiodobromide having a high content of silver chloride.

2. Description of the Related Art

Owing to remarkable development of color photographic photosensitive materials utilizing silver halides, high-quality color images are now easily available. For example, according to so-called ordinary color photography, color prints are obtained by taking a photograph utilizing a color negative film, processing the film, and optically printing the image information which is recorded in the processed color negative film onto-color photographic printing paper. Recently, this process has made remarkable progress, and large-scale, centralized color laboratories, in which a large quantity of color prints are produced efficiently, and the so-called mini-labs which are installed in shops and are designed to use compact and simple printer-processors have spread widely. Therefore, anybody can enjoy color photography easily.

The color photography, now in common use, reproduces color by the subtractive color process. Generally, a color negative film comprises a transparent support and photosensitive layers thereon utilizing silver halide emulsions as photosensitive elements sensitive to blue, green or red wavelength regions respectively, and so-called color couplers capable of producing a yellow, magenta or cyan dye having a complementary hue of the sensitive wavelength region of each photosensitive layer. A color negative film exposed during photography, is processed in a color developing solution containing an aromatic primary amine developing agent. At this time, the developing agent develops, i.e., reduces the exposed silver halide grains, and the oxidized form of the developing agent, which is formed concurrently with the foregoing reduction, undergoes a coupling reaction with the color coupler to form dyes. The metal silvers (developed silver) generated by the development and the unreacted silver halides are removed through a bleaching and fixing process, respectively. This creates a color image on the color negative film. Subsequently, color photographic printing paper, which comprises a reflective support and photosensitive layers coated thereon having a combination of photosensitive wavelength regions and hue in each layer, similar to the color negative film, is optically exposed to light through the processed color negative film, and is then subjected to the color developing, bleaching and fixing processes as in the case of the negative film to obtain a color print having a color image composed of dye images so that an original image can be reproduced.

Although these systems are widely adopted at the present time, there is a growing demand for a simpler system. The first reason for this is that expertise and skilled operation are necessary due to the requirement of strict control of the composition and the temperature of the solutions in processing baths for the above-mentioned procedure consisting of color development, bleaching and fixation. The second reason for this is that equipment to be used exclusively for the developing process is often required, due to substances, such as developing agents and bleaching agents comprising an iron chelate compound, the discharge of which is regulated from the standpoint of environmental protection. The third reason for this is that the currently available systems do not satisfactorily fulfill the requirement for rapid reproduction of recorded images. The above-mentioned processes still take time, although this time has been shortened with recent advances in technology.

Based on this background, many improved techniques have been proposed. In particular, in order to make the developing process simple and rapid, a variety of techniques have been proposed which use silver halide grains having a higher silver chloride content (50% or more and hereinafter referred to as "silver chloride rich grains"). The use of silver chloride rich grains brings about the advantages, for example, that the processing speed increases and the reusability of the processing solutions are improved.

Consequently, in recent years, most photosensitive materials for printing, such as color photographic printing paper, use silver chloride rich grains. Under ordinary manufacturing conditions, the produced silver chloride rich grains tend to be grains in which (100) planes constitute the exterior faces of the grains (hereinafter referred to as (100) grains). The grains actually used in practice have been cubes. Recently, tabular (100) grains, having larger specific surface areas (the ratio of the surface area to the volume) with the advantages that spectral sensitization can be effectively performed and the covering power after the developing process is enhanced, have also been developed. Examples of these tabular (100) grains are disclosed in, e.g., U.S. Pat. Nos. 5,320,938, 5,264,337 and 5,292,632.

However, in the case of the photosensitive materials using the silver chloride rich grains, the development characteristics of the silver chloride rich grains cause various problems. The first problem is that it is difficult to obtain a highly sensitive photographic response at an early stage of developing process, because the high-speed development of the individual grains of the silver halide emulsion containing the silver chloride rich grains often causes the timing of the start of the development of the light-exposed grains to vary. The second problem is that any attempt to utilize the high developing capability of the silver chloride rich grains is often associated with deterioration of the graininess. Consequently, it is very difficult to fulfill the characteristics of photosensitive materials for photographing such as a wide exposure latitude and superior level of graininess by use of a silver halide emulsion composed of the silver chloride rich grains. Since these problems still remain unsolved, many fundamental problems need to be solved before the photosensitive materials for photographing using silver halide emulsions composed of silver chloride rich grains can be put to practical use. The third problem is that the silver chloride rich grains in which (100) planes constitute the exterior faces of the grains tend to cause more fogging in comparison with conventional silver bromide grains.

As an effective solution to the above-described problems, a method has been proposed recently which comprises releasing or producing diffusive dyes on an image by means of thermal development and transferring the diffusive dyes to a dye-fixing element.

According to this method, it is possible to obtain negative or positive color images by selecting the kind of dyedonating compound or silver halide to be used. The details are described in, e.g., U.S. Pat. Nos. 4,500,626, 4,483,914, 4,503,137 and 4,559,290, Japanese Patent Application Laid-Open (JP-A) Nos. 58-149,046, 59-218,443, 60-133,449 and 61-238,056, European Patent Application Laid-Open Nos. 220,746A2 and 210,660A2, and Journal of Technical Disclosure No. 87-6,199.

In another attempt to fulfill the above-mentioned requirements, a technique has been reported which will lessen the load on the environment and contribute to the simplification of the system by establishing a color image formation system without the use of the color developing agents or bleaching agents now in use in current systems. For example, IS & T's 48th Annual Conference Proceedings, p.180, discloses a system in which the dye formed in the developing reaction is transferred to a mordant layer and thereafter a photosensitive material is stripped to remove the developed silver and unreacted silver halide from an image formed by the dye without the use of a bleach-fixing bath which has been indispensable to conventional color photographic processing. However, this technique cannot perfectly solve environmental problems because a developing process using a processing bath containing a developing agent is still necessary.

Fuji Photo Film Co., Ltd. has proposed Pictrography and Pictrostat systems which dispense with a processing solution containing a developing agent. In these systems, a small amount of water is supplied to a photosensitive material containing a base precursor, and then the photosensitive material and an image receiving material are placed face to face and heated to promote the developing reaction. This system does not use the aforementioned processing bath and, in this regard, is advantageous with respect to environmental protection. However, since this system is used in the application where the formed dye is fixed in the dye fixing layer which is then appreciated in the form of color images, there has been a demand for a system usable as a recording material for photographing.

The present inventors have conducted studies to establish a method wherein a photosensitive material is used as a recording material for photographing without undergoing a fixing treatment, thereby enabling easy and rapid processing without the use of processing solutions or with use of a minimum amount of processing solutions. As a result, they found that quickening of the process is possible by, e.g., using silver chloride rich grains. But this speed up makes the image quality insufficient because of a drop in the maximum density. As a solution to this problem, they have found a method wherein a photosensitive material comprises a coupler having a specific structure and a silver halide emulsion containing silver chloride rich, tabular grains whose exterior faces are made mainly of (100) and (111) planes.

Further, they have studied a photosensitive material for photographing having the graininess improved by use of silver chloride in the heat development system.

In the heat development system, however, in which the processing is performed at a high temperature, the tendency of the (100) grains to fog is greater than it is in conventional systems. Another type of silver chloride grains are grains having (111) planes as exterior faces (hereinafter referred to as (111) grains).

Meanwhile, specifications including U.S. Pat. Nos. 5,264,337, 5,292,632 and 5,310,635 and WO94/22,054 disclose the use of an emulsion containing tabular, silver chloride rich grains having (100) planes as the exterior faces of the grain to a photosensitive material for photographing. Owing to the use of an emulsion rich in silver chloride, this technique provides the advantages that a high-speed developing process is possible and that the same processing solution can be used for the photosensitive material for photographing and the photosensitive material for print. However, no mention is made of the introduction of a coupler having a specific structure to the photosensitive material in the above-mentioned specifications.

According to Japanese Patent Application Publication (JP-B) No. 7-120,014, fogging can be diminished, while high sensitivity is maintained in a photosensitive material for heat development, through the use of (100) silver halide grains having three sides in such a relationship that the length of one side is 2 or more times, or otherwise 0.5 or less times, the arithmetic mean of the other two sides. However, the image quality obtained through these methods is still unsatisfactory, especially with respect to the maximum density.

The tabular, silver chloride grains having (100) planes are described in many other reports, examples of which include U.S. Pat. No. 5,314,798, EP Nos. 534,395A, 617,321A, 617,317A, 617,318A, 617,325A, WO94/22,051, EP No. 616,255A, U.S. Pat. Nos. 5,356,764, 5,320,938 and 5,275,930.

Also, tabular grains whose exterior faces are made mainly of (111) planes are described in a variety of reports, examples of which include U.S. Pat. Nos. 4,439,520, and 5,250,403 which discloses so-called extremely thin tabular grains having an equivalent-circle diameter of 0.7 $\mu$m or more and a thickness of 0.07 $\mu$m or less. U.S. Pat. No. 4,435,501 discloses a technique whereby a silver salt is grown epitaxially on the surface of tabular grains. Further, there have been disclosed many inventions recently for the purpose of improving the performance of the tabular grains in, for example, EP Nos. 0,699,947A, 0,699,951A, 0,699,945A, 0,701,164A, 0,699,944A, 0,701,165A, 0,699,948A, 0,699,946A, 0,699,949A and 0,699,950A. These disclosures relate to silver bromide and silver iodobromide, but there is no description of silver halide containing silver chloride grains having (111) planes as exterior faces.

Special techniques are required for the preparation of (111) grains rich in silver chloride. For example, U.S. Pat. No. 4,399,215 issued to Wey discloses a method for the preparation of tabular, silver chloride rich grains by use of ammonia. This method, however, is associated with difficulty in obtaining small-sized grains which are useful in practice. This is because the use of ammonia increases the solubility of the already highly soluble silver chloride grains. Another disadvantage of this method is increased fogging due to high pH values of 8 to 10 at the time of preparation.

On the other hand, U.S. Pat. No. 5,061,617 issued to Maskasky discloses silver chloride rich (111) grains prepared by the use of a thiocyanate. Like ammonia, thiocyanate increases the solubility of silver chloride.

It has been known to add a crystal habit controlling agent at the time of grain formation as a method that enables the exterior faces of silver chloride rich grains to be made up of a (111) plane. Examples of these methods are shown below.

| Patent(Publication) No. | Crystal habit controlling agent | Inventor |
|---|---|---|
| U.S. Pat. No. 4400463 | azaindenes + thioether peptizer | Maskasky |
| U.S. Pat. No. 4783398 | 2-4-dithiazolydinone | Mifune et al. |
| U.S. Pat. No. 4713323 | aminopyrazolopyrimidine | Maskasky |
| U.S. Pat. No. 4983508 | bispyridinium salt | Ishiguro et al. |
| U.S. Pat. No. 5185239 | triaminopyrimidine | Maskasky |
| U.S. Pat. No. 5178997 | 7-azodindole compound | Maskasky |
| U.S. Pat. No. 5178998 | xanthine | Maskasky |

-continued

| Patent(Publication) No. | Crystal habit controlling agent | Inventor |
|---|---|---|
| JP-A No. 64-70741 | dye | Nishikawa et al. |
| JP-A No. 3-212639 | aminothioether | Ishiguro |
| JP-A No. 4-283742 | thiourea derivative | Ishiguro |
| JP-A No. 4-335632 | triazolinium salt | Ishiguro |
| JP-A No. 7-146891 | monopyridinium salt | Oozeki et al. |

Despite the above-described technical developments, there is still the demand for an emulsion having a still higher level of sensitivity and little fogging as a preferable emulsion for use in photosensitive material for photograhing in particular.

Meanwhile, the couplers having the structure useful in the present invention are disclosed in, for example, U.S. Pat. Nos. 3,725,067, 4,500,630 and 4,500,654. However, these patents make no mention of the effect of these couplers in a silver halide color photographic photosensitive material in which a color image is formed by placing the photosensitive layer of a photosensitive material and the processing layer of a processing material face to face and by heating both materials. And, these patents make absolutely no mention of the effect of these couplers in a color photosensitive material for heat development having at least one photosensitive layer comprised of an emulsion comprising tabular silver halide grains having a silver chloride content of 50 mol % or more (1) wherein the tabular silver halide grains, which have major exterior faces made up of a (100) plane and a plane of projection of the grain in the shape of a rectangle of a length to width ratio ranging from 1:1 to 1:2 to give an aspect ratio of 2 or greater, account for 50% or more of the total projected area of the silver halide grains of the emulsion, or (2) wherein the tabular silver halide grains, which have major exterior faces made up of a (111) plane and a plane of projection of the grain in the shape of a hexagon with the ratio of the lengths of neighboring sides ranging from 1:1 to 1:10 to give an aspect ratio of 2 or greater, account for 50% or more of the total projected area of the silver halide grains of the emulsion.

SUMMARY OF THE INVENTION

A first object of the present invention is to provide a silver halide color photographic photosensitive material which enables simple and rapid image formation without serious fog generation while minimizing adverse effects on the environment.

A second object of the present invention is to provide a highly sensitive silver halide color photographic photosensitive material which enables simple and rapid processing for the formation of high-quality images while minimizing adverse effects on the environment.

A third object of the present invention is to provide an excellent silver halide color photographic photosensitive material which provides excellent graininess and exposure latitude even in the case of simple and rapid processing, and in particular to provide a silver halide color photosensitive material for photographing which produces high-quality images at maximum density.

The above-described objects of the present invention can be achieved by means of the silver halide color photographic photosensitive material having the following aspects.

The first aspect of the present invention is a silver halide color photographic photosensitive material comprising a support and photographic constituent layers formed thereon, said photographic constituent layers comprising at least one photosensitive layer comprising a photosensitive silver halide emulsion, a developing agent, a compound, which forms a dye by a coupling reaction with an oxidized form of the developing agent, and a binder, said silver halide color photographic photosensitive material after the exposure thereof being put together with a processing material, which comprises a support and a constituent layer coated thereon containing a base and/or a base precursor, in the presence of water supplied to the layer of the silver halide color photographic photosensitive material or to the layer of the processing material in an amount ranging from 1/10 to the equivalent of an amount which is required for the maximum swelling of the total of the layers of these materials so that the layers face each other, and being heated to form a color image in the silver halide color photographic photosensitive material, wherein the photosensitive silver halide emulsion comprises silver halide grains, which have a silver chloride content of 50 mol % or more and in which 50% or more of the exterior faces of the grain is made up of a (111), such that these silver halide grains account for 50% or more of the total projected area of the silver halide grains of the emulsion, and wherein the developing agent is a compound represented by any of the following formulas I to IV.

General formula I

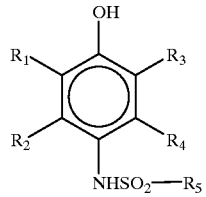

General formula II

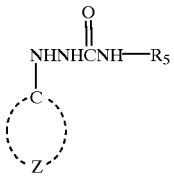

General formula III

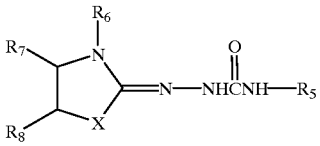

General formula IV

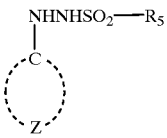

In the general formulas I to IV, $R_1$ to $R_4$ are selected from the group consisting of a hydrogen atom, a halogen atom, an alkyl group, an aryl group, an alkylcarbonamide group, an arylcarbonamide group, an alkylsulfonamide group, an arylsulfonamide group, an alkoxy group, an aryloxy group, an alkylthio group, an arylthio group, an alkylcarbamoly group, an arylcarbamoyl group, a carbamoyl group, an alkylsulfamoyl group, an arylsulfamoyl group, a sulfamoyl group, a cyano group, an alkylsulfonyl group, an arylsulfonyl group, an alkoxycarbonyl group, an aryloxycarbonyl group, an alkylcarbonyl group, an arylcarbonyl group and an acyloxy group. $R_5$ is selected from the group consisting of an alkyl group, an aryl group and a heterocyclic group. Z stands for a group of atoms forming a heterocyclic or aromatic ring and the total of Hammett's constants a of the substituents is 1 or greater if Z is a benzene ring. $R_6$ is an alkyl group. X is selected from the group consisting of an oxygen atom, a sulfur atom, a selenium atom and a tertiary nitrogen atom bearing an alkyl or aryl substituent. $R_7$ and $R_8$ are selected from the group consisting of a hydrogen atom and a substituent. $R_7$ and $R_8$ may join together to form a double bond or a ring. Each of the compounds represented by the general formulas I to IV contains at least one ballast group having 8 or more carbon atoms in order to impart oil solubility to the molecule.

The second aspect of the present invention is the silver halide color photographic photosensitive material of the first aspect, wherein the silver halide grains are prepared in the presence of at least one compound represented by the following General formula V

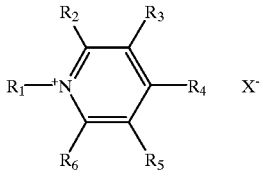

General formula VI

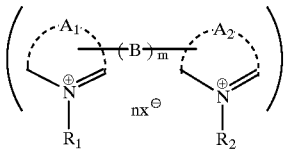

General formula VII

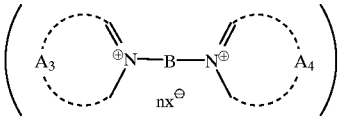

In the general formula V, $R_1$ is selected from the group consisting of an alkyl, an alkenyl and an aralkyl group. $R_2$, $R_3$, $R_4$, $R_5$ and $R_6$ are each selected from the group consisting of a hydrogen atom and a substituent. The couples $R_2$ and $R_3$, $R_3$ and $R_4$, $R_4$ and $R_5$ as well as $R_5$ and $R_6$ may each form a condensed ring. However, at least one of $R_2$, $R_3$, $R_4$, $R_5$ and $R_6$ is an aryl group. $X^-$ stands for a counter anion.

In the general formulas VI and VII, $A_1$, $A_2$, $A_3$ and $A_4$ may be the same or different and each stands for a group of non-metallic atoms for completing a nitrogen-containing heterocyclic ring. B stands for a divalent linking group. m is 0 or 1. $R_1$ and $R_2$ are each an alkyl group. X stands for an anion. n is 0 or 1 with the provision that n is 0 if an intramolecular salt is formed.

The third aspect of the present invention is the silver halide color photographic photosensitive material of the first or second aspect, wherein the silver halide emulsion comprises tabular silver halide grains, which have an aspect ratio of 5 or greater and the major exterior faces of the grain made up of a (111) plane, such that these tabular silver halide grains account for 50% or more of the total projected area of the silver halide grains of the emulsion.

The fourth aspect of the present invention is any of the silver halide color photographic photosensitive material of the first to third aspects, wherein at least one of the substitutents $R_1$ to $R_5$ in any of the compounds represented by the general formulas I to IV contains a ballast group having 8 or more carbon atoms.

The fifth aspect of the present invention is a silver halide color photographic photosensitive material comprising a support and at least one photosensitive layer thereon comprising a photosensitive silver halide emulsion, a compound, which forms a dye by a coupling reaction with an oxidized form of a developing agent, and a binder, the photosensitive layer of said silver halide color photographic photosensitive material being put together with the processing layer of a processing material so that the layers face each other, and being heated to form a color image in the silver halide color photographic photosensitive material, said at least one photosensitive layer comprising (1) an emulsion comprising tabular silver halide grains having a silver chloride content of 50 mol % or more, wherein the tabular silver halide grains, which have major exterior faces of the grain made up of a (100) plane and a plane of projection of the grain in the shape of a rectangle of a length to width ratio ranging from 1:1 to 1:2 to give an aspect ratio of 2 or greater, account for 50% or more of the total projected area of the silver halide grains of the emulsion, or (2) an emulsion comprising tabular silver halide grains having a silver chloride content of 50 mol % or more, wherein the tabular silver halide grains, which have major exterior faces of the grain made up of a (111) plane and a plane of projection of the grain in the shape of a hexagon with the ratio of the lengths of neighboring sides ranging from 1:1 to 1:10 to give an aspect ratio of 2 or greater, account for 50% or more of the total projected area of the silver halide grains of the emulsion, and said at least one photosensitive layer containing at least one of the pyrazolotriazole couplers represented by the following general formulas VIII or IX.

General formula VIII

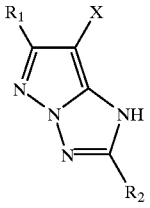

General formula IX

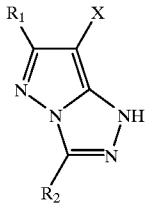

In the general formulas VIII and IX, $R_1$ is a secondary or tertiary alkyl group, $R_2$ is an alkyl or aryl group, while X stands for a hydrogen atom or a group which can split off at the time when the coupler undergoes a coupling reaction with the oxidized form of the developing agent.

The sixth aspect of the present invention is silver halide color photographic photosensitive material of the fifth aspect of the present invention, wherein the photosensitive layer of the photosensitive material comprises a developing agent and the processing layer of the processing material comprises a base and/or a base precursor and wherein, the photosensitive layer of the photosensitive material is put together with the processing layer of the processing material so that the layers face each other after water is supplied to the photosensitive layer of the photosensitive material and/or to the processing layer of the processing material. Then, heat development is carried out.

DESCRIPTION OF THE PREFERRED EMBODIMENTS

Figure 1:
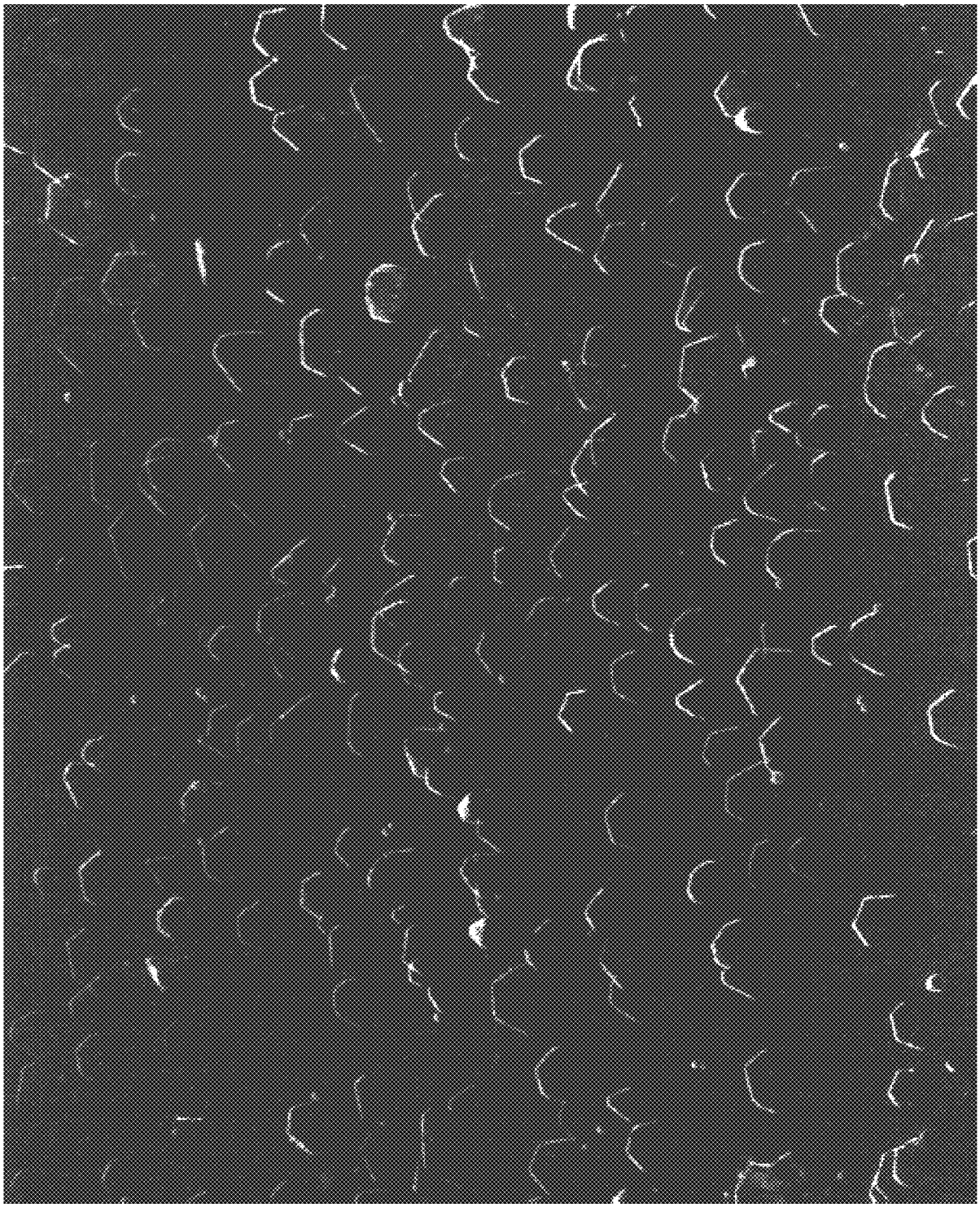
FIG. 1 is an electron microscope photograph showing the grain structure of the tabular grains of the emulsion B-1 prepared in examples.

Preferably, the photosensitive silver halide emulsion to be used in the first to fourth aspects of the present invention is a photosensitive silver halide emulsion, in which the silver halide grains have a silver chloride content of 50 mol % or more and in which 50% or more of the exterior faces of the grains is made up of a (111) plane, account for 50% or more of the total projected area of the silver halide grains of the emulsion. As stated previously, in order to prepare the (111) grains, various (crystal habit controlling) methods have been proposed. However, a particularly preferable method consists in the preparation of the silver halide emulsion in the presence of a compound (crystal habit controlling agent) represented by the aforementioned general formulas V, VI or VII.

The details of the crystal habit controlling agents represented by the formula V to be used in the present invention are given below.

In the general formula V, preferred examples of $R_1$ include a straight, branched or cyclic alkyl group having 1 to 20 carbon atoms (e.g., methyl, ethyl, isopropyl, t-butyl, n-octyl, n-decyl, n-hexyldecyl, cyclopropyl, cyclopentyl or cyclohexyl), an alkenyl group having 2 to 20 carbon atoms (e.g., an allyl, 2-butenyl or 3-pentenyl) and an aralkyl group having 7 to 20 carbon atoms (e.g., benzyl or phenethyl).

The groups represented by $R_1$ may be substituted by a substituent, examples of which include the following substitutable groups represented by $R_2$ to $R_6$.

$R_2$, $R_3$, $R_4$, $R_5$ and $R_6$ may be the same or different and represent a hydrogen atom or a group capable of substituting with a hydrogen atom. Examples of the substitutable group include the following groups.

A halogen atom (e.g., a fluorine, chlorine or bromine atom), an alkyl group (e.g., a methyl, ethyl, n-propyl, isopropyl, t-butyl, n-octyl, cyclopentyl or cyclohexyl group), an alkenyl group (e.g., an ally, 2-butenyl or 3-pentenyl group), an alkynyl group (e.g., a propargyl or 3-pentynyl group), an aralkyl group (e.g., a benzyl or phenethyl group), an aryl group (e.g., a phenyl, naphthyl or 4-methylphenyl group), a heterocyclic group (e.g., a pyridyl, furyl, imidazolyl, piperidyl or morpholino group), an alkoxy group (e.g., a methoxy, ethoxy or butoxy group), an aryloxy group (e.g., a phenoxy or 2-naphthyloxy group), an amino group (e.g., an unsubstituted amino, or dimethylamino, ethylamino or anilino group), an acylamino group (e.g., an acetylamino or benzolyamino group), a ureido groups (e.g., an unsubstituted ureido, N-methylureido or N-phenylureido group), a urethane group (e.g., a methoxycarbonylamino or phenoxycarbonylamino group), a sulphonylamino group (e.g., a methylsulphonylamino or phenylsulfonylamino group), a sulfamoyl group (such as an unsubstituted sulfamoyl, N,N-dimethylsulfamoyl or N-phenylsulfamoyl group), a carbamoly group (e.g., an unsubstituted carbamoyl, N,N-diethylcarbamoyl or N-phenylcarbamoyl group), a sulfonyl group (e.g., a mesyl and tosyl group), a sulfinyl group (e.g., a methylsulfinyl or phenylsulfinyl group), an alkyloxycarbonyl group (e.g., a methoxycarbonyl or ethoxycarbonyl group), an aryloxycarbonyl group (e.g., a phenoxycarbonyl group), an acyl group (e.g., an acetyl, benzoyl, formyl or pivalolyl group), an acyloxy group (e.g., an acetoxy or benzoyloxy group), a phosphoric acid amide group (e.g., an N,N-diethyl phosphoric acid amide group), an alkylthio group (e.g., a methylthio or ethylthio group), an arylthio group (e.g., a phenylthio group), a cyano group, a sulfo group, a carboxyl group, a hydroxyl group, a phosphono group, a nitro group, a sulfino group, an ammonio group (e.g., a trimethylammonio group), a phosphonio group and a hydrazino group. These groups may be substituted by a substituent, and, if these groups bear two or more substituents, the substituents may be the same or different.

The couples $R_2$ and $R_3$, $R_3$ and $R_4$, $R_4$ and $R_5$ as well as $R_5$ and $R_6$ may each be condensed to form a quinoline, isoquinoline or acridine ring.

X stands for a counter anion, examples of which include a halogen ion (e.g., a chloride and bromide ion), nitrate ion, sulfate ion, p-toluenesulfonate ion and trifluoromethanesulfonate ion.

In the general formula V, preferably $R_1$ is an aralkyl group, and at least one of $R_2$, $R_3$, $R_4$, $R_5$ and $R_6$ is an aryl group.

In the general formula V, more preferably $R_1$ is an aralkyl group; $R_4$ is an aryl group; and X is a halogen ion.

Concrete examples (crystal habit controlling agents 1 to 18) of the crystal habit controlling agent to be used in the present invention are given below. However, it should be noted that these examples present no limitation whatsoever to the present invention.

crystal habit controlling agent 1

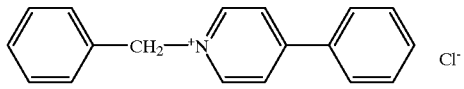

crystal habit controlling agent 2

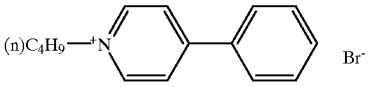

crystal habit controlling agent 3

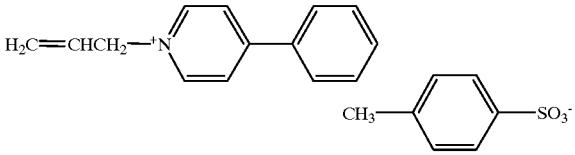

crystal habit controlling agent 4

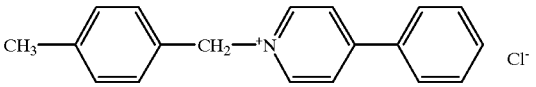

crystal habit controlling agent 5

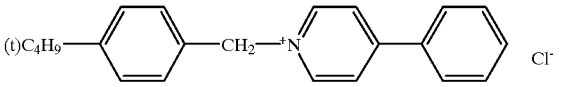

-continued crystal habit controlling agent 6

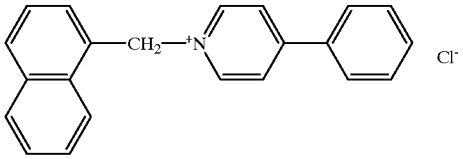

crystal habit controlling agent 7

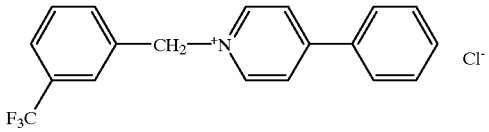

crystal habit controlling agent 8

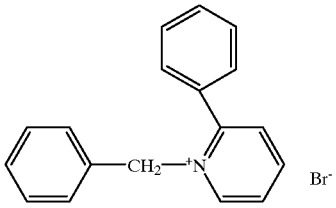

crystal habit controlling agent 9

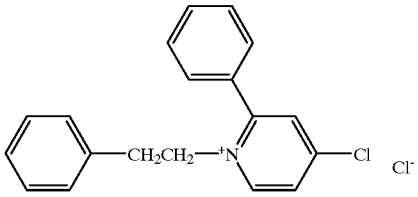

crystal habit controlling agent 10

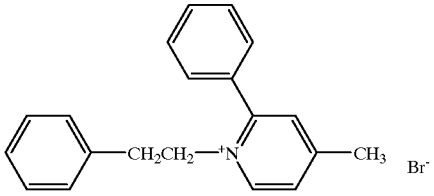

crystal habit controlling agent 11

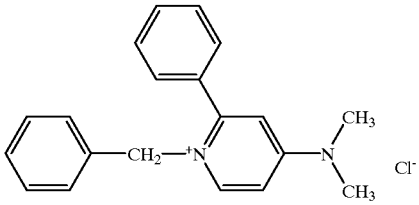

crystal habit controlling agent 12

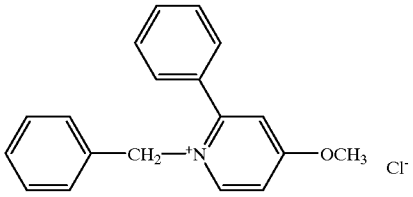

-continued crystal habit controlling agent 13

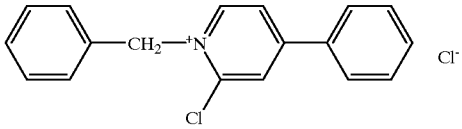

crystal habit controlling agent 14

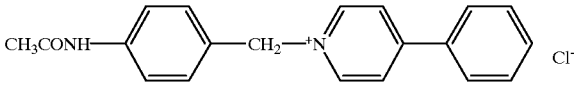

crystal habit controlling agent 15

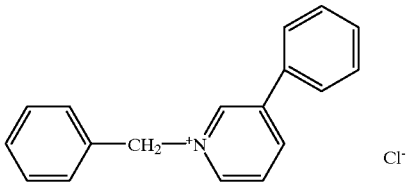

crystal habit controlling agent 16

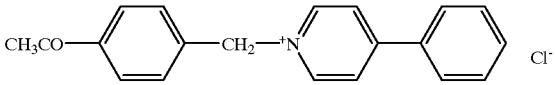

crystal habit controlling agent 17

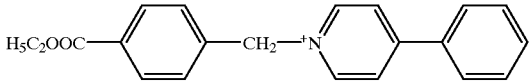

crystal habit controlling agent 18

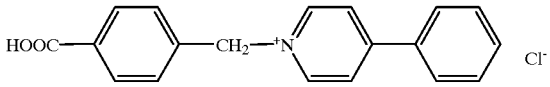

The details of the crystal habit controlling agents represented by the formulas VI and VII to be used in the present invention are given below.

In the general formulas VI and VII, $A_1$, $A_2$, $A_3$ and $A_4$ each stands for a group of non-metallic atoms for completing a nitrogen-containing heterocyclic ring, and may contain atoms such as an oxygen, nitrogen or sulfur atom. The benzene ring may form a condensed benzene ring. The heterocyclic ring composed of $A_1$, $A_2$, $A_3$ and $A_4$ may have a substituent or substituents which may be the same or different. Examples of the substituent include an alkyl group, and aryl group, an aralkyl group, an alkenyl group, a halogen atom, an acyl group, an alkoxycarbonyl group, an aryloxycarbonyl group, a sulfo group, a carboxyl group, a hydroxyl group, an alkoxy group, an aryloxy group, an amide group, a sulfamoyl group, a carbamoyl group, an ureido group, an amino group, a sulfonyl group, a cyano group, a nitro group, a mercapto group, an alkylthio group and an arylthio group. Preferably, $A_1$, $A_2$, $A_3$ and $A_4$ are selected from 5- to 6-membered rings (e.g., pyridine, imidazole, thiazole, oxazole, pyrazine and pyrimidine rings). More preferably, $A_1$, $A_2$, $A_3$ and $A_4$ are each a pyridine ring.

B stands for a divalent linking group, which is composed singly of or a combination of the following groups, i.e., alkylene, arylene, alkenylene, —$SO_2$—, —SO—, —O—, —S—, —CO—, and —N($R_2$)— ($R_2$ represents an alkyl group, an aryl group or a hydrogen atom). Preferably, B is alkylene or alkenylene.

$R_1$ and $R_2$ are each an alkyl group of from 1–20 carbon atoms, and $R_1$ and $R_2$ may be the same or different.

The alkyl group means a substituted or unsubstituted alkyl group, and the examples of the substituents are the same as those illustrated for $A_1$, $A_2$, $A_3$ and $A_4$.

Preferably, $R_1$ and $R_2$ are each an alkyl group of 4–10 carbon atoms. More preferably, $R_1$ and $R_2$ are each a substituted or unsubstituted aryl-substituted alkyl group.

$X^-$ stands for an anion, examples of which include a chloride ion, a bromide ion, an iodide ion, a nitrate ion, a sulfate ion, a p-toluenesulfonate ion and an oxalate ion. n is 0 or 1 and only 0 when an intramolecular salt is formed.

Concrete examples (crystal habit controlling agents 19 to 30) of the crystal habit controlling agents represented by the aforementioned general formulas II and III are given below. Other examples are disclosed in JP-A No. 2-32. However, it should be noted that these examples present no limitation whatsoever on the present invention.

crystal habit controlling agent 19

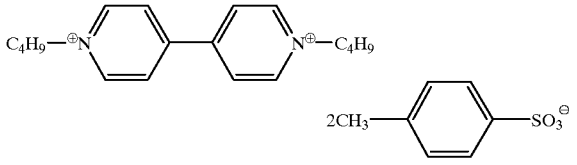

crystal habit controlling agent 20

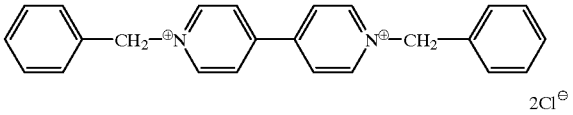

crystal habit controlling agent 21

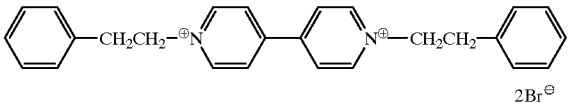

crystal habit controlling agent 22

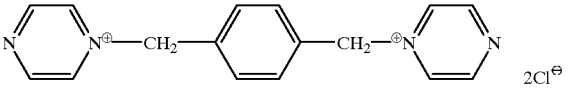

crystal habit controlling agent 23

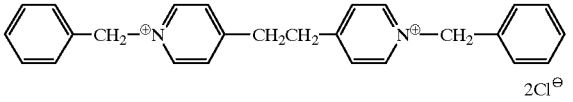

-continued crystal habit controlling agent 24

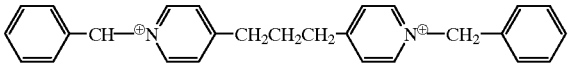

crystal habit controlling agent 25

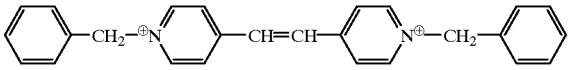

crystal habit controlling agent 26

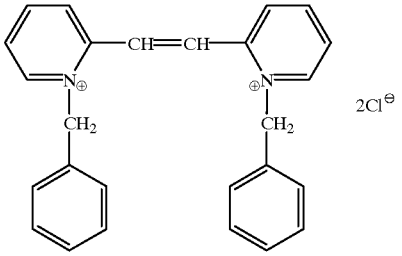

crystal habit controlling agent 27

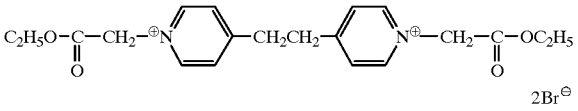

crystal habit controlling agent 28

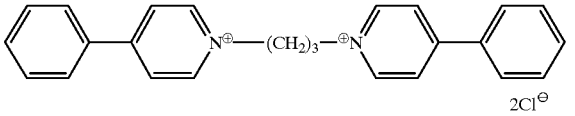

crystal habit controlling agent 29

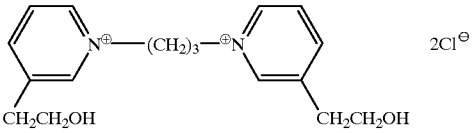

crystal habit controlling agent 30

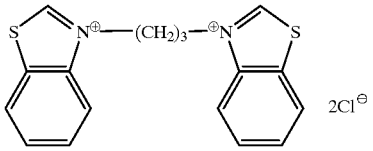

The amount of any of the crystal habit controlling agents used is preferably $6\times10^{-5}$ mol or more, and most preferably in the range of $3\times10^{-4}$ to $6\times10^{-2}$ mol per mol of silver halide in a completed emulsion.

The timing of the crystal habit controlling agent addition may be at any stage between the stage of nucleus formation and the stage of the physical development of the silver halide grains. After the addition of the crystal habit controlling agent, (111) plane growth begins. The crystal habit controlling agent may be placed in a reaction vessel in advance, or the crystal habit controlling agent may be added to the reaction vessel such that its concentration will increase as the grains grow.

In the preparation of the silver halide grains having a (111) plane, it is possible to prepare both regularly structured crystals (octahedron to tetradecahedron) and tabular grains. However, the preparation of any of the two groups separately depends mainly on the method for forming nuclei and also on the timing and amount of addition of the crystal habit controlling agent. The method for forming nuclei is described below.

(preparation of normal crystal habit grains)

It is preferable that the above-described crystal habit controlling agent be absent at the time when the nuclei are formed.

When the nuclei are formed, the chloride concentration should be 0.6 mol/l or less, preferably 0.3 mol/l or less, and most preferably 0.1 mol/l or less.

(preparation of tabular grains)

Tabular grains can be obtained by forming two parallel twin faces. Since the formation of the twin faces depends on such conditions as temperature, dispersing media (e.g., gelatin) and halogen concentrations, appropriate conditions need to be set up.

If the crystal habit controlling agent is present at the time when the nuclei are formed, the gelatin concentration is preferably 0.1 to 10%. The chloride concentration is 0.01 mol/l or more, and preferably 0.03 mol/l or more.

If the crystal habit controlling agent is not used at the time when the nuclei are formed, the gelatin concentration is 0.03 to 10%, and preferably 0.05 to 1.0%. The chloride concentration is 0.001 to 1 mol/l, and preferably 0.003 to 0.1 mol/l.

The temperature for the formation of nuclei may be any temperature between 2 and 90° C., but the temperature is preferably 5 to 80° C., more preferably 5 to 40° C.

The nuclei formed are grown in the presence of the crystal habit controlling agent by physical ripening and through the addition of a silver salt and a halide. In this case, the chloride concentration is 5 mol/l or less, and preferably 0.05 to 1 mol/l. The temperature for growing the nuclei may be any temperature between 10 and 90° C., but the temperature is preferably in the range of 30 to 80 C. If the amount of the dispersing medium employed at the time of nuclei formation becomes insufficient for the growth of the nuclei, replenishment of the medium is necessary. For this growth, it is preferable that gelatin in an amount of 10 to 60 g/l be present.

The pH at the time when the nuclei are formed is optional, but preferably it is in the range of neutral to acidic.

In the present invention, "the phrase silver chloride rich grains" means silver halide grains having a silver chloride content of 50 mol % or more. preferable 80 mol % or more, and most preferably 95 mol % or more. The portion other than silver chloride comprises silver bromide and/or silver iodide. The silver iodobromide layer can be localized on the surface of grains, and this is advantageous from the viewpoint of the adsorption of the sensitizing dye. The grain may be a so-called core/shell type grain.

The silver iodide content is 20 mol % or less, preferable 5 mol % or less, more preferably 2 mol % or less, and most preferably 1 mol % or less.

In the present invention, the silver halide grain has a surface made up of a (111) plane. The (111) planes comprises 50% or more, preferably 75% or more, and most preferably 90% or more of the total surface area (exterior face) of the grain. Quantitative determination of the (111) plane can be performed based on photographs of the produced silver halide grains taken by means of an electron microscope. In the present invention, the photosensitive silver halide emulsion is a silver halide emulsion in which the above-described silver halide grains account for 50% or more of the total projected area of the silver halide grains of the emulsion.

In the present invention, when the silver halide grains are normal habit crystals, the average grain size (equivalent-sphere diameter) is not particularly specified, but preferably 0.1 to 5 $\mu$m, and most preferably 0.2 to 3 $\mu$m.

In the present invention, if the silver halide grains are tabular, the diameter is preferably 0.3 to 5.0 $\mu$m, and most preferably 0.5 to 3.0 $\mu$m. The diameter of the silver halide grain as written here refers to the diameter of a circle having an area equivalent to the projected area of grains photographs of the silver halide grains taken by means of an electron microscope. The thickness is 0.4 $\mu$m or less, preferably 0.3 $\mu$m or less, and most preferably 0.2 $\mu$m or less. The volume-weighted mean volume is preferably 2 $\mu m^3$ or less, and more preferably 1 $\mu m^3$ or less. The ratio of diameter/thickness is preferably 2 or more, and more preferably in the range of 2 to 20.

Generally, a tabular grain is in the form of a plate having two parallel faces. Accordingly, in the present invention, the "thickness" is defined by the distance between the two parallel faces constituting the tabular grain.

In the above-mentioned silver halide grain, the ratio of the above-mentioned equivalent-circle diameter to the average thickness of the tabular grain is called the aspect ratio, which is preferably 5 or more in the present invention. If the aspect ratio is less than 5, the sensitivity is adversely affected. In the present invention, an average aspect ratio means an arithmetical average of the aspect ratios of all the tabular grains contained in the photosensitive silver halide emulsion. In the present invention, it is preferable that at least one kind of the silver halide grains be tabular grains having an aspect ratio of 5 or more and a (111) plane as the major exterior face.

In the present invention, the grain size distribution of the silver halide grains may be a polydispersion or a monodispersion, but a monodispersion is preferable.

The presence of the crystal habit controlling agent on grain surfaces after grain formation, influences adsorption of sensitizing dyes and development, etc. Therefore, it is preferable to eliminate the crystal habit controlling agent after the formation of grains. However, if the crystal habit controlling agent is eliminated, it is difficult for the silver chloride rich grains to maintain the (111) plane under ordinary conditions. Consequently, it is preferable to maintain the shape of the grains by means of substitution with sensitizing dye or a photographically useful compound. This method is described in, e.g., Japanese Patent Application Nos. 7,230,906 and 7-289,146 and U.S. Pat. Nos. 5,221,602, 5,286,452, 5,298,387, 5,298,388 and 5,176,992.

The above-mentioned method allows the crystal habit controlling agent to be desorbed from the grains, and the desorbed crystal habit controlling agent is preferably removed from the emulsion by means of water washing. The temperature for water washing may be a temperature which does not cause coagulation of the gelatin conventionally employed as a protective colloid. The method for water washing may be a known technique such as a flocculation method or ultrafiltration. If a pyridinium salt is used as the crystal habit controlling agent, the temperature for water washing is preferably 40° C. or higher, and most preferably 50° C. or higher. If a flocculation method is used, it is necessary to use a flocculant, examples of which include a sulfonic acid group-bearing flocculant and a carboxylic acid group-bearing flocculant. The pyridinium salt crystal habit controlling agent is difficult to remove by the water washing treatment, because it strongly interacts with the sulfonic acid group of the flocculent to form a salt even after the desorption from the grains. Therefore, it is preferable to use the carboxylic acid group-bearing flocculant. Examples of the carboxylic acid group-bearing flocculent are disclosed in British Patent No. 648,472.

A lower pH value accelerates the desorption of the crystal habit controlling agent from the grains. Therefore, the use of a lower pH in the water washing stage is preferred so long as the grains are not excessively flocculated.

According to the fifth and sixth aspects of the present invention, at least one photosensitive layer comprises (1) an emulsion comprising tabular silver halide grains having a silver chloride content of 50 mol % or more, wherein the tabular silver halide grains, which have major exterior faces made up of a (100) plane and a plane of projection of the grain in the shape of a rectangle of a length to width ratio ranging from 1:1 to 1:2 to give an aspect ratio of 2 or more, account for 50% or more of the total projected area of the silver halide grains of the emulsion, or (2) an emulsion comprising tabular silver halide grains having a silver chloride content of 50 mol % or more, wherein the tabular silver halide grains, which have major exterior faces made up of a (111) plane and a plane of projection of the grain in the shape of a hexagon with the ratio of the lengths of neighboring sides ranging from 1:1 to 1:10 to give an aspect ratio of 2 or more, account for 50% or more of the total projected area of the silver halide grains of the emulsion. Accordingly, the silver halide grains, which account for 50% or more, preferably 70% or more, of the projected area of the total silver halide grains contained in the emulsion, need to fulfill the above-described requirements.

In the present invention, the aspect ratio means a value obtained by dividing the diameter of a circle equivalent to the projected area by the thickness of the grain.

According to the fifth and sixth aspects of the present invention, the silver halide grain of the first embodiment (1) provides a plane of projection in the shape of a rectangle, because the grain has the major exterior faces made up of a (100) plane. In this case, the rectangle as a projected area needs to have a length to width ratio ranging from 1:1 to 1:2. That is, if an emulsion which comprises grains in a rectangular parallelepiped shape close to a rod or a cube is used, the effect of the present invention cannot be obtained. In the present invention, a preferable grain is tabular and has a plane of projection in the shape of a rectangle close to a square having a length to width ratio ranging from 1:1 to 1:1.5.

In the fifth and sixth aspects of the present invention, the silver halide grain of the second embodiment (2) provides a plane of projection in the shape of a hexagon, because the grain has the major exterior faces made up of a (111) plane. In this case, the hexagon as a projected area needs to have a ratio for the lengths of neighboring sides ranging from 1:1 to 1:10. That is, if an emulsion which comprises grains in a shape close to a triangle is used, the effect of the present invention cannot be obtained. In the present invention, the preferable grain is tabular and has a plane of projection close to a regular hexagon having a ratio for the lengths of neighboring sides ranging from 1:1 to 1:5.

The shapes of these silver halide grains can be measured under an electron microscope by means of a carbon replica method wherein the sample silver halide grains and reference latex spheres acting as a standard of size are synchronously subjected to a shadowing treatment with, for example, a heavy metal.

The silver halide composition of the present invention comprises silver chlorobromide, silver chloroiodide, silver chloroiodobromide or silver chloride each having a silver chloride content of 50 mol % or more. Although the emulsion in the present invention may contain silver iodide, the silver iodide content is 20 mol % or less, preferably 5 mol % or less, more preferably 2 mol % or less, and most preferably 1 mol % or less. It is also preferable to use a silver halide emulsion composed of silver halide grains each having a laminate internal structure made up of a plurality of layers having different halogen compositions. In the embodiment of the present invention, the size of a silver halide grain, which is expressed by the diameter of a circle having an area equivalent to the projected area of the grain, is preferably 0.1 to 10 $\mu$m, more preferably 0.3 to 5 $\mu$m and most preferably 0.5 to 4 $\mu$m.

A variety of methods, including known methods, can be used for the preparation of the emulsion to fulfill the fifth and sixth aspects of the present invention, i.e., the embodiment (1) i.e., an emulsion comprising tabular silver halide grains having a silver chloride content of 50 mol % or more, wherein the tabular silver halide grains have major exterior faces made up of a (100) plane and a plane of projection of the grain in the shape of a rectangle of a length to width ratio ranging from 1:1 to 1:2 to give an aspect ratio of 2 or more, or the embodiment (2) i.e., an emulsion comprising tabular silver halide grains having a silver chloride content of 50 mol % or more, wherein the tabular silver halide grains have major exterior faces made up of a (111) plane and a plane of projection of the grain in a shape of a hexagon with the ratio of the lengths of neighboring sides ranging from 1:1 to 1:10 to give an aspect ratio of 2 or more.

In the preparation of the emulsion of the embodiment (1) composed of silver chloride rich, tabular silver halide grains having the major exterior faces of the grain made up of a (100) plane, the methods described in, e.g., JP-A Nos. 5-204,073; 51-88,017; 63-24,238 and 7-146,522 can be used.

Meanwhile, in the fifth and sixth aspects of the present invention, for the preparation of the emulsion of the embodiment (2) composed of silver chloride rich, tabular silver halide grains having the major outer faces of the grains made up of a (111) plane, the methods described in, e.g., U.S. Pat. Nos. 4,399,215; 4,400,463 and 5,217,858, and JP-A No. 2-32 can be used. Since the silver chloride rich grain generally has a (100) plane as the exterior face in the absence of an adsorbed substance, the above-mentioned emulsion is prepared by a procedure comprising forming twin nuclei by use of an adsorptive substance which is selectively adsorbed on a (111) plane, selectively obtaining parallel, multiple-layered twin nuclei by eliminating nuclei of regularly- structured crystals, single-layered twin nuclei and non-parallel, multiple-layered twin nuclei, and growing the selectively obtained nuclei to prepare the photosensitive silver halide comprising tabular grains. An empirical rule of the growth of the tabular silver halide grains having a (111) plane is described in Journal of Photographic science, Vol. 36, p.182 (1988).

The key to the preparation of the tabular grains to be used in the present invention is the method of growth of the nuclei which grow in a tabular shape. For this purpose, as pointed out above, it is useful to add an iodide ion or bromide ion or to add a compound which is adsorbed selectively to a specific plane at an early stage of grain formation.

The average thickness of the tabular grains to be used in the present invention is preferably 0.01 to 0.5 μm, more preferably 0.01 to 0.4 μm, and most preferably 0.05 to 0.4 μm.

The average thickness of grains means an arithmetical average of the thicknesses of all of the tabular grains of the emulsion.

In order to prepare tabular grains having a high aspect ratio, it is important to grow small, twin nuclei. For this purpose, it is desirable to grow the nuclei at low temperature, high pBr, and low pH, using a small amount of gelatin, gelatin with a low methionine content, gelatin having a low molecular weight, a phthalated gelatin derivative and a shorter time period for the formation of nuclei.

After the formation of the nuclei, physical ripening is carried out to grow all-tabular grains (parallel, multiple-layered twin nuclei) by eliminating other nuclei, i.e., nuclei of normal habit crystals, single-layered twin nuclei and non-parallel, multiple-layered twin nuclei. Then, a soluble silver salt and a soluble halogen salt are added to the obtained nuclei to promote grain growth, and an emulsion comprising tabular grains is prepared.

The emulsion to be used in the present invention is preferably monodispersed.

The variation coefficient of the equivalent-circle diameters of the projected area of the total silver halide grains of the emulsion to be used in the present invention is preferably 30 to 3%, more preferably 25 to 3%, and most preferably 20 to 3%. The uniformity among grains is not very good if the coefficient exceeds 30%, but this does not limit the present invention.

The variation coefficient of the equivalent-circle diameter means a value obtained by dividing the standard deviation of the equivalent-circle diameters of individual silver halide grains by an average equivalent-circle diameter.

If the silver halide grains have phases containing iodides or chlorides, these phases maybe uniformly distributed within the grain or they may be localized.

Other silver salts, such as silver rhodanide, silver sulfide, silver selenide, silver carbonate, silver phosphate and silver salts of organic acids, may be present as separate grains or as part of the silver halide grains.

The tabular grains to be used in the present invention may have dislocation lines.

The dislocation lines are linear lattice defects present on the boundary between slipped regions and unslipped regions on crystal sliding surfaces.

Descriptions of the dislocation lines of the silver halide crystals are found in, e.g., (1) C. R. Berry, J. Appl. Phys., 27, 636 (1956), (2) C. R. Berry, D. C. Skilman, J. Appl. Phys., 35, 2165 (1964), (3) J. F. Hamilton, Phot. Sci. Eng., 11, 57 (1967), (4) T. Shiozawa, J. Soc. Phot. Sci. Jap., 34, 16 (1971), and (5) T. Shiozawa, J. Soc. Phot. Sci. Jap., 35, 213 (1972). The dislocation lines can be observed directly by X-ray diffractometry or low-temperature transmission electron microscopy.

When directly observing the dislocation line by transmission electron microscope, the silver halide grains are taken out of with care, so as not to cause generation of dislocation lines. The grains are then placed on a mesh for observation under the electron microscope. Then observation is carried out while the sample grains are kept in a cooled state in order to prevent any damage being caused by the electron beam (e.g., printout).

In this case, the use of high-voltage (200 kV or more per 0.25 μm of thickness) provides clearer results, because transmission of electron beams becomes more difficult as the thickness of the grain increases.

JP-A No. 63-220,238 discloses how dislocation lines are introduced into silver halide grains in a controlled manner.

Tabular grains having dislocation lines introduced demonstrated superior photographic characteristics such as sensitivity and reciprocity law than did tabular grains having no dislocation lines in.

In the case of tabular grains, by use of the electron microscopic photographs taken of the grain in the above-described way, the location and number of dislocations observed in the direction perpendicular to the major plane of the grains can be found.

Details of the emulsion of the present invention and of a photographic emulsion, which may be used in combination with the emulsion of the present invention but does not belong to the present invention, are explained below.

More concretely, the silver halide emulsion to be used in the present invention can be selected from silver halide emulsions prepared by methods described in, e.g., U.S. Pat. No. 4,500,626,column 50, U.S. Pat. No. 4,628,021, Research Disclosure (hereinafter abbreviated as RD) No. 17,029(1978), RD No. 17,643(December 1978), pp. 22–23, RD No. 18,716 (November 1979), pp. 648, RD No. 307, 105(November 1989), pp. 863–865, JP-A Nos. 62-253,159, 64-13,546, 2-236,546 and 3-110,555; P. Glafkides, Chemie et Phisque Photographique, Paul Montel, 1967; G. F. Duffin, Photographic Emulsion Chemistry, Focal Press, 1966; and V. L. Zelikman et al., Making and Coating Photographic Emulsion, Focal Press, 1964.

In the process for preparing the photosensitive silver halide emulsion of the present invention, it is preferable that a treatment to remove excessive salt, i.e., desalting, be conducted. For the removal of salt, employable methods include a noodle water-washing method in which salt is removed by gelation of gelatin and a flocculation method which utilizes such materials as an inorganic salt comprising a polyvalent anion (e.g., sodium sulfate), an anionic surfactant, an anionic polymer (e.g., sodium polystyrenesulfonate) or a gelatin derivative (e.g., aliphatic-acylated gelatin, aromatic-acylated gelatin and aromatic-carbamoylated gelatin). A flocculation method is preferably used.

For a variety of purposes, the photosensitive silver halide emulsion in the present invention may contain a heavy metal such as iridium, rhodium, platinum, cadmium, zinc, thallium, lead, iron and osmium. These heavy metals may be used alone or in a combination of two or more of them. Although the amount added of such heavy metals is selected depending on the purpose of use, it is generally in the range of $10^{-9}$ to $10^{-3}$ mol per mol of silver halide. The heavy metal may be present uniformly in silver halide grains or may be present in a localized manner within or on the surface of silver halide grains. Preferred examples of these emulsions are the emulsions described in JP-A Nos. 2-236,542; 1-116, 637and 5 -181,246.

Such compound as a rhodanate, ammonia, a tetra-substituted thiourea compound, an organic thioether derivative described in JP-B No. 47-11,386 or a sulfur-containing compound described in JP-A No. 53-144,319 may be used as a solvent for silver halide in the grain forming stage for the photosensitive silver halide emulsion to be used in the present invention.

For other conditions for the silver halide grain formation, reference can be made, for example, to P. Glafkides, Chemie et Phisque Photographique, Paul Montel, 1967; G. F. Duffin, Photographic Emulsion Chemistry, Focal Press , 1966; and V. L. Zelikman et al., Making and Coating Photographic Emulsion, Focal Press, 1964. That is, an employable method may be selected from an acidic method, a neutral method and an ammonia method. Further, any method selected from a single jet method, a double jet method and a combination thereof may be used as a method for reacting a soluble silver salt with a soluble halogen salt. A double jet method is preferable for obtaining a monodispersed emulsion.

An inverse mixing method in which grains are formed in the presence of an excess of silver ion can also be employed. A so-called controlled double jet method in which the pAg of the liquid phase for the formation of silver halide is kept constant can also be employed as a double jet method.

Meanwhile, the concentrations, amounts to be added and adding rates of the silver salt and halide salt may be increased in order to accelerate the growth of the grains (JP-A Nos. 55-142,329 and 55-158,124 and U.S. Pat. No. 3,650,757).

The stirring of the reaction mixture may be effected by any known method. Further, the temperature and pH of the reaction mixture during the formation of silver halide grains maybe selected depending on the purpose. The pH is preferably in the range of 2.2 to 7.0, and more preferably 2.5 to 6.0.

A photosensitive silver halide emulsion is normally a chemically sensitized silver halide emulsion. A sensitizing method by means of chalcogen, such as sulfur sensitization, selenium sensitization or tellurium sensitization, a sensitizing method by means of a noble metal, such as gold, platinum or palladium, and a sensitizing method by means of reduction, which are known sensitizing methods in the preparation of conventional photosensitive emulsions, may be used alone or in combination thereof as a chemically sensitizing method for the photosensitive silver halide emulsion of the present invention (see, for example, JP-A Nos. 3-110,555 and 5-241,267). These chemical sensitizations can be performed in the presence of a nitrogen-containing heterocyclic compound (JP-A No. 62-253,159). Also, an anti-fogging agent, described later, may be added to a silver halide emulsion after the chemical sensitization thereof. More concretely, the methods, which are described in JP-A Nos. 5-45,833 and 62-40,446, can be used. When a chemical sensitization is carried out, the pH is preferably in the range of 5.3 to 10.5, and more preferably 5.5 to 8.5, while pAg is preferably in the range of 6.0 to 10.5, and more preferably 6.8 to 9.0.

The total coating weight of the photosensitive silver halide to be used in the present invention is preferably in the range of 100 mg to 10 g/m$^2$, and more preferably 1 g to 5 g/m$^2$, based on the weight of silver.

In order to impart color-sensitivity, such as green-sensitivity or red-sensitivity, to the photosensitive silver halide to be used in the present invention, the photosensitive silver halide emulsion is spectrally sensitized by means of a methine dye or the like. Further, if necessary, a blue-sensitive emulsion may be spectrally sensitized in order to increase sensitivity to blue color region.

Examples of employable dyes include cyanine dyes, merocyanine dyes, complex cyanine dyes, complex merocyanine dyes, holopolar cyanine dyes, hemicyanine dyes, styryl dyes and hemioxonol dyes.

More concrete examples of these sensitizing dyes are disclosed, for example, in U.S. Pat. No. 4,617,257 and JP-A Nos. 59-180,550, 64-13,546; 5-45,828 and 5-45,834.

Although these sensitizing dyes may be used alone, they may also be used in a combination thereof. A combination of these sensitizing dyes is often used particularly for supersensitization or for wavelength adjustment of spectral sensitization.

The photosensitive silver halide emulsion to be used in the present invention may contain a compound which is a dye having no spectral sensitization effect itself or a compound substantially incapable of absorbing visible light but which exhibits a supersensitizing effect (e.g., compounds described in U.S. Pat. No. 3,615,641 and JP-A No. 63-23, 145).

These sensitizing dyes can be added to the emulsion at the stage of chemical ripening or thereabout, or before or after the formation of the nuclei of the silver halide grains in accordance with the descriptions in U.S. Pat. Nos. 4,183,756 and 4,225,666. These sensitizing dyes or supersensitizers may be added to the emulsion as a solution in an organic solvent, such as methanol, a dispersion in gelatin or a liquid containing a surfactant. The amount to be added is generally in the range of $10^{-8}$ to $10^{-2}$ mol per mol of silver halide.

Known photographic additives, which are used in the above-described processes and in the present invention, are described in the aforementioned RD Nos. 17,643, 18,716 and 307,105. The following table shows the additives together with relevant references.

| Additives | RD17,643 | RD18,716 | RD307,105 |
|---|---|---|---|
| 1. Chemical sensitizers | page 23 | page 648, right column | page 866 |
| 2. Sensitivity increasing agents | | page 648, right column | |
| 3. Spectral sensitizers, supersensitizers | pages 23–24 | page 648, right column to page 649, right column | pages 866–868 |
| 4. Brighteners | page 24 | page 648, right column | page 868 |
| 5. Anti-fogging agents, stabilizers | pages 24–25 | page 649, right column | pages 868–870 |
| 6. Light absorbents, filter dyes, ultraviolet absorbents | pages 25–26 | page 649, right column to page 650, left column | page 873 |
| 7. Dye image stabilizers | page 25 | page 650, left column | page 872 |
| 8. Gelatin hardeners | page 26 | page 651, left column | pages 874–875 |
| 9. Binders | page 26 | page 651, left column | pages 873–874 |
| 10. Plasticizers, lubricants | page 27 | page 650, right column | page 876 |
| 11. Coating aids, surfactants | pages 26–27 | page 650, right column | pages 875–876 |
| 12. Antistatic agents | page 27 | page 650, right column | pages 876–877 |
| 13. Matting agents | | | pages 878–879 |

The photosensitive material of the present invention comprises a support and photographic constituent layers formed thereon containing at least one photographic photosensitive layer comprising a photosensitive silver halide, a compound (hereinafter referred to as a coupler), which forms a dye by a coupling reaction with an oxidized form of a developing agent, and a binder.

In the present invention, color reproduction according to substractive color process can be basically used for the preparation of a photosensitive material used for reproduction of original scenes as color images. That is, the color information of the original scene can be recorded by means of a color negative film having at least three photosensitive layers, each having sensitivity to the blue, green and red wavelength region of light, respectively, and being incorporated, respectively, with a color coupler capable of producing a yellow, magenta or cyan dye as a complementary color to the sensitive wavelength region of the layer. Through the thus obtained color image, color photographic paper, which has a sensitive wavelength to developed color hue relationship identical to that of the color negative film, is optically exposed to thereby reproduce the original scene. Alternatively, it is also possible to reproduce an image for enjoyment by reading out by means of a scanner the information of the color dye image obtained by taking a photograph of an original scene.

The photosensitive material of the present invention can comprise three or more photosensitive layers, each of which has sensitivity to light of a wavelength different to the other two.

In addition, the relationship between the sensitive wavelength region and developed color hue of layer may be different from the complementary color relationship described above. In this case, it is possible to reproduce the original color information by image processing, e.g., color hue conversion, of the image information which has been read out as described above.

Preferably, the photosensitive material of the present invention comprises at least two silver halide emulsions which are sensitive to the same wavelength region and have different average grain projected areas. The term "sensitivity to the same wavelength region" as referred to herein means sensitivity to practically the same wavelength region. Therefore, emulsions with slightly different distributions of spectral sensitivity but having main photosensitive regions which overlap with each other, are deemed to be emulsions having photosensitivity in the same wavelength region.

In the above-mentioned emulsions, the difference between the average grain projected area of one emulsion to that of the other emulsion has preferably a factor of at least 1.25, more preferably at least 1.4, and most preferably 1.6. In the case where three or more emulsions are used, it is preferable that the emulsion with the largest average grain projected area, and the emulsion with the smallest average grain projected area, have this relationship.

In the present invention, a plurality of emulsions, the photosensitivity of each of which lies in the same wavelength region and the average grain projected areas of which are different, may be incorporated in different photosensitive layers or may be incorporated in the same photosensitive layer.

In the case where these emulsions are incorporated in different layers, it is preferable that the layer which contains the emulsion having the largest average grain projected area, be positioned in an upper layer (closer to the incident light).

In the case where these emulsions are incorporated in different photosensitive layers, it is preferable that the color couplers to be used in combination with these emulsions produce the same hue. However, a color coupler which is incorporated in one of the photosensitive layers may be different from a color coupler which is incorporated in another photosensitive layer so that the photosensitive layers produce different developed color hues, or otherwise the photosensitive layers may have couplers leading to different absorption profiles for a hue.

In the present invention, when coating these emulsions which have a sensitivity to the same wavelength region, it is preferable that the ratio of the number of silver halide grains contained in one emulsion per unit area of the photosensitive material exceeds the ratio of the coated amount of silver, which is to be obtained by coating the emulsion, divided by (average grain projected area of silver halide grains contained in the emulsion)$^{3/2}$, by a greater margin as the average grain projected area of grains contained in the emulsion becomes larger in comparison with other emulsions. By the above-described construction, it is possible to obtain an image which has satisfactory graininess, even when the photosensitive material is processed under high temperature development conditions. In addition, it is also possible to fulfill the requirements for high developability and broad latitude of exposure at the same time.

The pyrazolotriazole couplers, which are used in the fifth and sixth aspects of the present invention, can be represented by general formulas VIII or IX.

General formula VIII

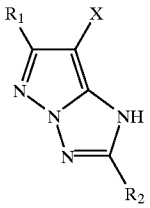

General formula IX

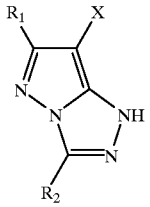

In the general formulas VIII and IX, $R_1$ is a secondary or tertiary alkyl group, $R_2$ is an alkyl or aryl group, while X stands for a hydrogen atom or a group which can split off when the coupler undergoes a coupling reaction with the oxidized form of the developing agent.

The details of the above-mentioned couplers to be used in the present invention are given below.

In the present invention, a primary alkyl group means an alkyl group in which a linking carbon atom bears one carbon atom and two hydrogen atoms or heteroatoms; a secondary alkyl group means an alkyl group in which a linking carbon atom bears two carbon atoms and one hydrogen atom or heteroatom; and a tertiary alkyl group means an alkyl group in which a linking carbon atom bears three carbon atoms.

In the general formulas VIII and IX, $R_1$ is a secondary or tertiary alkyl group having 3 to 32 carbon atoms, which may bear a substituent and in which branched alkyl groups may join together to form a ring. Examples of $R_1$ include isopropyl, 2-butyl, 3-pentyl, cyclopropyl, cyclopentyl, cyclohexyl, dicyclohexylmethyl, diphenylmethyl, 1,3-dimethylcyclohexane-2-il, t-butyl, t-amyl, 1-methyl-1-cyclopropyl, 1-ethyl-1-cyclopropyl, 1-methyl-1-cyclopropentyl, 1-methyl-1-cyclohexyl, 1,1,3,3-tetramethyl-1-butyl and 1-adamantyl. Examples of the substituent of $R_1$ include halogen atoms (e.g., fluorine, chlorine and bromine atoms), alkyl groups (preferably straight, branched or cyclic alkyl groups having 1 to 32 carbon atoms, e.g., methyl, ethyl, propyl, isopropyl, butyl, t-butyl, 1-octyl, tridecyl, cyclopropyl, cyclopentyl, cyclohexyl, 1-norbornyl and 1-adamantyl groups), aryl groups (preferably aryl groups having 6 to 32 carbon atoms, e.g., phenyl, 1-naphthyl and 2-naphthyl groups), heterocyclic groups (preferably, 5- to 8-membered heterocyclic groups having 1 to 32 carbon atoms, e.g., 2-ethynyl, 4-pyridyl, 2-furyl, 2-pyrimidinyl, 1-pyridyl. 2-benzothiazolyl, 1-imidazolyl, 1-pyrazolyl and benzotriazole-2-il groups), cyano groups, silyl groups (preferably silyl groups having 3 to 32 carbon atoms, e.g., trimethylsilyl, triethylsilyl, tributylsilyl, t-butyldimethylsilyl and t-hexyldimethylsilyl groups), hydroxyl groups, nitro groups, alkoxy groups (preferably alkoxy groups having 1 to 32 carbon atoms, e.g., methoxy, ethoxy and 1-butoxy, 2-butoxy, isopropoxy, t-butoxy and dodecyloxy groups), cycloalkyloxy groups (preferably cycloalkyloxy groups having 3 to 8 carbon atoms, e.g., cyclopentyloxy and cyclohexyloxy groups), aryloxy groups (preferably aryl groups having 6 to 32 carbon atoms, e.g., phenoxy and 2-naphthoxy groups), heterocycloxy groups (preferably heterocycloxy groups having 1 to 32 carbon atoms, e.g., 1-phenyltetrazole-5-oxy, 2-tetrahydropyranyloxy and 2-furyloxy groups), silyloxy groups (preferably silyloxy groups having 1 to 32 carbon atoms, e.g., trimethylsilyloxy, t-butyldimethylsilyloxy and diphenylmethylsilyloxy groups), acyloxy groups (preferably acyloxy groups having 2 to 32 carbon atoms, e.g., acetoxy, pivaloyloxy, benzoyloxy and dodecanoyloxy groups), alkoxycarbonyloxy groups (preferably alkoxycarbonyloxy groups having 2 to 32 carbon atoms, e.g., ethoxycarbonyloxy and t-butoxycarbonyloxy groups), cycloalkyloxycarbonyloxy groups (preferably cycloalkyloxycarbonyloxy groups having 4 to 9 carbon atoms. e.g., cyclohexyloxycarbonyloxy group), aryloxycarbonyloxy groups (preferably aryloxycarbonyloxy groups having 7 to 32 carbon atoms, e.g., phenoxycarbonyloxy group), carbamoyloxy groups (preferably carbamoyloxy groups having 1 to 32 carbon atoms, e.g., N,N-dimethylcarbamoyloxy, and N-butylcarbamoyloxy group), sulfamoyloxy groups (preferably sulfamoyloxy groups having 1 to 32 carbon atoms, e.g., N,N-diethylsulfamoyloxy and N-propylsulfamoyloxy groups), alkanesulfonyloxy groups (preferably alkanesulfonyloxy groups having 1 to 32 carbon atoms, e.g., methanesulfonyloxy and hexadecansulfonyloxy groups), arylenesulfonyloxy groups (preferably arylenesulfonyloxy groups having 6 to 32 carbon atoms, e.g., benzenesulfonyloxy group), acyl groups (preferably acyl groups having 1 to 32 carbon atoms, e.g., formyl, acetyl, pivaloyl, benzoyl and tetradecanoyl groups), alkoxycarbonyl groups (preferably alkoxycarbonyl groups having 2 to 32 carbon atoms, e.g., methoxycarbonyl, ethoxycarbonyl and octadecylcarbonyloxy groups), cycloalkyloxycarbonyl groups (preferably cycloalkyloxycarbonyl groups having 2 to 32 carbon atoms, e.g., cyclopentyloxycarbonyl and cyclohexyloxycarbony group), aryloxycarbonyl groups (preferably aryloxycarbonyl groups having 7 to 32 carbon atoms, e.g., phenoxycarbonyl group), carbamoyl groups (preferably carbamoyl groups having 1 to 32 carbon atoms, e.g., carbamoyl, N,N-dibutylcarbamoyl, N-ethyl-N-octylcarbamoyl and N-propylcarbamoyl groups), amino groups (amino groups preferably having 32 or less carbon atoms, e.g., amino, methylamino, N,N-dioctylamino, tetradecylamino and octadecylamino groups), anilino groups (preferably anilino groups having 6 to 32 carbon atoms, e.g., anilino and N-methylanilino groups), heterocyclic amino groups (preferably heterocyclic amino groups having 1 to 32 carbon atoms, e.g., 4-pyridylamino group), carbonamide groups (preferably carbonamide groups having 2 to 32 carbon atoms, e.g., acetamide, benzamide and tetradecanamide groups), ureido groups (preferably ureido groups having 1 to 32 carbon atoms, e.g., ureido, N,N-dimethylureido and-N-phenylureido groups), imido groups (imido groups preferably having 10 or less carbon atoms, e.g., N-succinimido and N-phthalimide groups), alkoxycarbonylamino groups (preferably alkoxycarbonylamino groups having 2 to 32 carbon atoms, e.g., methoxycarbonylamino, ethoxycarbonylamino. t-butoxycarbonylamino and octadecyloxycarbonylamino groups), aryloxycarbonylamino groups (preferably aryloxycarbonylamino groups having 7 to 32 carbon atoms, e.g., phenoxycarbonylamino group), sulfonamido groups (preferably sulfonamido groups having 1 to 32 carbon atoms, e.g., methanesulfonamido, butanesulfonamide, benzenesulfoneamido and hexadecanesulfonamide groups), sulfamoylamino groups (preferably sulfonamoylamino groups having 1 to 32 carbon atoms, e.g., N,N-dipropylsulfamoylamino and N-ethyl-N-dodecylsulfamoylamino groups), azo groups (preferably azo groups having 1 to 32 carbon atoms, e.g., phenylazo and 4-methoxyphenylazo groups), alkylthio groups (preferably alkylthio groups having 1 to 32 carbon atoms, e.g., ethylthio and octylthio groups), arylthio groups (preferably arylthio groups having 6 to 32 carbon atoms, e.g., phenylthio group), heterocyclic thio groups (preferably heterocyclic thio groups having 1 to 32 carbon atoms, e.g., 2-benzothiazolylthio, 2-pyridylthio and 1-phenyltetrazolylthio groups), alkylsulfinyl groups (preferably alkylsulfinyl groups having 1 to 32 carbon atoms, e.g., dodecanesulfinyl group), arylenesulfinyl groups (preferably arylenesulfinyl groups having 6 to 32 carbon atoms, e.g., benzenesulfinyl group), alkanesulfonyl groups (preferably alkanesulfonyl groups having 1 to 32 carbon atoms, e.g., methanesulfonyl and octanesulfonyl groups), arylenesulfonyl groups (preferably arylenesulfonyl groups having 6 to 32 carbon atoms, e.g., benzenesulfonyl and 1-naphthalenesulfonyl group), sulfamoyl groups (sulfamoyl groups preferably having 32 or less carbon atoms, e.g., sulfamoyl, N,N-dipropylsulfamonyl and N-ethyl-N-dodecylsulfamoyl groups), sulfo groups, phosphonyl groups (preferably phosphonyl groups having 1 to 32 carbon atoms, e.g., phenoxyphosphonyl, octyloxyphosphonyl and phenylphosphonyl groups), and phosphinoylamino groups (e.g., diethoxyphosphinoylamino and dioctyloxyphosphinoylamino groups).

Preferred examples of the substituent linked to a group represented by $R_1$ are halogen atoms, alkyl, aryl, silyl, hydroxyl, carboxyl, alkoxy, aryloxy, alkoxycarbonyl, carbamoyl, carbonamide, alkoxycarbonylamino, aryloxycarbonylamino, ureido, sulfonamide, imido, alkylthio, arylthio, alkanesulfonyl, arylenedulfonyl, phosphonyl and phophinoylamino groups. However, $R_1$ cannot be methyl in the compounds represented by the general formula (IX).

$R_2$ represents an alkyl group or an aryl group, wherein the preferable number of carbon atoms and concrete examples of these groups are the same as those enumerated in the explanation of $R_1$. The group represented by $R_2$ preferably bears a substituent, examples of which are the same as those enumerated in the explanation of the substituents of $R_1$. Particularly preferred examples of the substituents linked to the alkyl group or aryl group represented by $R_2$ include halogen atoms, alkyl, cycloalkyl, aryl, silyl, hydroxyl, carboxyl, nitro, alkoxy, aryloxy, acyloxy, carbamoyloxy, alkoxycarbonyl, cycloalkyloxycarbonyl, aryloxycarbonyl, carbamoyl, amino, anilino, carbonamide, alkoxycarbonylamino, aryloxycarbonylamino, ureido, sulfonamide, imido, alkylthio, arylthio, sulfamoyl, phosphonyl and phophinoylamino groups.

X stands for a hydrogen atom or a group which can split off when the coupler undergoes a coupling reaction with the oxidized form of the developing agent. Examples of the group which can split off include alkoxy, aryloxy, acyloxy, carbamoyloxy, sulfonyloxy, carbonamide, sulfonamide, carbamoylamino, heterocyclic, arylazo, alkylthio, arylthio and heterocyclic thio groups. Preferred scope and concrete examples of the halogen atoms and the groups which can split off are the same as those enumerated in the explanation of the substituents linked to the groups represented by $R_1$. In the case where X is a group which can split off, X may also bear a substituent, preferable examples of which are the same as those enumerated in the explanation of $R_1$. Further, X can be a bis-type coupler in which 2 molecules of 4-equivalent couplers are linked via an aldehyde or ketone. Furthermore, X can be a photographically useful group, or a precursor thereof, of a compound such as a development accelerator, a development inhibitor, a desilvering accelerator.

The preferred scope of the couplers to be used in the present invention is explained below.

The group represented by $R_1$ is preferably a tertiary alkyl group. The tertiary alkyl group is more preferably t-butyl, t-amyl, 1-methyl-1-cyclopropyl, 1-ethyl-1-cyclopropyl, 1-methyl-1-cyclopentyl, 1-methyl-1-cyclohexyl, 1,1,3,3-tetramethyl-1-butyl or 1-adamantyl, and is most preferably t-butyl.

The group represented by $R_2$ is preferably represented by the following general formula (X) or (XI).

General formula (X)

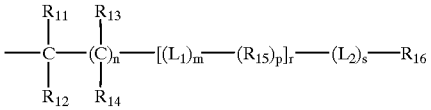

General formula (XI)

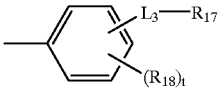

In the general formula (X), $R_{11}$, $R_{12}$, $R_{13}$ and $R_{14}$ represent each a hydrogen atom, an alkyl group or an aryl group, wherein the preferable number of carbon atoms and concrete examples of the alkyl and aryl groups are the same as those enumerated in the explanation of $R_1$. $L_1$ stands for —O—, —S—, —SO— or —$SO_2$—. $R_{15}$ represents an alkylene group (which preferably has 1 to 10 carbon atoms in the main chain and 1 to 32 carbon atoms in the chains including substituents, examples of which include methylene, ethylene, propylene and butylene). Alternatively, $R_{15}$ represents an arylene group (which preferably has 6 to 32 carbon atoms, examples of which include 1,4-phenylene, 1,3-phenylene, 1,2-phenylene and 1,4-naphthylene). $L_2$ stands for —N($R_{19}$)CO—, —N($R_{19}$)CON($R_{20}$)—, —N($R_{19}$)$CO_2$—, —N($R_{19}$)$SO_2$—, —N($R_{19}$)$SO_2$N($R_{20}$)—, —OCO—, —$OCO_2$—, —OCON($R_{19}$)—, —$CO_2$—, —CON($R_{19}$)— or —$SO_2$N ($R_{19}$)—, where $R_{19}$ and $R_{20}$ represent each a hydrogen atom, an alkyl, aryl, acyl, alkanesulfonyl orarylenesulfonyl group, wherein the preferable number of carbon atoms and concrete examples of these groups are the same as the alkyl, aryl, acyl, alkanesulfonyl and arylenesulfonyl groups for the explanation of $R_1$. $R_{16}$ represents an alkyl or aryl group wherein the preferable number of carbon atoms and concrete examples of these groups are the same as the alkyl and aryl groups for the explanation of $R_1$. n is an integer of 0 to 3; m, p and s are each 0 or 1; and r is an integer of 0 to 2. $R_{11}$, $R_{12}$, $R_{13}$, $R_{14}$, $R_{15}$, $R_{16}$, $R_{19}$ and $R_{20}$ may bear a substituent, preferred examples of which are the same as those enumerated as preferred examples of the substitutent linked to the groups represented by $R_1$.

In the general formula (XI), $L_3$ has the same meaning as that of $L_2$ in the general formula (X); $R_{17}$ has the same meaning as that of $R_{16}$ in the general formula (X); $R_{18}$ represents the same substituents as those linked to the group represented by $R_1$; and t is an integer of 0 to 4. $R_{17}$ and $R_{18}$ may bear a substituent, examples of which are the same as those enumerated as preferred examples of the substituent linked to the groups represented by $R_1$.

More preferably, the group represented by $R_2$ is represented by one of the following general formulas (XII), (XIII) or (XIV).

general formula (XII)

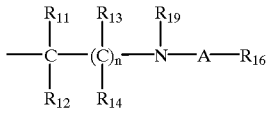

general formula (XIII)

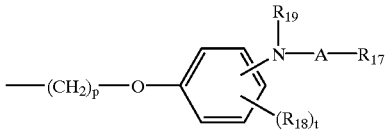

general formula (XIV)

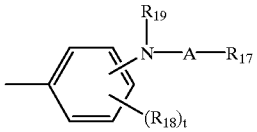

$R_{11}$, $R_{12}$, $R_{13}$, $R_{14}$, $R_{16}$, $R_{19}$ and n in the general formula (XII) have the same meanings as those of $R_{11}$, $R_{12}$, $R_{13}$, $R_{14}$, $R_{16}$, $R_{19}$ and n in the general formula (X); and A stands for —CO— or —$SO_2$—.

$R_{17}$, $R_{18}$ and $R_{19}$ in the general formula (XIII) have the same meanings as those of $R_{17}$, $R_{18}$ and $R_{19}$ in the general formulas (X) and (XI), and p is an integer of 1 to 4.

$R_{17}$, $R_{18}$, $R_{19}$ and t in the general formula (XIV) have the same meanings as those of $R_{17}$, $R_{18}$, $R_{19}$ and t in the general formula (XI).

More preferably, in the general formula (XII), $R_{11}$ and $R_{12}$ are each a hydrogen atom or an alkyl group; $R_{13}$ and $R_{14}$ are each a hydrogen atom; n is 0 or 1; $R_{16}$ is a substituted alkyl or substituted aryl group; and $R_{19}$ is a hydrogen atom.

More preferably, in the general formula (XIII), $R_{17}$ is a substituted alkyl or substituted aryl group; $R_{19}$ is a hydrogen atom; p is 2 or 3; and t is 0. Most preferably, —N($R_{19}$)-A-$R_{17}$ is linked to a para-position in relation to —O—.

More preferably, in the general formula (XIV) , R17 is a substituted alkyl or substituted aryl group; $R_{19}$ is a hydrogen atom; and t is 0. Most preferably, A is —CO—; and —N($R_{19}$)-A-$R_{17}$ is linked to a para-position in relation to a pyrazolotriazole nucleus.

In the general formulas (VIII) and (IX), X is selected preferably from the group consisting of a hydrogen atom, a halogen atom, aryloxy, carbamoyloxy, acylamino, heterocyclic, arylazo, alkylthio, arylthio and heterocyclothio groups; more preferably from the group consisting of a halogen atom, aryloxy, heterocyclic, alkylthio, arylthio and heterocyclothio groups; and most preferably from the group consisting of chlorine, aryloxy groups and a hydrogen atom. Examples of X are given below.

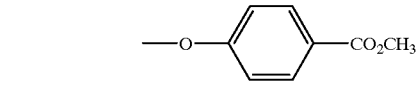
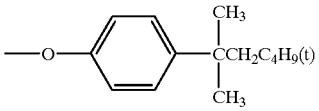
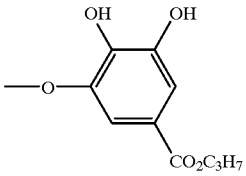
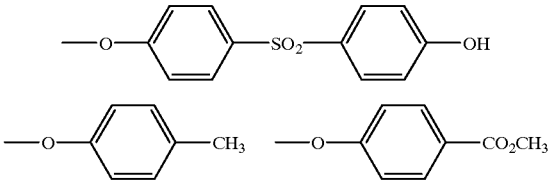
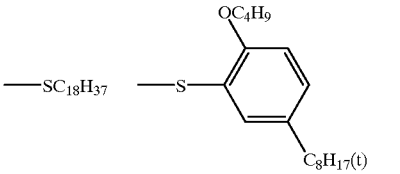
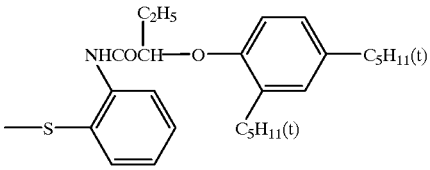
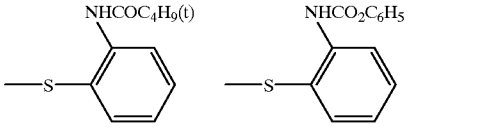
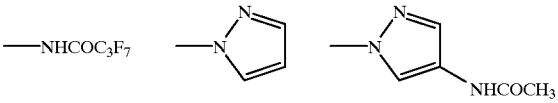
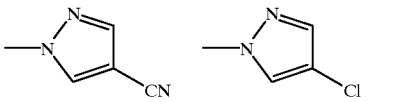
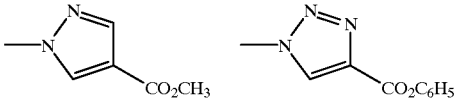
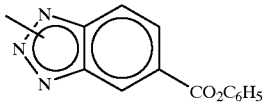
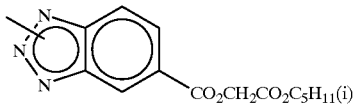
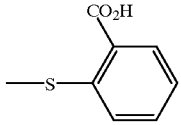
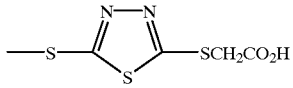
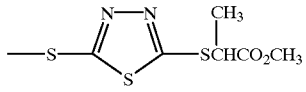
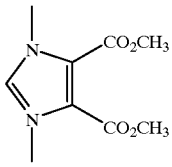
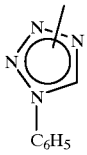
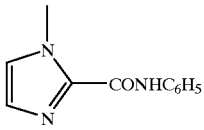
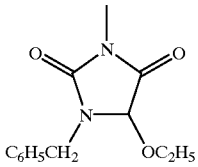
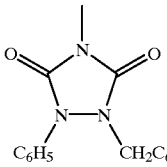
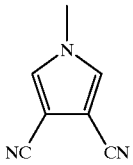
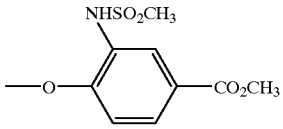
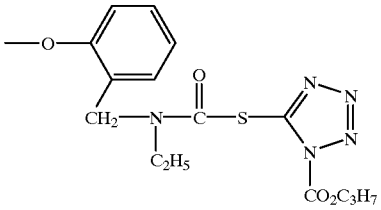
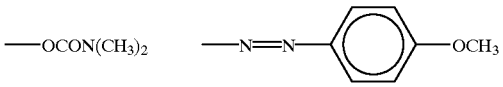
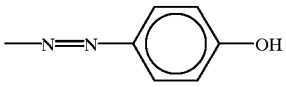
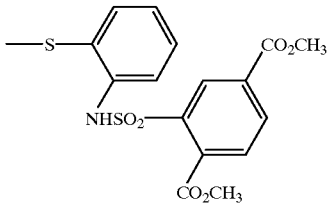
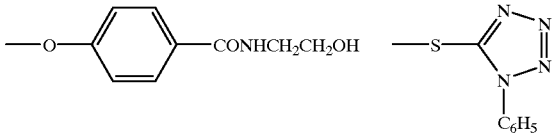
Cl F Br I $SCH_2CO_2H$ -continued

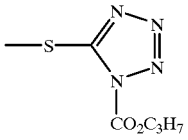

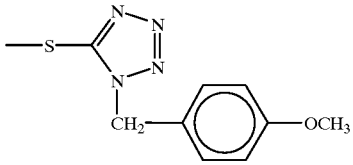

In the compounds represented by the general formula (XIII), preferably $R_1$ is a t-butyl group; $R_2$ is a group represented by the general formula (XII), (XIII) or (XIV); and X is a halogen atom; more preferably $R_1$ is a t-butyl group; $R_2$ is a group represented by the general formula (XII) or (XIV); and X is a chlorine atom; and most preferably $R_1$ is a t-butyl group; $R_2$ is a group represented by the general formula (XII); and X is a chlorine atom.

Examples of the pyrazolotriazole couplers, which can be used in the fifth and sixth aspects of the present invention and which can be represented by the general formula (VIII) or (IX) are given below. However, the present invention is not limited by these examples.

I-1

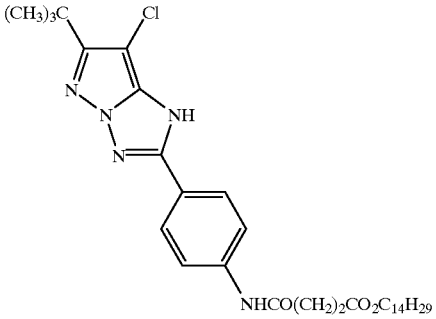

I-2

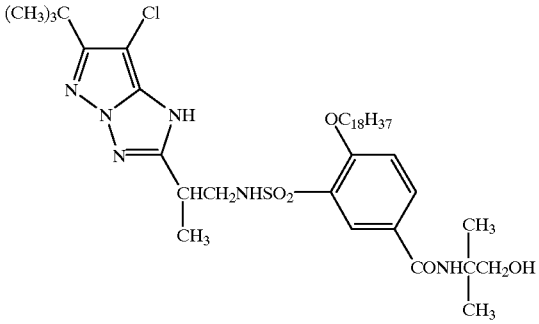

I-3

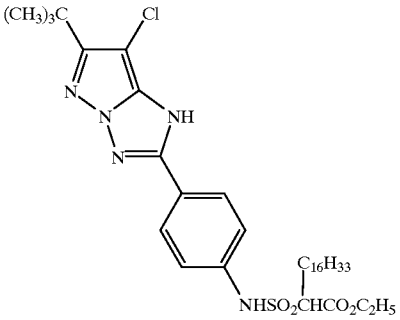

-continued

I-4

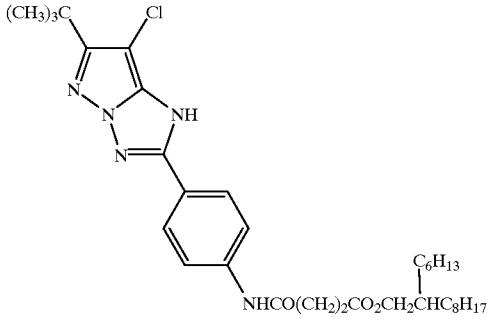

I-5

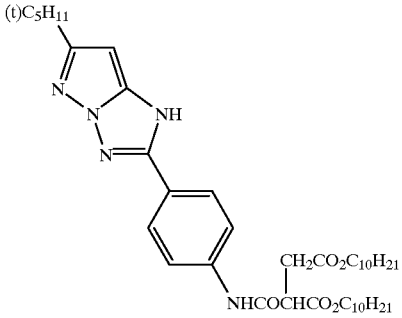

I-6

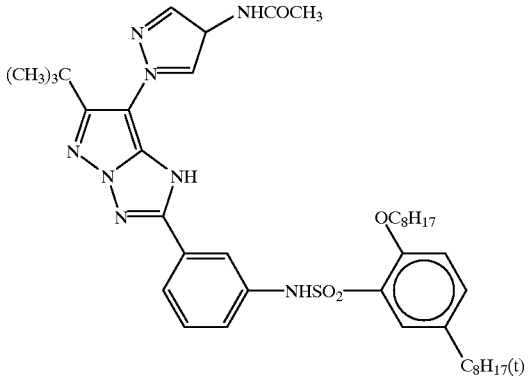

I-7

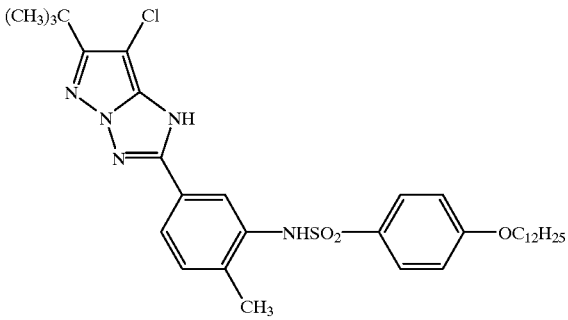

-continued
I-8
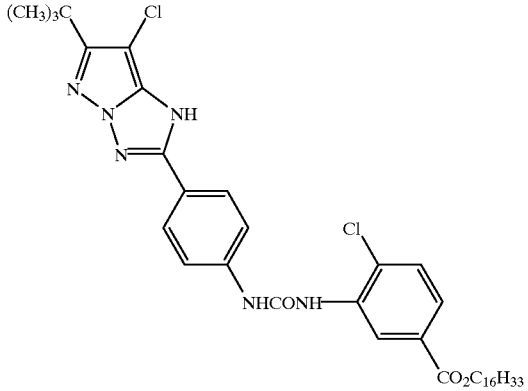
I-9
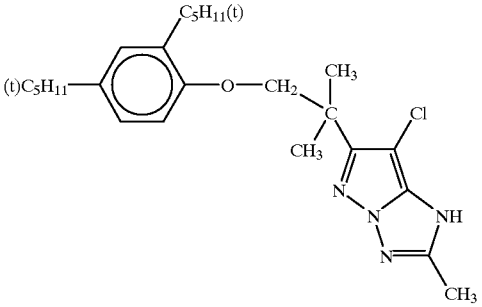
I-10
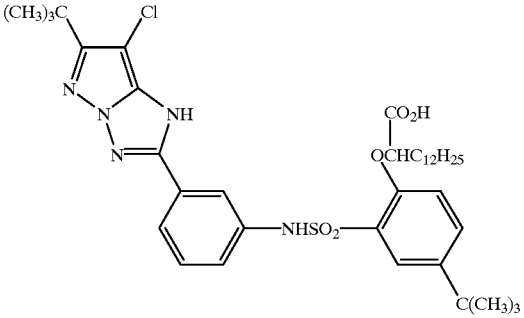
I-11
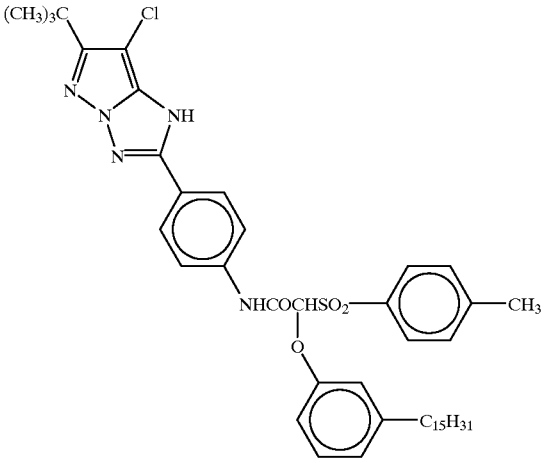
-continued
I-12
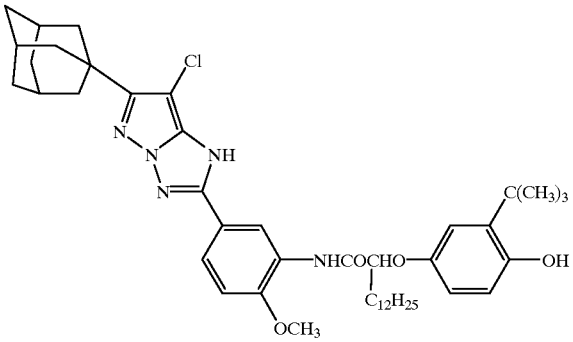
I-13
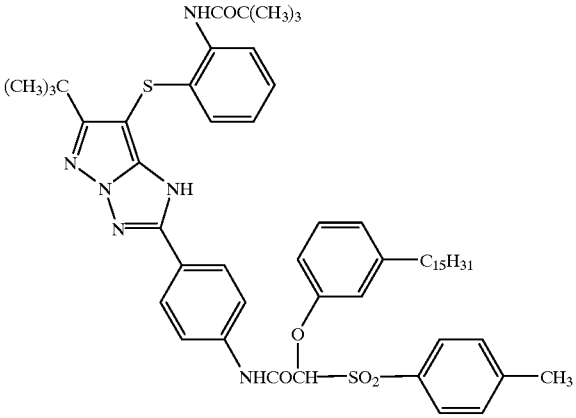
I-14
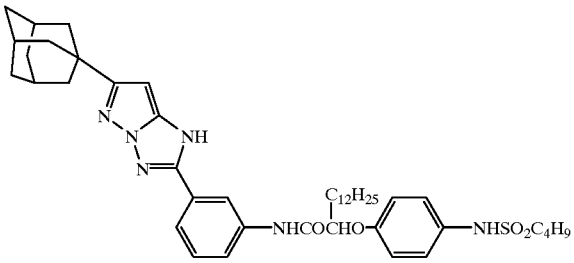
I-15
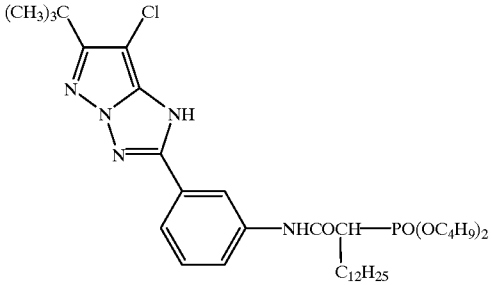

-continued
I-16
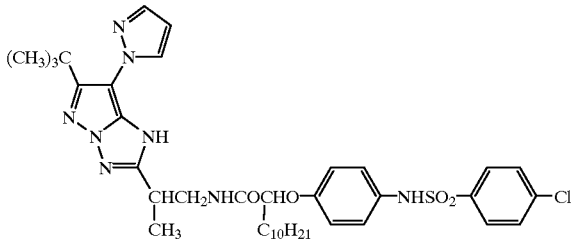
I-17
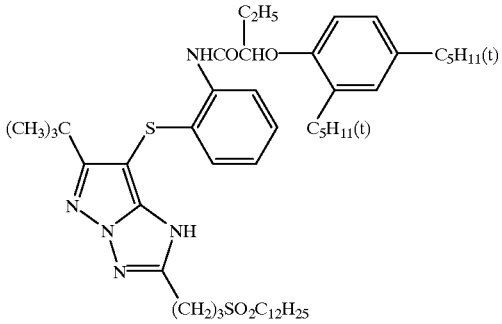
I-18
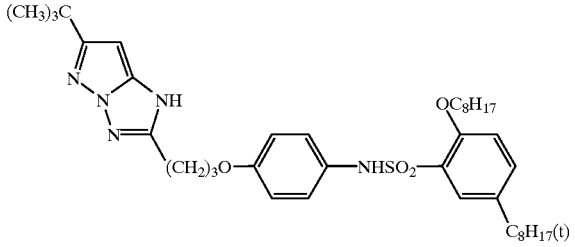
I-19
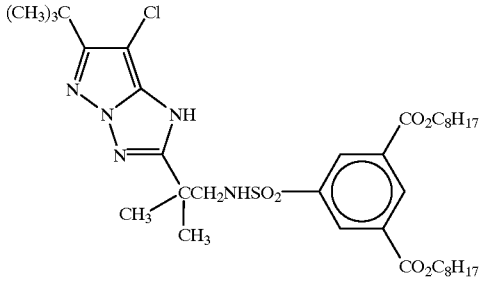
I-20
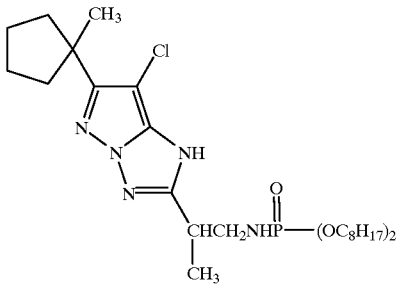
-continued
I-21
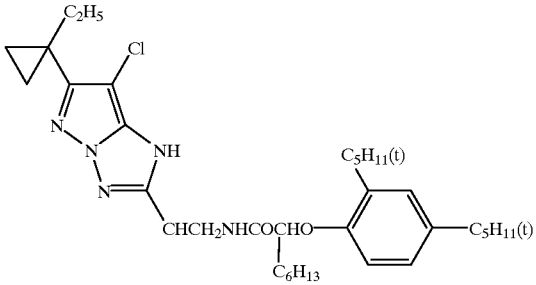
I-22
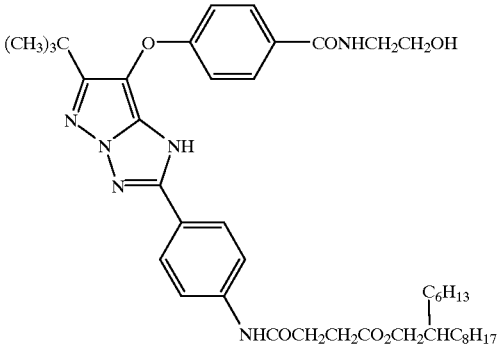
I-23
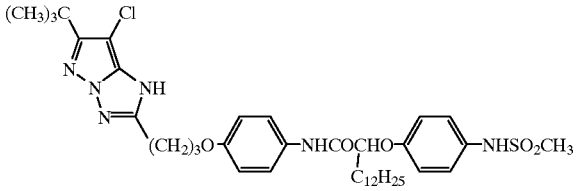
I-24
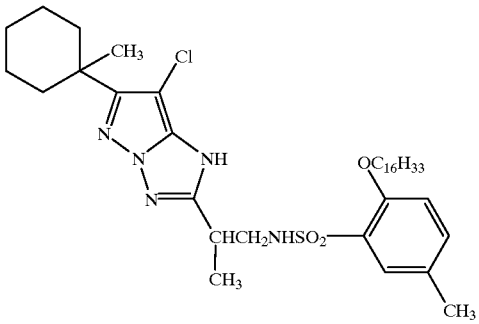
I-25
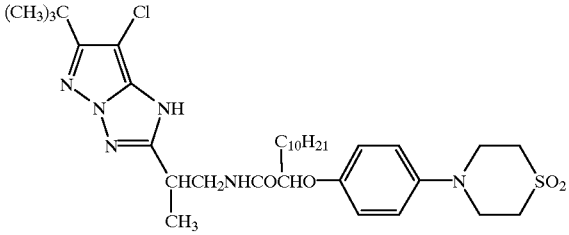

-continued
I-26
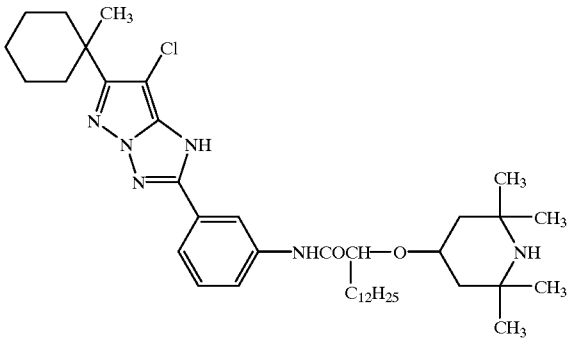
I-27
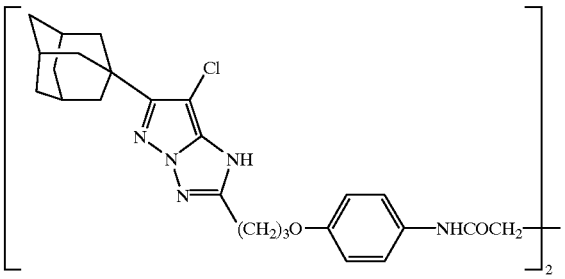
I-28
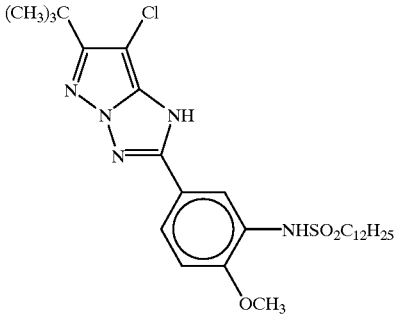
I-29
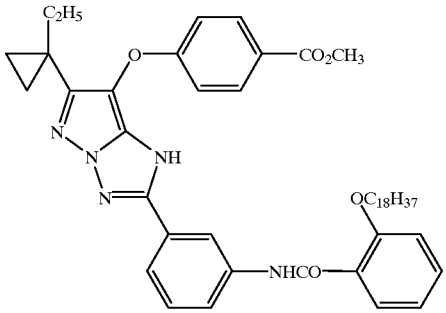
I-30
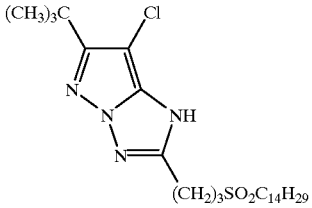
-continued
I-31
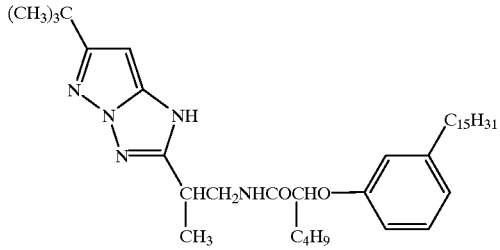
I-32
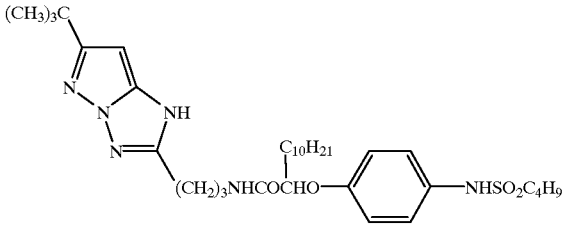
I-33
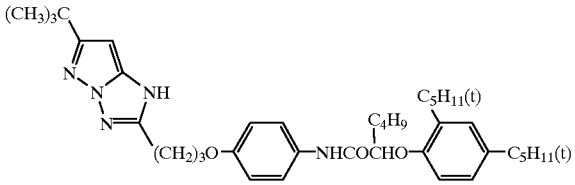
I-34
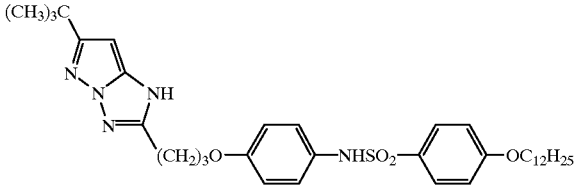
I-35
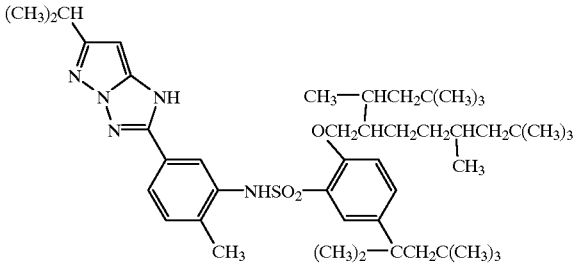
I-36
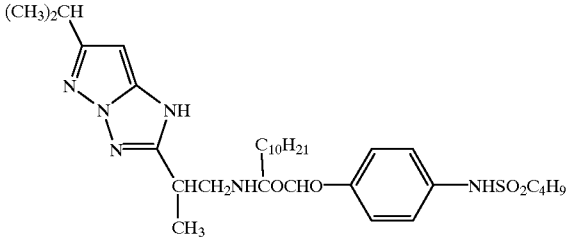

-continued
I-37
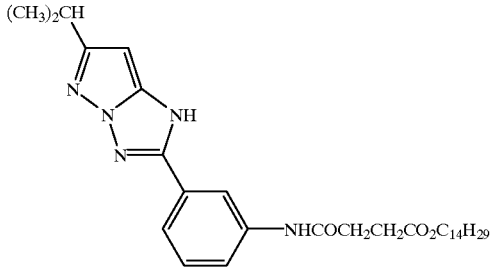
I-38
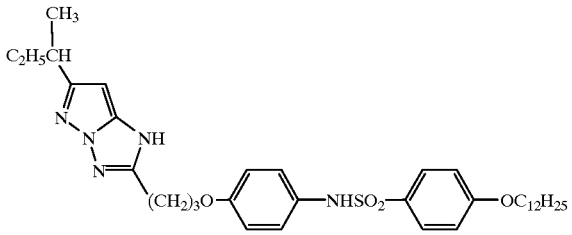
II-1
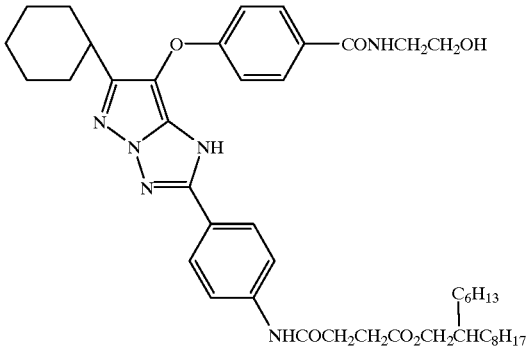
II-2
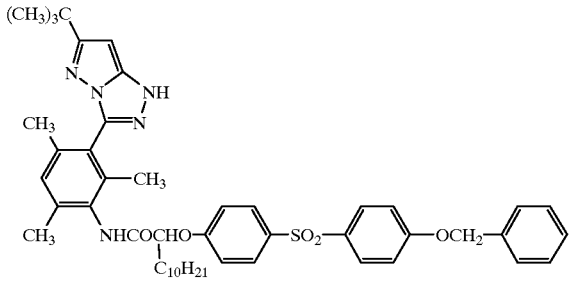
II-3
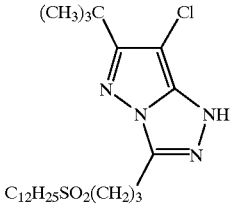
-continued
II-4
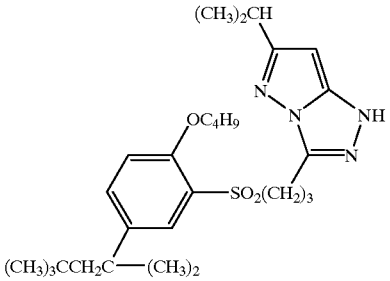
II-5
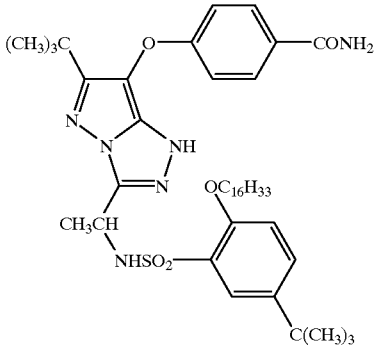
II-6
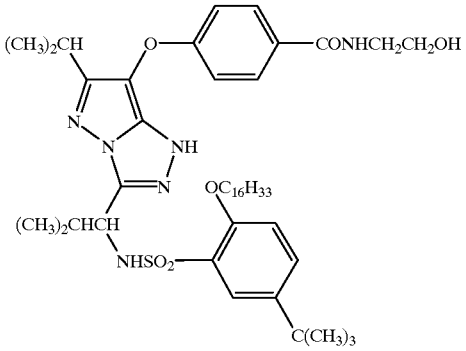
II-7
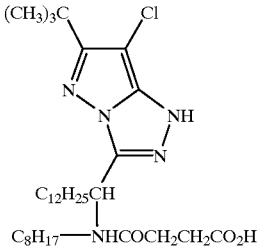
II-8
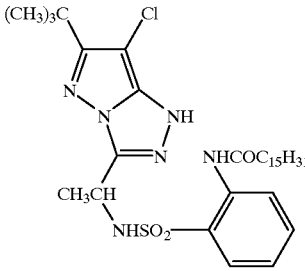

These compounds can be synthesized by commonly known methods. The synthetic processes are briefly described below.
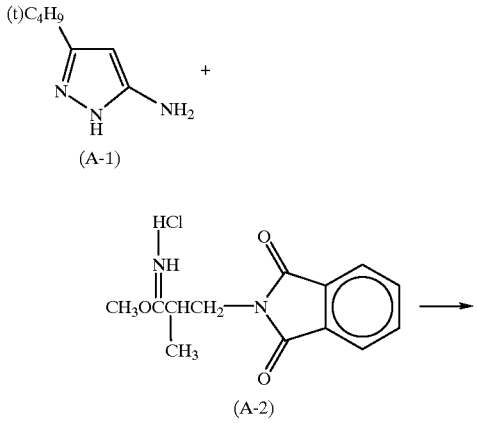
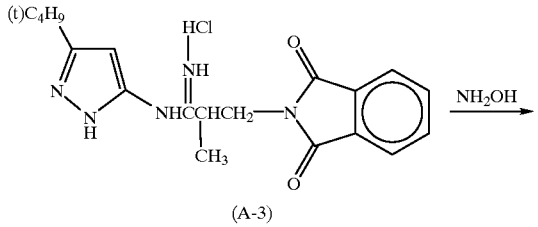
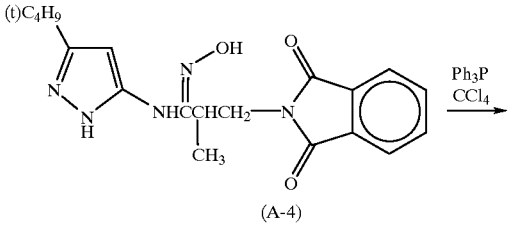
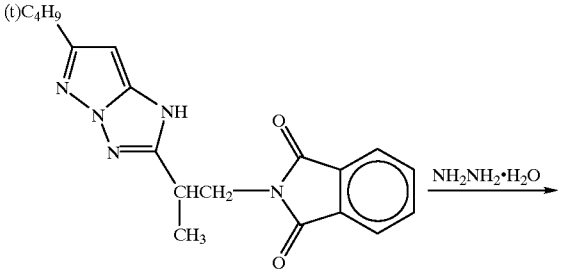
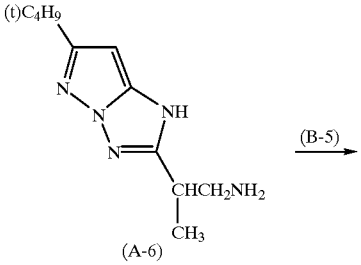
-continued
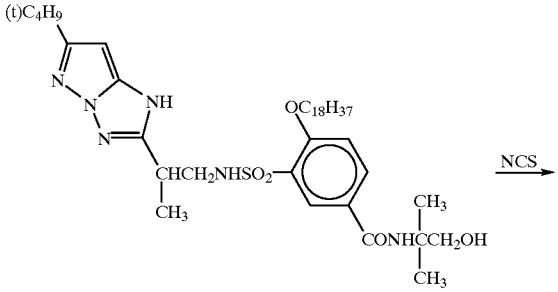
Illustrated compound 1-2
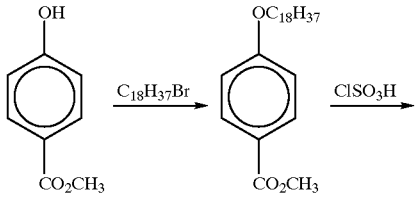
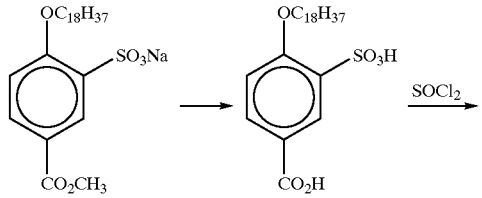
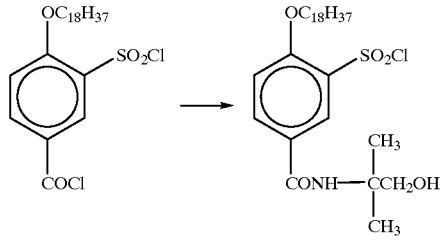
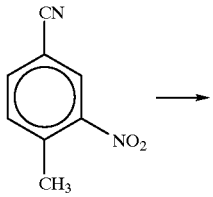
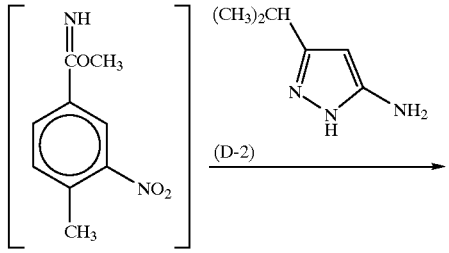

-continued
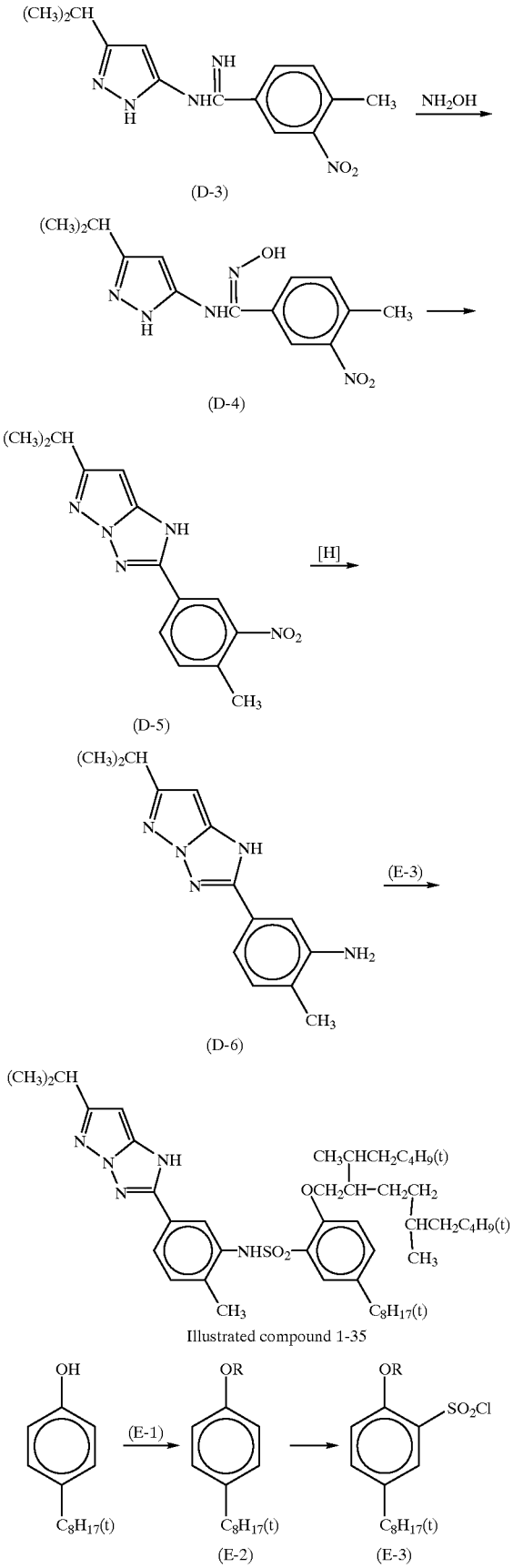
-continued
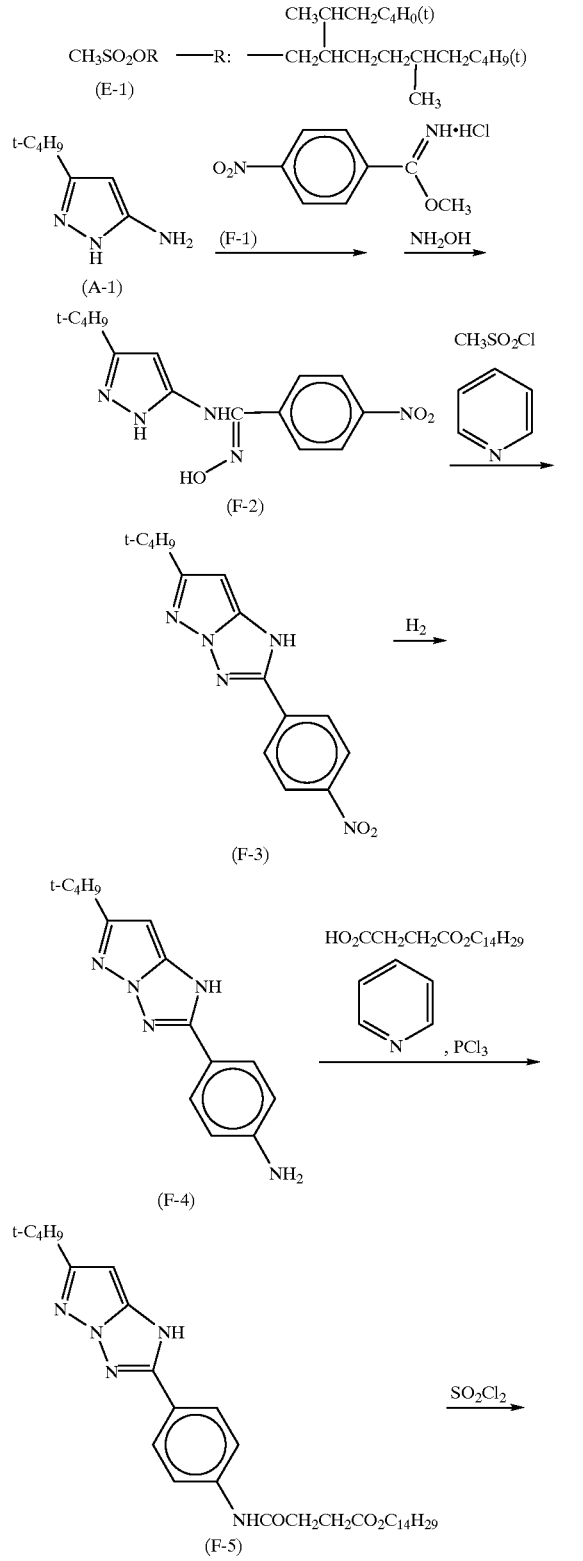
Illustrated compound 1-1
The adding amount of the coupler represented by the general formula (VIII) or (IX) to be used in the present invention to the silver halide color photographic photosensitive material is $3\times10^{-5}$ to $3\times10^{-3}$ mol/m$^2$, preferably $3\times10^{-4}$ to $2\times10^{-3}$ mol/m$^2$, and more preferably $1\times10^{-4}$ to $1.5\times10^{-3}$ mol/m$^2$. If a green-sensitive silver halide emulsion layer is made up of a plurality of layers, the coupler can be used in these plural layers. The same coupler can be used in plural layers, or otherwise a mixture of different couplers can also be used. In addition, depending on the purpose, the coupler can also be used in photosensitive layers other than the green-sensitive silver halide emulsion layer or in non-photosensitive layers.

The 5-amino-1H-pyrazole compound, which is a starting material for the pyrazolotriazole couplers to be used in the fifth and sixth aspects of the present invention, can be synthesized by the methods described in JP-A Nos. 4-66,573 and 4-66,574. The 5-hydradino-1H-pyrazole compound, which is a necessary material for the synthesis of the compound represented by the general formula (IX), can be obtained by a procedure comprising diazotizing the 5-amino-1H-pyrazole compound and reducing the resultant product according to the method described in JP-A No. 4-194,846. The skeleton part of the pyrazolotriazole couplers to be used in the present invention can be synthesized by the methods described in, e.g., U.S. Pat. No. 4,540,654; JP-B Nos. 4-79,350and 4-79,351, JP-A Nos. 3-184,980, 5-186,470 and 6-116,271, U.S. Pat. No. 3,725,067, JP-A Nos. 3-220,191 and 5-204,106.

In conventional photographic color negative films, for the purpose of achieving target graininess, a so-called DIR coupler, which releases a development-inhibiting compound at the time of a coupling reaction with the oxidized form of the developing agent, has been adopted along with the improvement of the silver halide emulsion. The photosensitive material of the present invention makes it possible to achieve an excellent level of graininess even when the DIR coupler is not used. If the DIR coupler is used jointly, the level of the graininess becomes even better.

In the present invention, an organic metal salt can be used as an oxidant together with a photosensitive silver halide. Among these organic metal salts, an organic silver salt is particularly preferable.

Examples of organic compounds, which can be used in the preparation of the above-mentioned organic silver salts, include benzotriazoles, fatty acids and other compounds described in U.S. Pat. No. 4,500,626, columns 52–53. The silver acetylide, which is described in U.S. Pat. No. 4,775,613, is also useful. These silver salts may be used alone or in a combination of two or more of them.

The above-mentioned organic silver salt can be used in an amount in the range of 0.01 to 10 mol, preferably 0.01 to 1 mol, per mol of the photosensitive silver halide. The total coating amount of the photosensitive silver halide and the organic silver salt is in the range of 0.05 to 10 g/m$^2$, preferably 0.1 to 4 g/m$^2$, based on the weight of silver.

The binder for a constituent layer of the photosensitive material is preferably a hydrophilic material, examples of which include those described in the aforesaid Research Disclosure and in JP-A No. 64-13,546,pp. 71–75. More specifically, the binder is preferably a transparent or translucent hydrophilic material, exemplified by a naturally occurring compound, such as a protein including gelatin and a gelatin derivative, and a polysaccharide including a cellulose derivative, starch, gum arabic, dextran and pullulan, and by a synthetic polymer such as polyvinyl alcohol, polyvinyl pyrrolidone and acryl amide polymer. Also usable as the binder is a highly water-absorbent polymer described in U.S. Pat. No. 4,960,681 and JP-A No. 62-245,260, for example, a homopolymer composed of a vinyl monomer having —COOM or —$SO_3$M (M stands for a hydrogen atom or an alkali metal), or a copolymer obtained by a combination of these monomers or by a combination of at least one of these monomers and an other monomer(s) such as sodium methacrylate and ammonium methacrylate (e.g., SUMITAGEL L-5H manufactured by Sumitomo Chemical Co., Ltd.). These binders may be used alone or in a combination of two or more of them. Particularly, a combination of gelatin and any of the above-mentioned non-gelatin binders is preferable. Depending on the purpose, a lime-processed gelatin, acid-processed gelatin and a delimed gelatin, which has undergone a deliming process to decrease the content of calcium, and the like can be used. Alternatively, a combination of these processed gelatin substances may be employed.

In the present invention, the coating amount of the binder is preferably 1 to 20 g/m$^2$, and more preferably 2 to 10 g/m$^2$.

The other couplers, which can be used together with the couplers constituting the present invention, are described below. These couplers may be a 4-equivalent coupler or a 2-equivalent coupler. In these couplers, the nondiffusive group may form a polymeric chain. Details of these couplers are described in, e.g., T. H. James, The Theory of the Photographic Process, 4th edition, pp. 291–334, pp. 354–361, and in JP-A Nos. 58-123,533, 58-149,046, 58-149,047, 59-111,148, 59-124,399, 59-174,835, 59-231,539, 59-231,540, 60-2,950, 60-2,951, 60-14,242, 60-23,474, 60-66,249, 8-110,608, 8-146,552 and 8-146,578.

Further, the following couplers can be used.

Yellow color forming couplers: couplers represented by the formulas (I) and (II) in EP 502,424A; couplers represented by the formulas (1) and (2) in EP 513, 496A; couplers represented by the general formula (I) described in Claim 1 of JP-A No. 5-307,248; couplers represented by the general formula (D) in U.S. Pat. No. 5,066,576, column 1, lines 45 to 55; couplers represented by the general formula (D) in JP-A No. 4-274,425, paragraph 0008; couplers described in EP 498,381A1, Claim 1 on page 40; couplers represented by the formula (Y) in EP 447,969A1, p. 4; and couplers represented by the general formulas (I) to (IV) in U.S. Pat. No. 4,476,219, column 7, lines 36 to 58.

Magenta color forming couplers: couplers described in JP-A Nos. 3-39,737, 6-43,611, 5-204,106 and 4-3,626.

Cyan color forming couplers: couplers described in JP-A Nos. 4-204,843 and 4-43,345 and in Japanese Patent Application No. 4-23,633.

Polymeric couplers: couplers described in JP-A No. 2-44,345.

The couplers described in U.S. Pat. No. 4,366,237, GB 2,125,570, EP 96,570 and DE 3,234,533 are preferable as couplers able to generate dyes and having appropriate diffusive properties.

The photosensitive material in the present invention may contain a functional coupler, for example, a coupler which is designed to compensate for any unnecessary absorption of a developed color dye, such as the yellow colored cyan dye-forming coupler and the yellow colored magenta dye-forming coupler described in EP 456,257A1, the magenta colored cyan dye-forming coupler described in U.S. Pat. No. 4,833,069 and the colorless masking coupler represented by the formula (2) in U.S. Pat. No. 4,837,136 and by the formula (A) in Claim 1 of WO 92/11,575 (compounds shown on pages 36–45 in particular).

In the present invention, it is preferable to use a coupler or other compound which reacts with the oxidized form of a developing agent to release a photographically useful compound.

Examples of the compounds (including couplers), which react with the oxidized form of a developing agent to release photographically useful compound residues, include compounds which release development inhibitors. For instance, compounds represented by the formulas (I) to (IV) described on page 11 in EP 378, 236A1, compounds represented by the formula (I) described on page 7 in EP 436, 938A2, compounds represented by the formula (1) described in JP-A No. 5-307,248, compounds represented by the formulas (I) to (III) described on pages 5 and 6 in EP 440,195A2, compound-ligand releasing compounds represented by the formula (I) described in claim 1 of JP-A No. 6-59,411 and compounds represented by LIG-X described in Claim 1 of U.S. Pat. No. 4,555,478.

In the present invention, the amount of the coupler used is preferably 1/1000 to 1 mol, more preferably 1/500 to 1/5 mol, per mol of silver halide.

The photosensitive material of the present invention should contain a developing agent, the oxidized form of which results from the silver development and is capable of coupling with the aforementioned coupler to form a dye.

Examples of such a combination of a coupler and a developing agent include a combination of a p-phenylene diamine as a developing agent and a phenol or active methylene coupler described in U.S. Pat. No. 3,531,256 and a combination of a p-aminophenol as a developing agent and an active methylene coupler described in U.S. Pat. No. 3,761,270.

Further, the incorporation of a combination of a sulfonamide phenol and a 4-equivalent coupler in a photosensitive material. described in U.S. Pat. No. 4,021,240 and JP-A No. 60-128,438, is preferable, because this combination assures excellent storage stability of an unexposed photosensitive material.

In the present invention, a precursor of a developing agent may be used, examples of which include an indoaniline-based compound described in U.S. Pat. No. 3,342,597, a Schiff base-type compound described in U.S. Pat. No. 3,342,599 and in Research Disclosure Nos. 14,850 and 15,159, an aldol compound described in Research Disclosure No. 13,924, a metal salt complex described in U.S. Pat. No. 3,719,492 and a urethane-based compound described in JP-A No. 53-135,628.

Other combinations, i.e., a combination of a sulfonamide phenol as a developing agent and a coupler as described in Japanese Patent Application No. 7-180,568 and a combination of a hydrazine as a developing agent and a coupler as described in Japanese Patent Application Nos. 7-49,287 and 7-63,572, are also preferable for use in the photosensitive material of the present invention.

In the present invention, it is preferable to use a compound, which is represented by one of the general formulas I, II, III and IV, as a developing agent. Among these compounds, a compound, which is represented by the general formula I or II below, is particularly preferable.

Details of these developing agents are described below.

general formula I

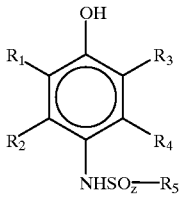

-continued general formula II

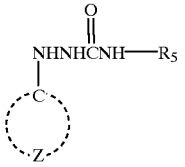

general formula III

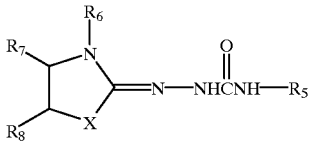

general formula IV

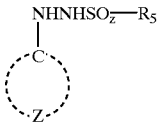

In these general formulas, $R_1$ to $R_4$ are selected from the group consisting of a hydrogen atom, halogen atoms, alkyl groups, aryl groups, alkylcarbonamide groups, arylcarbonamide groups, alkylsulfonamide groups, arylsulfonamide groups, alkoxy groups, aryloxy groups. alkylthio groups, arylthio groups, alkylcarbamoyl groups, arylcarbamoyl groups, carbamoyl groups, alkylsulfamoyl groups, arylsulfamoyl groups, sulfamoyl groups, cyano groups. alkylsulfonyl groups, arylsulfonyl groups, alkoxycarbonyl groups, aryloxycarbonyl groups, alkylcarbonyl groups, arylcarbonyl groups and acyloxy groups. $R_5$ is selected from the group consisting of alkyl groups, aryl groups and heterocyclic groups. Z stands for a group of atoms forming a heterocyclic or aromatic ring and the total of Hammett's constants σ of the substitutents is 1 or greater if Z is a benzene ring. $R_6$ is an alkyl group. X is selected from the group consisting of an oxygen atom, a sulfur atom, a selenium atom and an alkyl- or aryl-substituted tertiary nitrogen atom. $R_7$ and $R_8$ are selected from the group consisting of a hydrogen atom and a substituent. R7 and $R_8$ may join together to form a double bond or a ring. Each of the compounds represented by the general formulas I to IV contains at least one ballast group having 8 or more carbon atoms in order to impart oil solubility to the molecule.

The compounds, which are represented by the general formula I, are generally called sulfonamide phenols and are known compounds in the art. In these compounds for use in the present invention, preferably at least one substituent selected from the substituents $R_1$ to $R_5$ has a ballast group having 8 or more carbon atoms.

In the above-described formula, examples of $R_1$ to $R_4$ are a hydrogen atom, halogen atoms (e.g., chlorine and bromine atoms), alkyl groups (e.g., methyl, ethyl, isopropyl, n-butyl and t-butyl groups), aryl groups (e.g., phenyl, tolyl and xylyl groups), alkylcarbonamide groups (e.g., acetylamino, propionylamino and butyloylamino groups), arylcarbonamide groups (e.g., benzoylamino groups), alkylsulfonamide groups (e.g., methanesulfonylamino and ethanesulfonylamino groups), arylsulfonamide groups (e.g., benzenesulphonylamino and toluenesulfonylamino groups), alkoxy groups (e.g., methoxy, ethoxy and butoxy groups), aryloxy groups (e.g., phenoxy group), alkylthio groups (e.g., methylthio, ethylthio and butylthio groups), arylthio groups (e.g., phenylthio and tolylthio groups), alkylcarbamoly groups (e.g., methylcarbamoyl, dimethylcarbamoyl, ethylcarbamoyl, diethylcarbamoyl, dibutylcarbamoyl, piperidylcarbamoyl and morpholinylcarbamoyl groups), arylcarbamoly groups (e.g., phenylcarbamoyl, methylphenylcarbamoyl, ethylphenylcarbamoyl and benzylphenylcarbamoyl groups), carbamoyls groups, alkylsulfamoyl groups (e.g., methylsulfamoyl, dimethylsulfamoyl, ethylsulfamoyl, diethylsulfamoyl, dibutylsulfamoyl, piperidylsulfamoyl and morpholinylsulfamoyl groups), arylsulfamoyl groups (e.g., phenylsulfamoyl, methylphenylsulfamoyl, ethylphenylsulfamoyl and benzylphenylsulfamoyl groups), sulfamoyl groups, cyano groups, alkylsulfonyl groups (e.g., methanesulfonyl and ethanesulfonyl groups), arylsulfonyl groups (e.g., phenylsulfonyl, 4-chlorophenylsulfonyl and p-toluenesulfonyl groups), alkoxycarbonyl groups (e.g., methoxycarbonyl, ethoxycarbonyl and butoxycarbonyl groups), aryloxycarbonyl groups (e.g., phenoxycarbonyl group), alkylcarbonyl groups (e.g., acetyl, propionyl and butyloyl groups), arylcarbonyl groups (e.g., benzoyl and alkylbenzoyl groups), and acyloxy groups (e.g., acetyloxy, propionyloxy and butyloyloxy groups). Of the groups represented by $R_1$ to $R_4$, $R_2$ and $R_4$, are preferably hydrogen atoms. The total of Hammett's constants σ of $R_1$ to $R_4$ is preferably 0 or greater. $R_5$ is an alkyl group (e.g., methyl, ethyl, butyl, octyl, lauryl, cetyl or stearyl group), an aryl group (e.g., phenyl, tolyl, xylyl, 4-methoxyphenyl, dodecylphenyl, chlorophenyl, trichlorophenyl, nitrochlorophenyl, triisopropylphenyl, 4-dodecyloxyphenyl or 3,5-di-methoxycarbonyl group), or a heterocyclic group (e.g., pyridyl group).

The compounds, which are represented by the general formula II, are generally called carbamoylhydrazines and are known compounds in the art. In these compounds for use in the present invention, $R_5$ or a substituent linked to a ring preferably has a ballast group having 8 or more carbon atoms.

In the formula II, Z stands for a group of atoms forming an aromatic ring. The aromatic group indicated by z should be sufficiently electron-attractive to impart silver development activity to the compound. From this stand point, preferably employed is a nitrogen-containing aromatic ring or an aromatic ring such as a benzene ring bearing an electron-attractive substituent. In this sense, preferred examples of such aromatic rings include a pyridine ring, a pyradine ring, a pyrimidine ring, a quinoline ring and a quinoxaline ring. In the case of a benzene ring, examples of its substituents include alkylsulfonyl groups (e.g., methanesulfonyl and ethanesulfonyl groups), halogen atoms (e.g., chlorine and bromine atoms), alkylcarbamoly groups (e.g., methylcarbamoyl, dimethylcarbamoyl, ethylcarbamoyl, diethylcarbamoyl, dibutylcarbamoyl, piperidylcarbamoyl and morpholinylcarbamoyl groups), arylcarbamoly groups (e.g., phenylcarbamoyl, methylphenylcarbamoyl, ethylphenylcarbamoyl and benzylphenylcarbamoyl groups), carbamoyl groups, alkylsulfamoyl groups (e.g., methylsulfamoyl, dimethylsulfamoyl, ethylsulfamoyl, diethylsulfamoyl, dibutylsulfamoyl, piperidylsulfamoyl and morpholinylsulfamoyl groups), arylsulfamoyl groups (e.g., phenylsulfamoyl, methylphenylsulfamoyl, ethylphenylsulfamoyl and benzylphenylsulfamoyl groups), sulfamoyl groups, cyano groups, alkylsulfonyl groups (e.g., methanesulfonyl and ethanesulfonyl groups), arylsulfonyl groups (e.g., phenylsulfonyl, 4-chlorophenylsulfonyl and p-toluenesulfonyl groups), alkoxycarbonyl groups (e.g., methoxycarbonyl, ethoxycarbonyl and butoxycarbonyl groups), aryloxycarbonyl groups (e.g., a phenoxycarbonyl group), alkylcarbonyl groups (e.g., acetyl, propionyl and butyloyl groups), and arylcarbonyl groups (e.g., benzoyl and alkylbenzoyl groups). The total of Hammett's constants σ of the above-mentioned substituents is preferably 1 or greater.

The compounds represented by the general formula III are generally called carbamoylhydrazines. The compounds represented by the general formula IV are generally called sulfonylhydrazines. Both of these compounds are known in the art. In these compounds used in the present invention, preferably at least one substituent selected from the substituents $R_5$ to $R_8$ has a ballast group having 8 or more carbon atoms.

$R_6$ is an alkyl group (e.g., methyl and ethyl groups). X is selected from the group consisting of an oxygen atom, a sulfur atom, a selenium atom and an alkyl- or aryl-substituted tertiary nitrogen atom. X is preferably an alkyl-substituted tertiary nitrogen atom. $R_7$ and $R_8$ are selected from the group consisting of a hydrogen atom and a substituent (examples of which include the above examples of substitutents on benzene ring for Z). $R_7$ and $R_8$ may join each other to form a double bond or a ring.

Among the compounds represented by the general formulas I to IV, the compounds represented by the general formulas I and II are preferable from the viewpoint of superior storage stability of an unexposed photosensitive material.

In the above compounds, the groups indicated by $R_1$ to $R_8$ may each have a substituent, examples of which include the above examples of substituents on the benzene ring Z.

Concrete examples of the compounds represented by the general formulas I to IV are given below, but the compounds in the present invention are not limited by these examples.

D-1

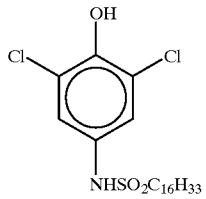

D-2

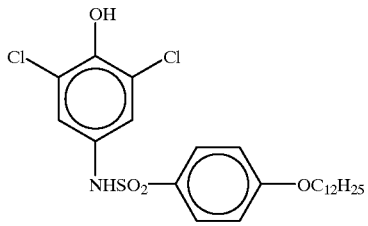

D-3

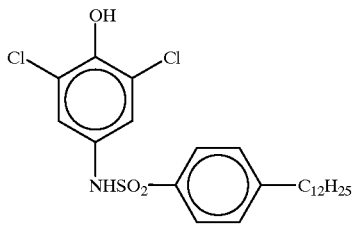

-continued
D-4
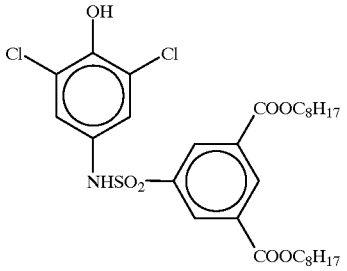
D-5
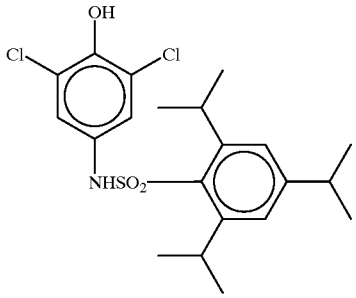
D-6
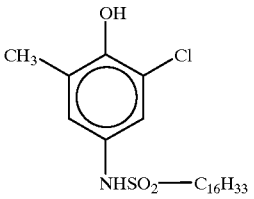
D-7
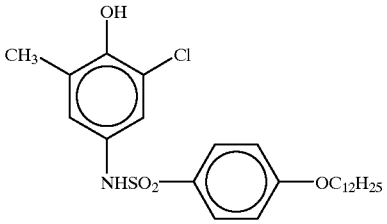
D-8
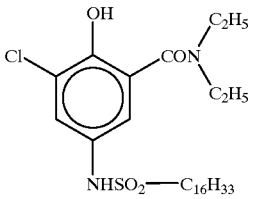
D-9
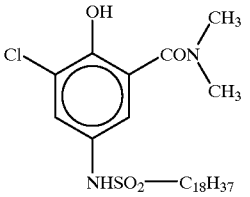
-continued
D-10
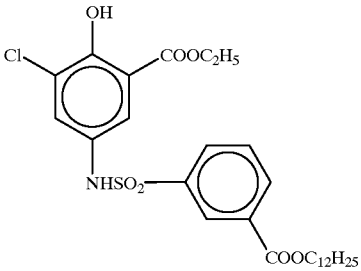
D-11
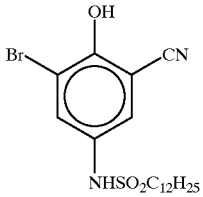
D-12
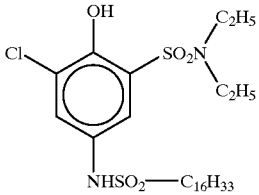
D-13
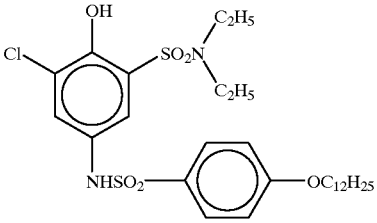
D-14
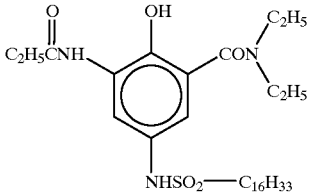
D-15
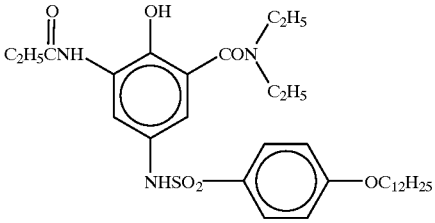

-continued
D-16
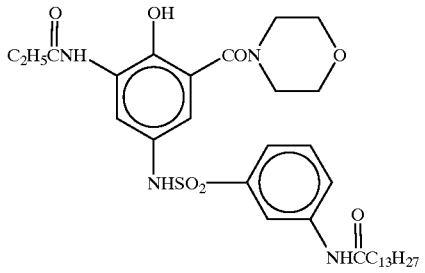
D-17
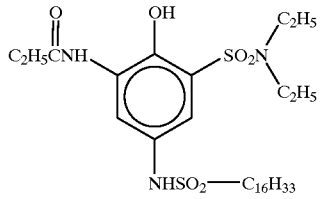
D-18
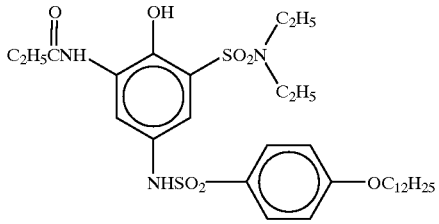
D-19
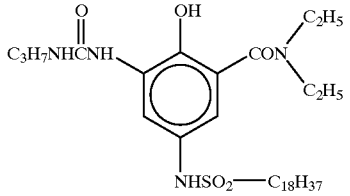
D-20
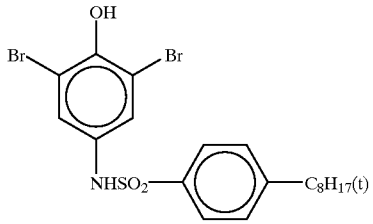
D-21
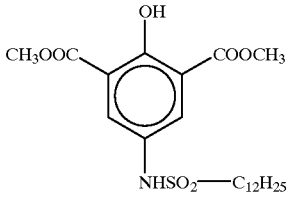
-continued
D-22
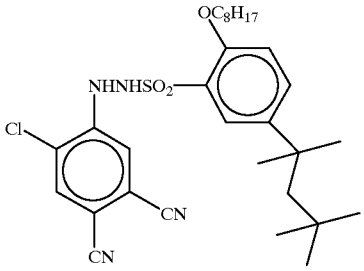
D-23
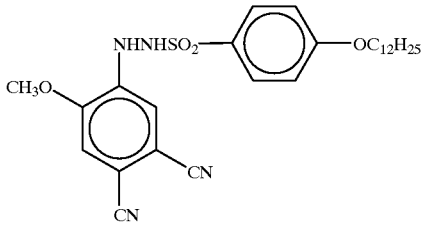
D-24
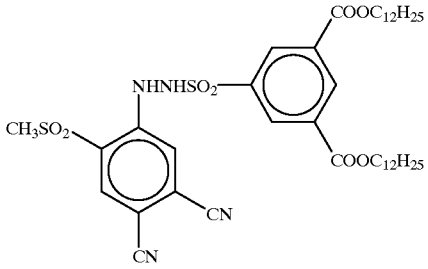
D-25
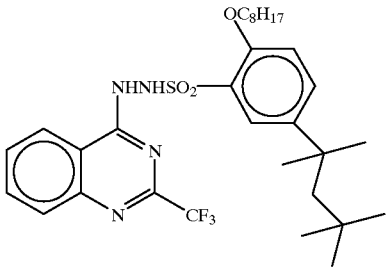
D-26
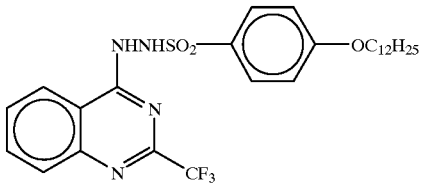
D-27
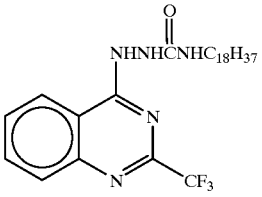

-continued
D-28
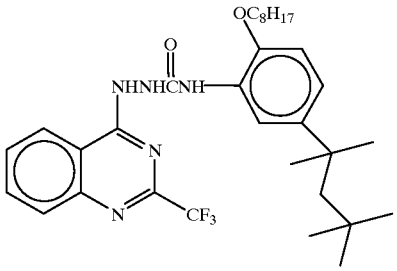
D-29
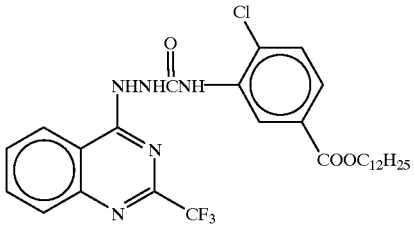
D-30
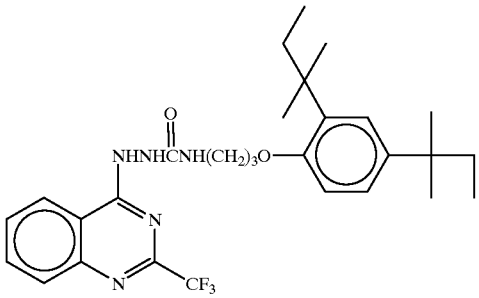
D-31
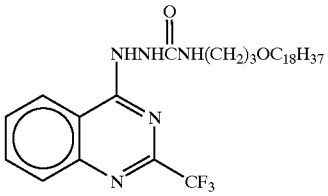
D-32
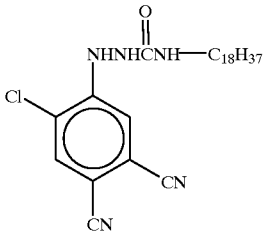
-continued
D-33
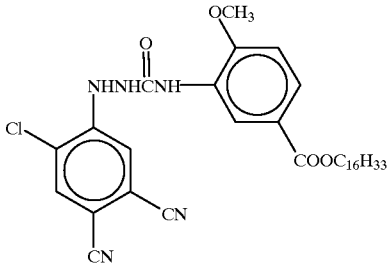
D-34
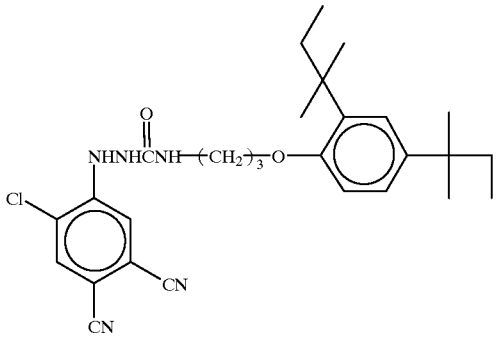
D-35
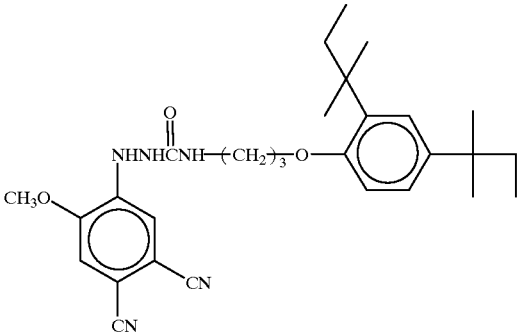
D-36
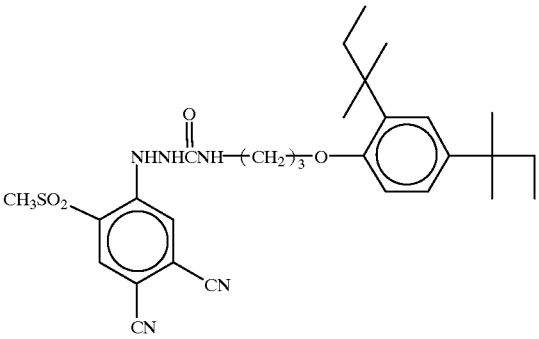

-continued
D-37
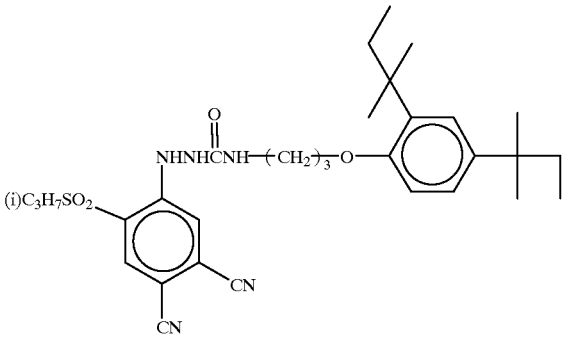
D-38
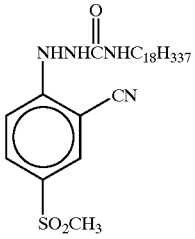
D-39
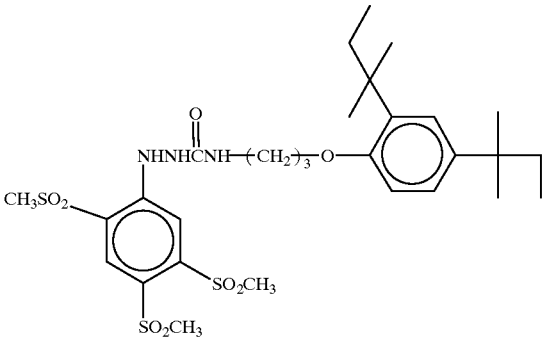
D-40
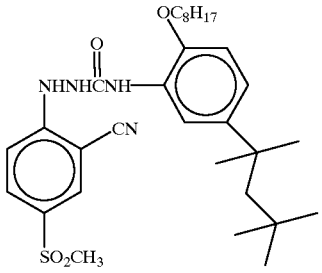
D-41
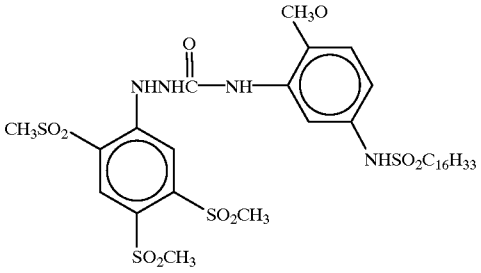
-continued
D-42
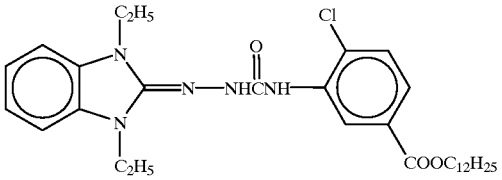
D-43
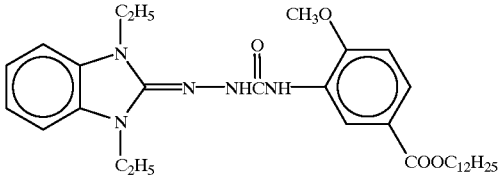
D-44
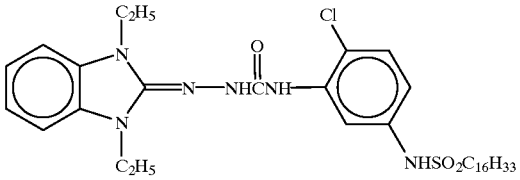
D-45
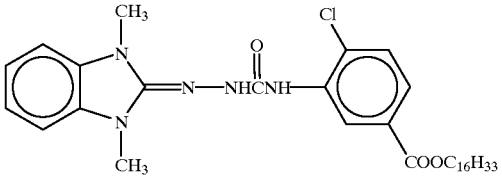
D-46
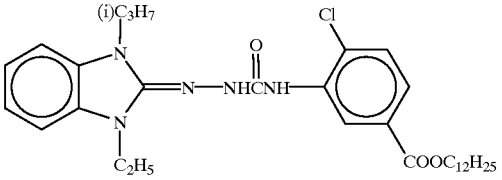
D-47
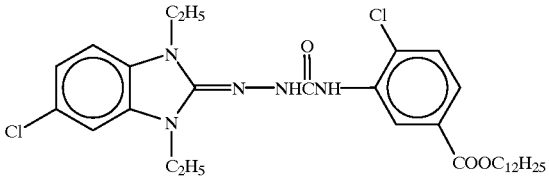
D-48
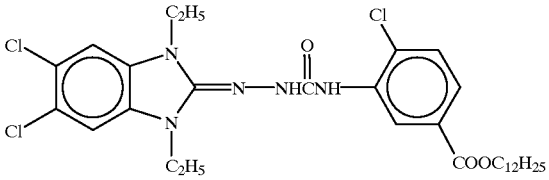

-continued
D-49
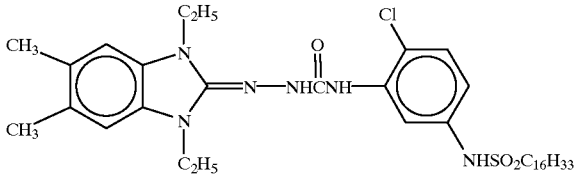
D-50
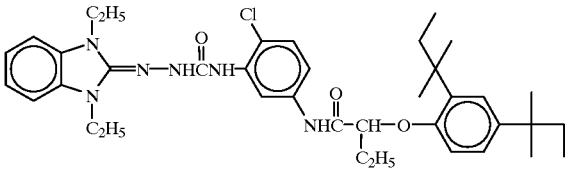
D-51
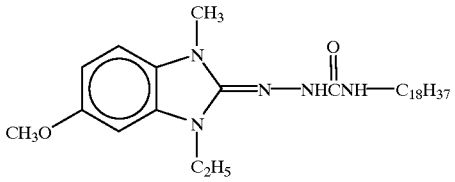
D-52
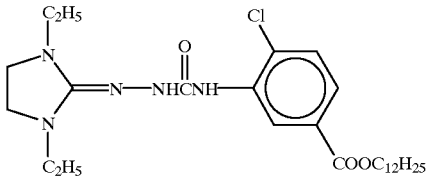
D-53
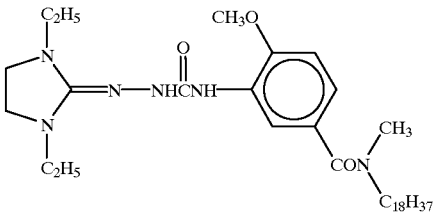
D-54
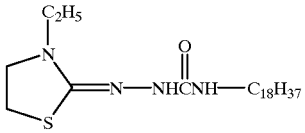
D-55
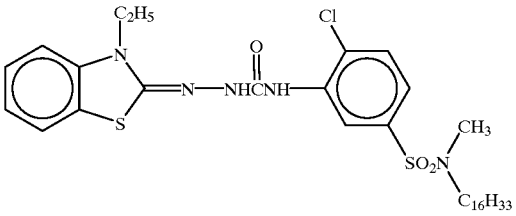
-continued
D-56
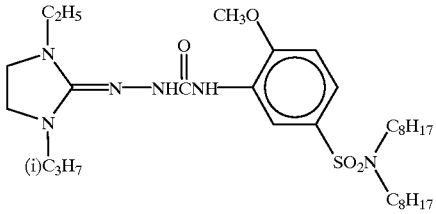
The above compounds can be synthesized by commonly known methods. Synthetic processes of the compounds are briefly described below.
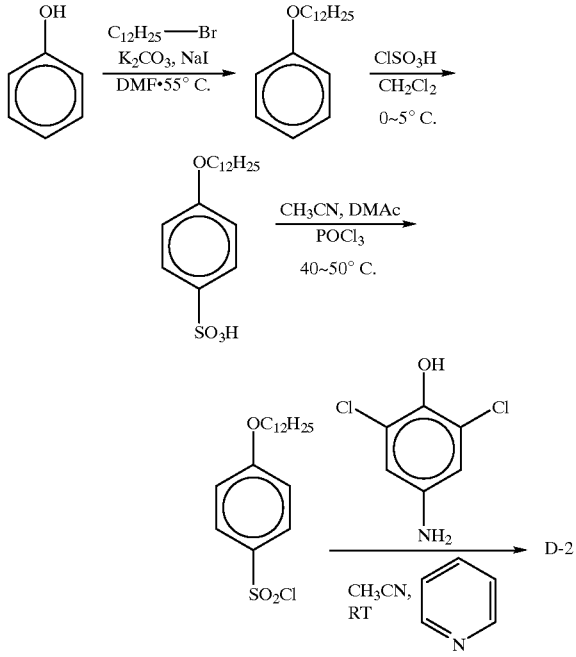
Synthesis of developing agent D-27
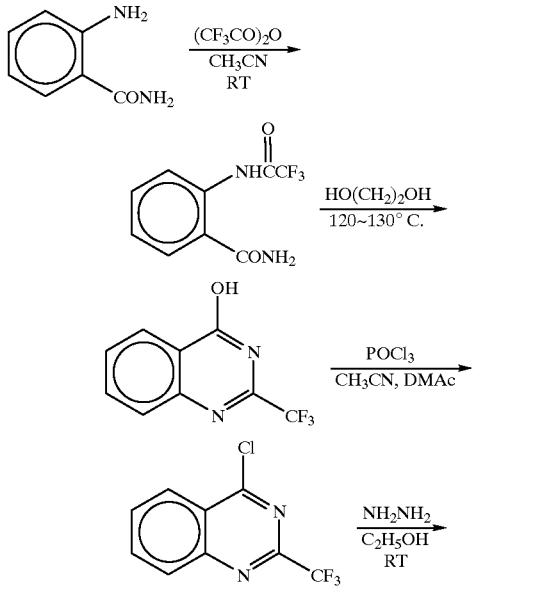

-continued

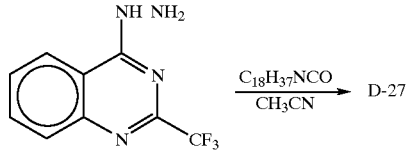

Synthesis of developing agent D-42

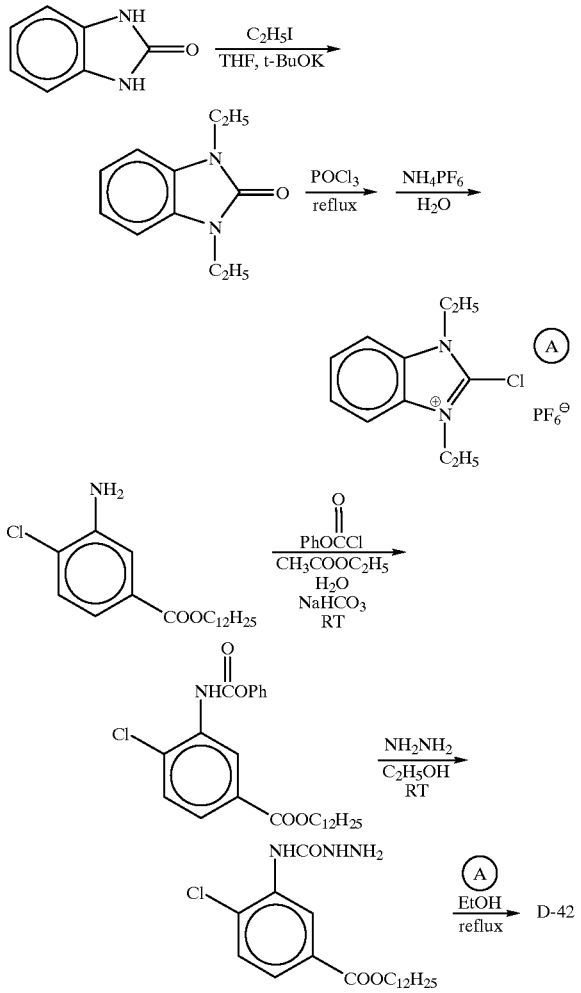

In the case where a nondiffusive developing agent is used, if necessary, an electron transferring agent and/or a precursor thereof can be used in the photosensitive material of the present invention in order to accelerate the transfer of electrons between the nondiffusive developing agent and the silver halide to be developed. Use of electron transferring agents and precursors thereof, which are described in U.S. Pat. No. 5,139,919 and in European Patent Application Laid-Open No. 418,743, are particularly preferred in the present invention. Methods used for introducing the electron transferring agent and/or precursor thereof into layers in a stable manner, which are described in JP-A Nos. 2-230,143 and 2-235,044, are particularly preferred in the present invention.

An electron transferring agent or a precursor thereof can be selected from the aforesaid developing agents or precursors thereof. The mobility of the electron transferring agent or a precursor thereof is preferably greater than that of a nondiffusive developing agent (electron donor). Particularly useful electron transferring agents are 1-phenyl-3-pyrazolidones or aminophenols.

A precursor of an electron donor, which is described in JP-A No. 3-160,443, is also preferable for use in the photosensitive material of the present invention.

For such purposes as prevention of color mixing, improvement in color reproduction and the like, a reducing agent may be used in an intermediate layer or in a protective layer. The reducing agents, which are described in European Patent Application Laid-Open Nos. 524,649 and 357,040 and in JP-A Nos. 4-249,245, 2-46,450 and 63-186,240, are particularly preferable for use in the present invention. Also usable are development inhibitor releasing reducers which are described in JP-B No. 3-63,733, JP-A Nos. 1-150,135; 2-46,450, 2-64,634 and 3-43,735 and European Patent Application Laid-Open No. 451,833.

Further, a precursor of a developing agent, which does not have reducing properties per se but which exhibits reducing properties under the influence of a nucleophilic reagent or heat in the developing process, can be used in the photosensitive material of the present invention.

In addition, the photosensitive material may contain a reducing agent indicated below.

The photosensitive material of the present invention can contain any of the following reducing agents, examples of which are the reducing agents and precursors thereof described in U.S. Pat. No. 4,500,626, columns 49–50, U.S. Pat. No. 4,839,272, 4,330,617, 4,590,152, 5,017,454 and 5,139,919, JP-A Nos. 60-140,335, pp. 17–18, 57-40,245, 56-138,736, 59-178,458, 59-53,831, 59-182,449, 59-182, 450, 60-119,555. 60-128,436, 60-128,439, 60-198,540, 60-181,742, 61-259,253, 62-244,044, 62-131,253, 62-131, 256, 64-13,546, pp. 40–57 and 1-120,553, and EP No. 220,746A2, pp. 78–96.

Further, a combination of reducing agents, which is disclosed in U.S. Pat. No. 3,039,869, can also be used in the present invention.

The developing agents or the reducing agents may be incorporated in a processing sheet which is described later, although they may be incorporated in the photosensitive material.

The total amount of the developing agent and the reducing agent to be employed in the present invention is in the range of 0.01 to 20 mol, preferably 0.01 to 10 mol, per mol of silver.

In the present invention, either a 4-equivalent coupler or a 2-equivalent coupler can be selected for use depending on the kind of the developing agent. A 4-equivalent coupler is used for the developing agent represented by the general formula (I). Since the coupling site of the developing agent represented by the general formula (I) is substituted with a sulfonyl group so that the sulfonyl group is released as a sulfinic acid at the time of the coupling reaction, the releasing group which is released from the coupler used together with the developing agent represented by the general formula (I) at the time of the coupling reaction should be cationic. Accordingly, although the developing agent represented by the general formula (I) reacts with a 4-equivalent coupler which is capable of releasing a proton as a releasing group at the time of the coupling reaction, it does not react with a 2-equivalent coupler whose releasing group is anionic. Conversely, a 2-equivalent coupler is used together with the developing agents represented by the general formulas (II) or (III). Since the coupling site of the developing agent represented by the general formula (II) or (III) is substituted with a carbamoyl group so that the hydrogen atom linked to the nitrogen atom is released as a proton, the releasing group which is released from the coupler used together with the developing agent represented by the general formula (II) or (III) at the time of the coupling reaction should be anionic. Accordingly, although the developing agent represented by the general formula (II) or (III) reacts with a 2-equivalent coupler which is capable of releasing an anion as a releasing group at the time of the coupling reaction, it does not react with a 4-equivalent coupler whose releasing group is a proton. Use of such a combination can color muddiness caused by movement of the oxidized form of a developing agent between adjacent layers. Examples of the 4-equivalent couplers and 2-equivalent couplers are described in detail in "Theory of the Photographic Process" (4th Ed. by T. H. James, Macmillan, 1977), pp. 291–334, pp. 345–361, and in JP-A Nos. 58-12,353, 58-149,046, 58-149,047, 59-11,114, 59-124,399, 59-174,835, 59-231,539, 59-231,540, 60-2,951, 60-14,242, 60-23,474 and 60-66,249 in addition to the aforementioned literature and patents.

Hydrophobic additives, such as a coupler, a developing agent and a nondiffusive reducing agent, can be introduced into a layer of a photosensitive material according to a known method such as the method described in, e.g., U.S. Pat. No. 2,322,027.

In this case, an organic solvent having a high boiling point, which is described in U.S. Pat. Nos. 4,555,470, 4,536,466, 4,536,467, 4,587,206, 4,555,476 and 4,599,296 and in JP-B No. 3-62,256, can be used, if necessary, together with an organic solvent having a lower boiling point in the range of 50 to 160° C. These color forming compounds, nondiffusive reducing agents and organic solvents having a high boiling point and the like may be used in a combination of two or more of them, respectively.

The amount of the organic solvent having a high boiling point is 10 g or less, preferably 5 g or less, more preferably in the range of 0.1 to 1 g, per gram of the hydrophobic additives to be used. The amount of the organic solvent having a high boiling point is 1 cc or less, preferably 0.5 cc or less, more preferably 0.3 cc or less, per gram of the binder.

Examples of useful methods for introducing a hydrophobic additive into the layer of a photosensitive material include a dispersion method utilizing a polymer as described in JP-B No. 51-39,853 and JP-A No. 51-59,943 and a method wherein a hydrophobic additive, which has been dispersed to fine particles, is added to the layer as described in JP-A No. 62-30,242.

In addition to the above methods, in the case where the hydrophobic additive is a compound substantially insoluble in water, the hydrophobic compound may be dispersed as fine particles in a binder.

When dispersing a hydrophobic compound to form a hydrophilic colloidal dispersion, a variety of surfactants can be used. For example, surfactants, which are described in JP-A No. 59-157,636, pp. 37–38, and in the Research Disclosure above, can be used. In addition, a phosphoric ester-type surfactant, which is described in JP-A Nos. 7-56,267 and 7-228,589 and in German Patent Application Laid-Open No. 1,932,299A, can also be used in the photosensitive material of the present invention.

The photosensitive material of the present invention may contain a compound which activates the development and stabilizes the image. Preferred examples of these compounds are described in U.S. Pat. No. 4,500,626, columns 51–52.

A non-photosensitive layer, such as a protective layer, an undercoat layer, an intermediate layer, a yellow filter layer or an antihalation layer, may be formed between the photographic photosensitive layers containing the silver halide emulsion of the photosensitive material and/or as a top layer and/or a bottom layer thereof. Further, a supplementary layer, such as a back layer, may be formed on the reverse side of the support opposite to the side on which the photographic photosensitive layer is formed. More specifically, it is possible to form, on the support, various layers including the above-mentioned construction, an undercoat layer described in U.S. Pat. No. 5,051,335, an intermediate layer containing a solid pigment described in JP-A Nos. 1-167,838 and 61-20,943, an intermediate layer containing a reducing agent or a DIR compound described in JP-A Nos. 1-120,553, 5-34,884 and 2-64,634, an intermediate layer containing an electron transferring agent described in U.S. Pat. Nos. 5,017,454 and 5,139,919 and in JP-A No. 2-235,044 and a protective layer containing a reducing agent described in JP-A No. 4-249,245 as well as a combination of two or more of these layers.

A dye, which can be used in a yellow filter layer or in an antihalation layer, is preferably a dye which loses its color or is leach out of these layers at the time of development so that it exerts no influence on the density of image after the developing process of the photosensitive material.

That the dye which is present in a yellow filter layer or in the antihalation layer loses its color or is eliminated at the time of development means that the amount of the dye remaining after the developing process is less than one third, preferably less than one tenth, of the amount of the dye present immediately before the process. This may be attained by a phenomenon wherein the component of the dye is leached out of the photosensitive material or is transferred into the processing material at the time of development, or by a phenomenon wherein the component of the dye undergoes a reaction and becomes a colorless compound at the time of development.

A known dye can be used in the photosensitive material of the present invention besides the foregoing dyes. For example, employable dyes include a dye, which is soluble in an alkaline solution of a developer, and a dye which becomes colorless as a result of the reaction with an ingredient of the developing solution, sulfite ion, a developing agent or an alkali. Concrete examples of the dyes include the dye described in European Patent Laid-Open Application EP 549,489A and the dye described in JP-A No. 7-152,129, ExF 2–6. A dye which is solid-dispersed and is described in JP-A No. 8-101,487 can also be used. Although this dye can also be used in the case where the photosensitive material is developed with a processing solution, this dye is particularly suitable to the case where the photosensitive material is subjected to heat development utilizing a processing sheet which is described later.

Further, it is also possible to mordant a dye to a mordant and a binder. In this case, the mordant and the dye may be those well known in the field of photography. Examples of the mordants include those described in U.S. Pat. No. 4,500,626, columns 58–59 and in JP-A Nos. 61-88,256, pp. 32–41, 62-244,043 and 62-244,036.

Furthermore, it is also possible to use a reducing agent and a compound which reacts with the reducing agent to release a diffusive dye so that the alkali at the time of development causes the reaction to release a mobile dye, which will be eliminated either by being dissolved in the processing solution or by being transferred to the processing sheet. Examples of these compounds and reducing agents are described in U.S. Pat. Nos. 4,559,290 and 4,793,369, European Patent No. 220,746A2, Journal of Technical Disclosure No. 87-6,119 and JP-A No. 8-101,487, paragraph 0080–0081.

A leuco dye, which becomes colorless, can also be used in the photosensitive material of the present invention. For example, JP-A No.1-150,132 discloses a silver halide photosensitive material containing a leuco dye which is given a color in advance by means of a metal salt of an organic acid as a color developer. Since a complex of a leuco dye and a developer undergoes a reaction by heat or reacts with an alkali to become colorless, the use of the combination of a leuco dye and a color developer in the photosensitive material of the present invention is desirable if the photosensitive material of the present invention is to be subjected to heat development.

In the present invention, a known leuco dye can be used, examples of which are described in Moriga and Yoshida, "Dyes and Chemicals", Vol.9, p.84, Association of Chemical Products, "New Handbook of Dyes", p.242, Maruzen Co., Ltd. (1970), R. Garner, "Reports on the Progress of Applied Chemistry", Vol.56, p.199 (1971), "Dyes and Chemicals", Vol.19, p.230, Association of Chemical Products (1974), "Color Materials", Vol.62, p.288 (1989) and "Dye Industry", Vol.32, p.208.

Preferred color developers are a metal salt of an organic acid in addition to acid clay and a phenol/formaldehyde resin. Among metal salts of organic acids are metal salts of salicylic acid, metal salts of a phenol/salicylic acid/formaldehyde resin, rhodanates and metal salts of xanthogenic acid are preferable. Zinc is particularly preferable among the metals. An oil-soluble zinc salicylate described in U.S. Pat. Nos. 3,864,146 and 4,046,941 and in JP-B No. 52-1,327 can also be used as the color developers.

The photosensitive material of the present invention is preferably hardened by means of a hardener.

Examples of the hardener include those described in U.S. Pat. Nos. 4,678,739, column 41 and 4,791,042, and in JP-A Nos. 59-116,655, 62-245,261, 61-18,942 and 4-218,044. More specifically, examples of these hardeners include an aldehyde (e.g., formaldehyde), an aziridine, an epoxy, a vinylsulfone (e.g.,N,N'-ethylene-bis (vinylsulfonylacetamide)ethane), an N-methylol compound (e.g., dimethylolurea), boric acid, metaboric acid and a polymeric compound (e.g., a compound described in, e.g., JP-A No.62-234,157). The amount of the hardener added is in the range of 0.001 to 1 g, preferably 0.005 to 0.5 g, per gram of the hydrophilic binder.

The photosensitive material of the present invention may contain an anti-fogging agent or a photographic stabilizer as well as a precursor thereof, examples of which include the compounds described in the aforesaid Research Disclosure, U.S. Pat. Nos. 5,089,378, 4,500,627 and 4,614,702, JP-A No. 64-13,564, pp.7–9, pp.57–71 and pp.81–97; U.S. Pat. Nos. 4,775,610, 4,626,500 and 4,983,494, JP-A Nos. 62-174,747, 62-239,148, 1-150,135, 2-110,557, 2-178,650 and RD 17,643 (1978) pp.24–25.

The amount of these compounds added is preferably in the range of $5\times10^{-6}$ to $1\times10^{-1}$ mol, more preferably $1\times10^{-5}$ to $1\times10^{-2}$ mol, per mol of silver.

The photosensitive material of the present invention is imagewisely exposed to light and thereafter heat-developed to form an image by placing the photosensitive material and a processing material comprising a support and a constituent layer thereon containing a base and/or a base precursor in such a manner that the photosensitive layer of the photosensitive material and the processing layer of the processing material face each other. A preferred method for the color development in the present invention comprises supplying water to the photosensitive material or the processing material in an amount ranging from 1/10 to the equivalent of an amount which is required for the maximum swelling of the total layers of these materials, putting together the photosensitive material and the processing material and heating the materials so that a color image is formed in the photosensitive material. However, the present invention is not limited by this method. Further, according to a preferred method of the present invention, if necessary, the photosensitive material or the processing material may contain a developing agent, but the present invention is not limited by this method.

The photosensitive material of the present invention can be used without the fixation of the unreacted silver halide when the photosensitive material is processed. In this case, a color image is formed in the photosensitive material, but silver halide remains. In the case where a photosensitive material bearing an image is used with the silver halide still remaining, the photosensitive material of the present invention provides an image superior in sharpness owing to the emulsion comprising tabular silver chloride rich grains having faces made up of a (100) or (111) plane, in comparison with a photosensitive material containing some other silver halide. Even better image sharpness can be obtained if the photosensitive material comprising the above-described emulsion of the present invention further contains a coloring dye having the structure specified by the present invention.

The present invention has been made in order to realize a better level of graininess, exposure latitude and sharpness in the above-described heat development, and in order to lessen the adverse environmental influences that accompany the development using a developing solution. The photosensitive material of the present invention, however, may be developed by means of an activator process utilizing an alkaline processing solution or by means of a developing method utilizing a processing solution containing a developing agent and a base.

The thermal processing of the photosensitive material of the present invention is well known in the art. For example, a photosensitive material for heat development and the processing thereof are described in "Fundamentals of Photographic Engineering", pp.553–555, Corona Co., Ltd. (1970), "Image Information" (April 1978). p.40, "Nablett's Handbook of Photography and Reprography", 7th Ed. (Vna Nostrand and Reinhold Company), pp.32–pp.33, U.S. Pat. Nos. 3,152,904, 3,301,678, 3,392,020 and 3,457,075, British Patent Nos.1,131,108 and 1,167,777 and Research Disclosure (June, 1978), pp.9–15 (RD-17,029).

The activator process is a developing process in which a photosensitive material containing a color developing agent is processed with a processing solution containing no color developing agent. A feature of the activator process is that the processing solution does not contain a color developing agent which is contained in an ordinary processing solution. The processing solution may contain components, such as an alkali and an auxiliary developing agent. Examples of the activator process are described in publicized literature such as European Patent Nos. 545,491A1 and 565,165A1.

Methods for processing a photosensitive material by means of a processing solution containing a developing agent and a base are described in RD Nos. 17,643, pp.28–29, 18,716, p.651, left column to right column, and 307,105, pp.880–881.

Details of the treating material and treating method to be employed in the heat developing process of the present invention are given below.

The photosensitive material of the present invention preferably contains a base or a base precursor in order to accelerate the development of silver and the dye forming reaction. Examples of the base precursor include a salt of an organic acid and a base capable of decarboxylation through heat and a compound capable of releasing an amine by means of an intramolecular neucleophilic substitution reaction, a Lossen rearrangement or a Beckmann rearrangement. Examples of these compounds are described in U.S. Pat. Nos. 4,514,493 and 4,657,848 as well as in "Known Technologies" No. 5 (issued on Mar. 22, 1991, ASTECH Inc.), pp.55–86. In addition, also usable in the present invention is a base generating method in which a combination of a slightly water-soluble basic metal compound and a compound capable of reacting with the metal contained in the foregoing basic metal compound by use of water as a medium to form a complex compound (hereinafter referred to as a complex forming compound) as described in European Patent Application Laid-Open No. 210,660 and in U.S. Pat. No. 4,740,445.

The amount of the base or the base precursor to be used in the present invention is in the range of 0.1 to 20 g/m$^2$, preferably 1 to 10 g/m$^2$.

The photosensitive material of the present invention may contain a thermal solvent, examples of which include polar organic compounds described in U.S. Pat. Nos. 3,347,675 and 3,667,959. Concrete examples of such compounds include amide derivatives (e.g., benzamide), urea derivatives (e.g., methylurea and ethyleneurea), sulfonamide derivatives (e.g., compounds described in JP-B Nos. 1-40, 974 and 4-13,701), polyol compounds (e.g., sorbitol and a polyethylene glycol).

Where the thermal solvent is insoluble in water, preferably the thermal solvent is used as a solid dispersion. Depending on the purposes, the thermal solvent may be contained in either a photosensitive layer or a non-photosensitive layer.

The amount of the thermal solvent added is in the range of 10 to 500% by weight, preferably 20 to 300% by weight, based on the weight of the binder present in the layer to which the thermal solvent is to be added. The use of the thermal solvent is preferable at the time when heat development is performed without the use of water.

Although the heating temperature of the heat development process is in the range of about 50 to 250° C., a temperature in the range of 60 to 150° C. is particularly preferable.

In order to supply a base, which is needed for the heat development process, to the photosensitive material of the present invention, a processing material is used which has a processing layer containing a base or a base precursor. The processing material may have other functions, for example, a function to shut out the air at the time of heat development, a function to prevent the vaporization of the components of the photosensitive material, a function to supply a material other than the base to the photosensitive material and a function to remove a component of the photosensitive material which becomes unnecessary after the developing process (e.g., a yellow filter dye and an antihalation dye) or an unnecessary component which is formed during the developing process. The support and binder for the treating material can be the same as those for the photosensitive material.

The processing material may contain a mordant for the removal of the dye as stated above or for other purpose. The mordant can be any of those known in the field of photography, examples of which include the mordants described in U.S. Pat. Nos. 4,500,626, columns 58–59, and in JP-A No. 61-88,256, pp.32–41, 62,244,043 and 62-244,036. Further, the processing material can contain a dye receiving polymeric compound described in U.S. Pat. No. 4,463,079, or the above-mentioned thermal solvent.

The processing layer of the processing material contains a base or a base precursor. The base may be either an organic base or an inorganic base. The base precursor may be any of those described hereinabove. The amount of the base or the base precursor to be used in the present invention is in the range of 0.1 to 20 g/m$^2$, preferably 1 to 10 g/m$^2$.

When the photosensitive material of the present invention undergoes the heat developing process utilizing the processing material, a small amount of water is used for such purposes as acceleration of development, acceleration of the transfer of processing components, or acceleration of the diffusion of unnecessary substances as described in U.S. Pat. Nos. 4,704,245 and 4,470,445 and in JP-A No. 61-238,056. Such compounds as an inorganic salt of an alkali metal, an organic base, a solvent having a low boiling point, a surfactant, an anti-fogging agent, a compound forming a complex with a slightly water-soluble metal salt, an anti-mold agent and an antibacterial agent may be added to the water.

The water is not particularly specified, and examples of the water include distilled water, tap water, well water and mineral water. In the heat developing apparatus utilizing the photosensitive material of the present invention and the processing material, the waste water may be discarded without being reused or may be recycled for repeated use. When using recycled water, the water used accumulates the components leached out of the materials over the repeated use. Further, the apparatus and water described in JP-A Nos. 63-144,354, 63-144,355, 62-38,460 and 3-210,555 may be used in the present invention.

Water can be supplied to the photosensitive material or to the processing material or to both of them. The amount of water to be used ranges from 1/10 to the equivalent of an amount which is required for the maximum swelling of the entire coating layers (not including the back layer) of the photosensitive material and the processing material.

Preferred examples of methods for supplying water to these materials include the methods described in JP-A Nos. 62-253,159, p.5, and 63-85,544. Further, water in the form of microcapsules or hydrates may be incorporated in advance into the photosensitive material or the processing material or into both of them.

The temperature of the water to be supplied may be in the range of 30 to 60° C. as described, for example, in JP-A No. 63-85,544.

When conducting heat development of the photosensitive material in the presence of a small amount of water, it is effective to adopt a method in which a base is generated by a combination of a slightly water-soluble basic metal compound and a compound capable of reacting with the metal contained in the foregoing basic metal compound by use of water as a medium to form a complex compound (herein referred to as a complex forming compound), as described in European Patent Application Laid-Open No. 210,660 and in U.S. Pat. No. 4,740,445. In this case, it is desirable to incorporate the slightly water-soluble basic metal compound in the photosensitive material and to incorporate the complex forming compound in the treating material, from the viewpoint of the storability of unexposed materials.

Examples of the heating method in the developing process include a method in which the photosensitive material is brought into contact with a heated block or plate, a method in which the photosensitive material is brought into contact with such an object as a hot plate, a hot presser, a heated roller, a heated drum, a halogen lamp heater and an infrared or a far infrared lamp heater, and a method in which the photosensitive material is passed through a heated atmosphere.

As for the method for placing the photosensitive material and the processing material face to face so that the photosensitive layer and the processing layer face each other, the methods, which are described in JP-A Nos. 62-253,159 and 61-147,244, p.27, can be employed. The heating temperature is preferably in the range of 70 to 100° C.

For the purpose of processing the photographic elements composed of the photosensitive material of the present invention, any known apparatus for heat development can be used. Preferred examples of the apparatus include the apparatus described in JP-A Nos. 59-75,247, 59-177,547, 59-181,353 and 60-18,951, Japanese Utility Model Application Laid-Open (JP-U) No. 62-25,944 and Japanese Patent Application Nos. 4-277,517, 4-243,072, 4-244,693, 6-164,421, and 6-164,422.

In addition, commercially available apparatus such as "Pictrostat" 100, 200, 300, 330 and 50 and "Pictrography" 3000 and 2000, manufactured by Fuji Photo Film Co., Ltd. can be used in the present invention.

The photosensitive material and/or the processing material of the present invention may have an electroconductive heat generating layer as a heating means for the heat development. For example, a heat generating element described in JP-A No. 61-145,544 can be used.

In the present invention, although the readout of the image information is possible without removing the silver produced by development and the undeveloped silver halide from the photosensitive material, the readout of the image information is also possible after removing the silver or silver halide. In the latter case, the silver or silver halide can be removed concurrently with or after the development.

The developed silver can be removed from the photosensitive material concurrently with the development, or the processing material may contain a silver oxidizing agent which serves as a bleaching agent and is allowed to react with the silver when the heat development is performed.

Further, after the developing process, a second processing material containing a silver oxidizing agent and the photosensitive material may be placed face to face to remove the developed silver.

In order to remove the developed silver from the photosensitive material concurrently with the development, or in order to complex or solubilize the silver halide, the processing material may contain a silver oxidizing agent or re-halogenating agent which serves as a bleaching agent or a solvent for the silver halide and which serves as a fixing agent so that these reactions occur when the heat development is performed.

Further, after the developing process, a second processing material which contains a silver oxidizing agent, a silver re-halogenating agent or a solvent for silver halide, and the photosensitive material may be placed face to face to remove the developed silver, or the complexing or solubilizing of the photosensitive silver halide be carried out.

In the present invention, the above-mentioned processings may be performed in so far as these processings do not provide adverse effects on the reading out of image information after the developing process.

However, from the standpoint of processing simplicity, it is preferable not to bleach the developed silver when the photosensitive material is processed.

In the present invention, a processing material can contain a commonly used silver bleaching agent. Examples of the silver bleaching agent are described in U.S. Pat. Nos. 1,315,464 and 1,946,640 and in "Photographic Chemistry". Vol.2, chapter 30, Foundation Press, London, England. These bleaching agents effectively oxidize a silver image to make it soluble. Examples of useful silver bleaching agents include an alkali metal salt of dichromic acid and an alkali metal ferricyanide.

Preferred bleaching agents are a water-soluble compound, examples of which include ninhydrin, indandione, hexaketocyclohexane, 2,4-dinitrobenzoic acid, benzoquinone, benzenesulfonic acid and 2,5-dinitrobenzoic acid. The bleaching agents also include an organic complex of a metal, such as an iron (III) salt of cyclohexyldialkylaminetetraacetic acid, an iron (III) salt of ethylenediaminetetraacetic acid and an iron (III) salt of citric acid.

The fixing agent can be a solvent for silver halide (i.e., a solvent capable of dissolving silver halide) which can be used in the processing material for developing the silver halide color photographic photosensitive material (the first processing material). The binder, support and other additives usable in the second processing material can also be the same substances as those usable in the first processing material.

The amount of bleaching agent to be added should be determined depending on the amount of silver contained in the photosensitive material, and is in the range of 0.01 to 10 mol, preferably 0.1 to 3 mol, and more preferably 0.1 to 2 mol, per mol of silver present in the photosensitive material per unit area.

The solvent for silver halide may be a known compound, examples of which include thiosulfates, such as sodium thiosulfate and ammonium thiosulfate, sulfites, such as sodium sulfite and sodiumhydrogensulfite, thiocyanates, such as potassium thiocyanate and ammonium thiocyanate, thioethers, such as 1,8-di-3,6-dithiaoctane, 2,2'-thiodiethanol and 6,9-dioxa-3,12-dithiatetradecane-1,14-diol as described JP-B No. 47-11,386, a compound having a 5- or 6-membered imido ring, such as urasil and hydantoin as described in Japanese Patent Application No. 6-325,350, and a compound represented by the following general formula (A) as described in JP-A No. 53-144,319. A mesoion thiolate compound of trimethyltriazolium thiolate described in "Analytica Chemica Acta", Vol. 248, pp.604 to 614 (1991). is also a preferred compound. A compound which is described in Japanese Patent Application No. 6-206,331 and which is capable of fixing a silver halide to stabilize it can also be used as a solvent for the silver halide.

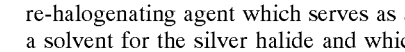

$$N(R^1)(R^2)—C(=S)—X—R^3 \qquad \text{General formula (A)}$$

where X stands for a sulfur atom or an oxygen atom. $R^1$ and $R^2$ may be the same or different and are each a group selected from the group consisting of an aliphatic group, an aryl group, a heterocyclic group and an amino group. $R^3$ is an aliphatic group or an aryl group. $R^1$ and $R^2$ or $R^2$ and $R^3$ may join together to form a 5-membered or a 6-membered heterocyclic ring. The above-described solvents for the silver halide may be used alone or in a combination of two or more of them.

Among the above-described compounds, a sulfite or a compound having a 5-membered or 6-membered imido ring, such as urasil or hydantoin, is particularly preferable. The addition of urasil or hydantoin in the form of a potassium salt thereof is preferable, because the salt inhibits gloss reduction of the processing material during storage.

The content of the total amount of the solvent for silver halide in the processing layer is in the range of 0.01 to 100 mmol/m$^2$, preferably 0.1 to 50 mmol/m$^2$, and more preferably 10 to 50 mmol/m$^2$. The total amount of the solvent for the silver halide in the photosensitive material is in the range of 1/20 to 10 times, preferably 1/10 to 10 times, and more preferably ⅓ to 3 times the amount (mol) of silver present in the photographic silver halide photosensitive material.

When using the solvent for silver halide, it may be added to a solvent, such as water, methanol, ethanol, acetone, dimethylformamide or methylpropyl glycol, or to an alkaline or acidic aqueous solution, or otherwise a dispersion comprising fine solid particle of the solvent for the silver halide may be added to a coating solution.

Alternatively, the processing material may contain a physical development nuclei and the solvent for silver halide so that the photosensitive silver halide emulsion contained in the photographic silver halide photosensitive material is solubilized by the solvent for silver halide or fixed to the processing layer concurrently with the development.

The physical development nuclei reduce the soluble silver salt diffused from the photographic silver halide photosensitive material to convert the salt into physical development silver which will be fixed to the processing layer. Any physical development nuclei known as such can be used in the present invention. Examples of the physical development nuclei include colloidal grains of heavy metals, such as zinc, mercury, lead, cadmium, iron, chromium, nickel, tin, cobalt, copper and ruthenium, noble metals, such as palladium, platinum, silver and gold, chalcogen compounds composed of the foregoing and a substance such as sulfuric acid, selenium or tellurium.

These physical development nucleus substances are obtained by reducing a corresponding metal ion utilizing such a reducing agent as ascorbic acid, sodium boron hydride or hydroquinone to produce a colloidal dispersion of metal or by mixing a metal ion with a solution comprising a water-soluble sulfide, selenide or telluride to produce a colloidal dispersion of insoluble metal sulfide, metal selenide or metal telluride, respectively. These colloidal grains are formed preferably in a hydrophilic binder such as gelatin. The method for preparing colloidal silver grains is described, for example, in U.S. Pat. No. 2,688,601. If necessary, a salt removing processing may be conducted in the preparation of the colloidal silver, as is known in a method for preparing silver halide emulsion wherein excessive salt is removed.

The grain diameters of these physical development nuclei are preferably in the range of 2 to 200 nm.

The physical development nuclei are present in an amount ranging normally from $10^{-3}$ to 100 mg/m$^2$, preferably from $10^{-2}$ to 10 mg/m$^2$, in the treating layer.

Although the physical development nuclei may be prepared separately from a coating solution and thereafter the physical development nuclei may be added to the coating solution, the physical development nuclei may be prepared, for example, by the reaction between silver nitrate and sodium sulfide or between chloroauric acid and a reducing agent in a coating solution containing a hydrophilic binder.

Silver, silver sulfide, palladium sulfide or the like is preferably employed as a physical development nucleus. When using as an image the physical development silver, which has been transferred to a sheet comprising a complexing agent, it is preferable to use palladium sulfide, silver sulfide and the like, because they have low Dmin and high Dmax values.

Both the first processing material and the second processing material can have at least one timing layer. The timing layer can temporarily retard the bleaching reaction until the desired reaction among the silver halide, a dye forming compound and a developing agent substantially ends. The timing layer may comprise gelatin, polyvinyl alcohol or a vinyl alcohol/vinyl acetate copolymer. This layer may be a barrier timing layer as described in U.S. Pat. Nos. 4,056,394, 4,061,496 and 4,229,516.

The layer thickness of the timing layer is in the range of 5 to 50 μm, preferably 10 to 30 μm.

According to the present invention, the photosensitive material after exposure thereof is bleached utilizing the second processing material. That is, the processing comprises supplying water, in an amount ranging from 1/10 to the equivalent of an amount which is required for the maximum swelling of the total layers of the photosensitive material and the second processing material excepting the respective back layers, to the photosensitive material or to the second processing material, placing the photosensitive material and the second processing material so that the photosensitive layer and processing layer face each other and thereafter heating them to a temperature in the range of 40 to 100° C. for 5 to 60 seconds.

As for the amount of water, kind of water, method of supplying water and method of placing the layer of the photosensitive material and the layer of the second processing material face to face, the same as those in the case of the first processing material can be employed.

More specifically, the bleaching sheets described in JP-A No. 59-136,733, U.S. Pat. No. 4,124,398 and JP-A No. 55-28,098, can be used in the present invention.

In the photosensitive material of the present invention, unreacted silver halide is not fixed after the heat development, and the photosensitive material which substantially retains the unreacted silver halide is used as a negative original to form an image on paper and the like.

In the present invention, "unreacted silver halide is not fixed" means that a fixing step is not performed after the heat development step.

In the present invention, "substantially retains the unreacted silver halide" means that 50 mol % or more, preferably 70 mol % or more, and more preferably 80 mol % or more of the unreacted silver halide is retained.

In the present invention, the processing period from the time when the layer of the processing material and the layer of the photosensitive material are placed face to face and to the time when these layers are released from each other is preferably 30 seconds or less.

In order to gain improvements in coatability, peeling-off property, sliding property, prevention of electrostatic charge and acceleration of the developing reaction, a surfactant may be added to the photosensitive material. Examples of the surfactants include those described in "Known Technologies" No. 5 (issued on Mar. 22, 1991, ASTECH Inc.), pp.136–138 and in JP-A Nos. 62-173,463 and 62-183,457.

For such purposes as improvement in sliding ability, prevention of electrostatic charge and improvements in peeling-off property, an organic fluorine-containing compound may be added to the photosensitive material. Typical examples of the organic fluorine-containing compounds include a fluorine-containing surfactant and a hydrophobic fluorine-containing compound, such as an oily fluorine-containing compound, e.g., fluorocarbon oil, and a solid fluorine-containing resin, e.g., tetrafluoroethylene, described in JP-B No. 57-9,053, columns8–17, JP-A Nos. 61-20, 944and 62-135,826.

The photosensitive material of the present invention preferably has sliding property. For this purpose, it is preferable that a lubricating agent be contained both in the photosensitive layer face and in the back face. A preferable level of sliding property is 0.01 to 0.25 as a coefficient of kinetic friction. This represents a value that is obtained when a sample is conveyed at a speed of 60 cm/minute in opposition to a stainless steel ball having a diameter of 5 mm (25° C., 60% RH). In this test, a value of nearly the same level is obtained even when the stainless steel ball is replaced with a photosensitive layer acting as a partner material.

Examples of feasible lubricating agents include polyorganosiloxanes, higher fatty acid amides, metal salts of higher fatty acid and esters made up of higher fatty acids and higher alcohols. Examples of the polyorganosiloxanes include polydimethylsiloxane, polydiethylsiloxane, polystyrylmethylsiloxane and polymethylphenylsiloxane. The layer to which the lubricating agent is added is preferably the outermost photosensitive layer or the back layer. Polydimethylsiloxane and an ester having a long alkyl chain are particularly preferable.

It is preferable to use an anti-static agent in the present invention. Polymers, which contain carboxylic acid, carboxylic acid salt or a sulfonic acid salt, cationic polymers and ionic surfactants can be used as the anti-static agent.

The most preferred anti-static agent is made up of grains of at least one type of crystalline metal oxide having grain sizes in the range of 0.001 to 1.0 $\mu$m, selected from the group consisting of ZnO, $TiO_2$, $SnO_2$, $Al_2O_3$, $In_2O_3$, $SiO_2$, MgO, BaO, MoO and $V_2O_5$ and having a volume resistivity of $10^7$ Ω.cm or less, preferably $10^5$ Ω.cm or less, or fine grains of a complex oxide thereof, for example a complex of an element such as Sb, P, B, In, S, Si, C and the like or fine grains of sol state, metal oxides or complex metal oxide thereof. The amount of an anti-static agent present in the photosensitive material is preferably in the range of 5 to 500 mg/m$^2$, more preferably in the range of 10 to 350 mg/m$^2$. The ratio of the electroconductive crystalline oxide or the complex oxide thereof to a binder is preferably in the range of 1/300 to 100/1, more preferably 1/100 to 100/5.

Constituent layers (including back layers) of the photosensitive material or processing sheet can contain a polymer latex in order to improve layer physical properties such as dimension stability, prevention of curling, prevention of adhering, prevention of layer cracking and prevention of pressure-induced sensitization or desensitization. Any polymer latices, which are described in JP-A Nos. 62-245,258, 62-136,648 and 62-110,066, can be used in the present invention. Particularly, the utilization of a polymer latex having a low glass transition point (40° C. or less) in a mordant layer can prevent the cracking of the mordant layer, while the utilization of a polymer latex having a high glass transition point in the back layer can prevent curling.

Preferably, the photosensitive material of the present invention contains a matting agent. Although the matting agent may be added to either the photosensitive layer or the back layer, it is particularly preferable that the matting agent be added to the outermost layer on the same side of the support that the emulsion layer is provided on. Although the matting agent may be soluble or insoluble in a processing solution, it is preferable to use a combination of a soluble matting agent and an insoluble matting agent in the present invention. Examples of matting agents comprise particles of polymethyl methacrylate, poly(methyl methacrylate/methacrylic acid) (in a molar ratio of 9/1 or 5/5) and polystyrene. The matting agent has particle diameters preferably in the range of 0.8 to 10 $\mu$m and preferably has a narrow range of particle diameter distribution. It is preferable that 90% or more of the total number of the particles have a diameter falling in the range of 0.9 to 1.1 times the average particle diameter. Meanwhile, in order to enhance the matting effect, it is also preferable to use fine particles having a particle diameter of 0.8 $\mu$m or less, together with the matting agent having the above-mentioned particle diameter. Examples of fine particles include particles of polymethyl methacrylate (0.2 $\mu$m), particles of poly(methyl methacrylate/methacrylic acid) (in a molar ratio of 9/1, 0.3 $\mu$mm), particles of polystyrene (0.25 $\mu$m) and particles of colloidal silica (0.03 $\mu$m). Concrete examples of the matting agent are described in JP-A No. 61-88,256, p.29. Other examples of the matting agent are such materials as benzoguanamine resin beads, polycarbonate beads and AS resin beads, all of which are described in JP-A Nos. 63-274,944 and 63-274,952. Further, the compounds which are described in the aforesaid Research Disclosure can be employed as the matting agent.

In the present invention, a support for the photosensitive material and the processing sheet needs to be able to withstand the processing temperature. Generally, examples of the support are paper, a synthetic polymer (film) and the like, as described in "Fundamentals of Photographic Engineering—Silver Salt Photography Section", pp.223–240, edited by Photographic Society of Japan, Corona Co., Ltd., 1979. Concrete examples of the support include polyethylene terephthalate, polyethylene naphthalate, polycarbonate, polyvinyl chloride, polystyrene, polypropylene, polyimide and celluloses (e.g., triacetylcellulose).

These materials may be used alone. Further, a support in which a synthetic polymer such as polyethylene is laminated to one side or both sides of paper can be used.

Other supports, which can be used in the present invention, include those described in JP-A Nos. 62-253,159, pp.29–31, 1-161, 236, pp.14–17, 63-316,848, 2-22, 651 and 3-56,955 and U.S. Pat. No. 5,001,033.

Where requirements of resistance to heat and curling are stringent, preferred examples of the supports are those described in JP-A Nos. 6-41,281, 6-43,581, 6-51,426, 6-51,437, 6-51,442, 6-82,961, 6-82,960, 6-123,937, 6-82,959, 6-67,346, 6-118,561, 6-266,050, 6-202,277, 6-175,282, 6-118,561, 7-219,129 and 7-219,144.

Also preferable is a support made from a styrene-based polymer mainly composed of a syndiotactic structure.

In order to bond the constituent photographic layer to the support, it is preferable that the support be surface-treated. Examples of the surface treatments include a chemical treatment, a mechanical treatment, a corona discharge treatment, a flame treatment, an ultraviolet ray treatment, a high frequency wave treatment, a glow discharge treatment, an activated plasma treatment, a laser treatment, a mixed acid treatment and an ozone-oxidation treatment. Among these surface treatments, an ultraviolet irradiation treatment, a flame treatment, a corona discharge treatment and glow discharge treatment are particularly preferable.

An undercoat layer may comprise a single layer or may comprise two or more layers. Examples of the binder for the undercoat layer include a copolymer, which is made up of a monomer as a starting material, selected from the group consisting of vinyl chloride, vinylidene chloride, butadiene, methacrylic acid, acrylic acid, itaconic acid, maleic anydride and the like, polyethylene imine, an epoxy resin, grafted gelatin, nitrocellulose and gelatin. Examples of the compound, which swells the support, include resorcin and p-chlorophenol. The undercoat layer may contain a gelatin-hardening agent such as a chromates (e.g., chrome alum), aldehydes (e.g., formaldehyde and glutaric aldehdye), isocyanates, active halogen compounds (e.g., 2,4-dichloro-6-hydroxy-s-triazine), an epichlorohydrin resin and active vinylsulfonic compounds. Further, the undercoat layer may contain $SiO_2$, $TiO_2$, grains of an inorganic material or particles of a copolymer of polymethyl methacrylate (0.01 to 10 $\mu$m) as a matting agent.

In addition, it is preferable to record photographic information and the like by use of a support which is provided with a magnetic recording layer and is described in JP-A Nos. 4-124,645, 5-40,321 and 6-35,092 and in Japanese Patent Application Nos. 5-58,221 and 6-317,875.

A magnetic recording layer is formed by coating onto a support an aqueous or organic solvent-based coating solution comprising a binder and magnetic grains dispersed therein.

Examples of usable magnetic grains include ferromagnetic iron oxide such as $\gamma$-$Fe_2O_3$, Co-deposited $\gamma$-$Fe_2O_3$, Co-deposited magnetite, Co-containing magnetite, ferromagnetic chromium dioxide, ferromagnetic metals, ferromagnetic alloys, hexagonal Ba-ferrite, Sr-ferrite, Pb-ferrite and Ca-ferrite. A Co-deposited ferromagnetic iron oxide such as Co-deposited $\gamma$-$Fe_2O_3$ is preferable. The grain can take the shape of any of, e.g., a needle, a rice grain, a sphere, a cube and a plate. The specific surface area in SBET is preferably 20 $m^2/g$ or greater, more preferably 30 $m^2/g$ or greater. The saturation magnetization ($\sigma s$) of the ferromagnetic substance is preferably in the range of $3.0\times10^4$ to $3.0\times10^5$ A/m, more preferably $4.0\times10^4$ to $2.5\times10^5$ A/m. The ferromagnetic grains may be surface-treated with silica and/or alumina or with an organic substance. Further, as described in JP-A No. 6-161,032, the ferromagnetic grains may be surface-treated with a silane coupling agent or with a titanium coupling agent. Magnetic grains, which are covered with an inorganic or organic substance and are described in JP-A Nos. 4-259,911and 5-81,652, can also be used in the present invention.

As described in JP-A No. 4-219,569, the binders usable together with the magnetic grains are thermoplastic resin, thermosetting resin, radiation-curable resins, reactive resins, acid-, alkali- or biodegradable polymers, naturally occurring polymers (e.g., cellulose derivatives and derivatives of saccharides) and mixtures thereof. These resins have a Tg in the range of −40 to 300° C. and a weight average molecular weight in the range of 2,000 to 1,000,000. Preferred examples of the binder include vinyl copolymers, cellulose derivatives, such as cellulose diacetate, cellulose triacetate, cellulose acetatepropionate, cellulose acetatebulylate and cellulose tripropionate, acrylic resins, polyvinyl acetal resins and gelatin. Cellulose di (tri) acetate is particularly preferable. The binder may be hardened by use of a crosslinking agent such as an epoxy, aziridine or isocyanate crosslinking agent. Examples of the isocyanate crosslinking agent include isocyantes, such as tolylenediisocyanate, 4,4'-diphenylmethanediisocyanate, hexamethylenediisocyanate and xylylenediisocyanate, a reaction product of any of these isocyanates and a polyalcohol (e.g., a tolylenediisocyanate/trimethylol propane in 3/1 molar ratio adduct) and a polyisocyanate produced by a condensation reaction of these isocyanates, all of which are described, for example, in JP-A No. 6-59,357.

As described in JP-A No. 6-35,092, the aforementioned magnetic grains are dispersed in a binder preferably by means of a kneader, a pin-type mill or an annular mill. A combination of these dispersing means is also preferable. Dispersants described in JP-A No. 5-088,283 and other known dispersants can be used. The thickness of the magnetic recording layer is in the range of 0.1 to 10 $\mu$m, preferably 0.2 to 5 $\mu$m, and more preferably 0.3 to 3 $\mu$m. The ratio of the weight of the magnetic grains to the weight of the binder is preferably in the range of 0.5:100 to 60:100, more preferably 1:100 to 30:100. The coating amount of the magnetic grains is in the range of 0.005 to 3 $g/m^2$, preferably 0.01 to 2 $g/m^2$, and more preferably 0.02 to 0.5 $g/m^2$. The transmission yellow density of the magnetic recording layer is preferably in the range of 0.01 to 0.50, more preferably 0.03 to 0.20, and most preferably 0.04 to 0.15. The magnetic recording layer may be formed on the entire surface or in a stripe on the reverse side of a photographic support by coating or printing the coating solution for forming the magnetic recording layer. Employable methods for forming the magnetic recording layer include an air doctor method, a blade method, an air knife method, squeezing, impregnation, reverse roll coating, transfer roll coating, gravure coating, kissing, casting, spraying, dipping, bar coating and extrusion. The coating solution, which is described, for example, in JP-A No. 5-341,436, is preferably used.

The magnetic recording layer may also function in the enhancement of lubrication, control of curling, prevention of electrostatic charge, prevention of adhering and head polishing. Alternatively, another functional layer can be formed and any of these functions can be given to that layer. The abrasive grains, which impart a head polishing function to the magnetic recording layer or to another functional layer, preferably contain at least one type of grain having a Mohs hardness of 5 or greater and are non-spherically shaped inorganic grains. Examples of the composition of non-spherical inorganic grains include oxides, such as aluminum oxide, chromium oxide, silicon dioxide and titanium dioxide, carbides, such as silicon carbide and titanium carbide, and a fine powder of diamond. The surface of abrasive grains may be treated with a silane coupling agent or with a titanium coupling agent. These grains may be added to the magnetic recording layer. Alternatively, the magnetic recording layer may be overcoated with a coating solution (e.g., a protective layer and lubricating layer) containing these grains. As for the binder in the overcoat, the same binders as those mentioned above may be used, and the binder in the overcoat is preferably the same as that for the magnetic recording layer. The photosensitive materials having a magnetic recording layer are described in U.S. Pat. Nos. 5,336,589, 5,250,404, 5.229,259 and 5,215,874 and in EP 466,130.

A polyester support to be used for the photosensitive material having a magnetic recording layer in the present invention is described below. Details of the polyester support, photosensitive materials, processings, cartridges and examples are described in Journal of Technical Disclosure No.94-6,023 (JIII; Mar. 15, 1994). The polyester used in the present invention is made up of a diol and an aromatic dicarboxylic acid as essential components. Examples of the aromatic dicarboxylic acid include 2,6-, 1,5-, 1,4- and 2,7-naphthalenedicarboxylic acids, terephthalic acid, isophthalic acid and phthalic acid. Examples of the diol include diethyleneglycol, triethyleneglycol, cyclohexanedimethanol, bisphenol A and bisphenol. Examples of the polymer are homopolymers such as polyethylene terephthalate, polyethylene naphthalate and polycyclohexanedimethanol terephthalate. The polyester containing 50 to 100 mol % of 2,6-naphthalenedicarboxylic acid is particularly preferable. Polyethylene-2,6-naphthalate is most preferable among these polymers. The average molecular weight ranges between 5,000 and 200,000. The Tg of the polyesters for use in the present invention is 50° C. or higher, preferably 90° C. or higher.

In order to make the polyester support more resistant to curling, the polyester support is heat-treated at a temperature within the range of from 40° C. up to Tg, more preferably at a temperature within the range of from Tg −20° C. up to Tg. The heat treatment can be performed at a fixed temperature within this range or can be performed while being cooled. The heat treatment time is 0.1 to 1,500 hours, more preferably 0.5 to 200 hours. The heat treatment can be performed in the form of a rolled support or while the support is conveyed in the form of a web. Grooves and bumps (e.g., coating the surface with electroconductive inorganic fine grains such as $SnO_2$ or $Sb_2O_5$) may be given to the surface to improve the surface condition. It is also desirable to knurl and slightly raise the edge portions, thereby preventing the shape of the cut edge portions of the core from being transferred. These heat treatments can be performed at any stage, for example, after the film making of the support, after surface treatment, after back layer coating (e.g., an antistatic agent or lubrication agent) and after the application of an undercoat. A preferable stage for the heat treatment is after the application of the antistatic agent.

An ultraviolet absorbent may be incorporated into this polyester. Also, the prevention of light pumping can be achieved by incorporating the polyester with a dye or pigment, such as Diaresin manufactured by Mitsubishi Chemical Industries, Ltd. or Kayaset manufactured by Nippon Kayaku Co., Ltd., which is commercially available as an additive to polyester.

A film cartridge for loading the photosensitive material of the present invention is described below. The principal material of the cartridge to be used in the present invention can be a metal or synthetic plastic.

Examples of preferable plastic materials include polystyrene, polyethylene, polypropylene and polyphenylene ether. The cartridge of the present invention can also contain various antistatic agents. For this purpose, carbon black, metal oxide grains, nonionic, anionic, cationic or betaine surfactants, or polymers can be preferably used. These cartridges subjected to the antistatic treatment are described in JP-A Nos. 1-312,537 and 1-312,538. It is particularly preferable that the resistance be $10^{12}$ Ω/□ or less at 25° C. and 25%RH. Commonly, plastic cartridges are manufactured by using plastics into which carbon black or pigments are incorporated to give a light-shielding property. The cartridge size can be a presently available 135 size. For the purpose of making the cameras compact, it is effective to decrease the diameter of a 25-mm cartridge of 135 size to 22 mm or less. The volume of a cartridge case is 30 $cm^3$ or less, preferably 25 $cm^3$ or less. The weight of the plastic used in the cartridge and the cartridge case is preferably 5 to 15 g.

Furthermore, a cartridge which feeds a film by rotating a spool can be used in the present invention. It is also possible to use a structure in which the tip of the film is housed in a cartridge main body and fed through a port of the cartridge to the outside by rotating a spool shaft in the film feed direction. These structures are disclosed in U.S. Pat. Nos. 4,834,306 and 5,226,613.

In the present invention, the developed silver produced through the developing process and undeveloped silver halide do not need to be removed and the image information can be read out by means of a scanner or the like as digital data. Printing material such as color printing paper can be optically exposed in an analog way using the photographed information of conventional procedures.

In order to produce prints on a sheet of color printing paper or a photosensitive material for heat development by use of the color photographic material for photographing of the present invention, the methods described in JP-A Nos. 5-241,251, 5-19,364 and 5-19,363 can be used.

In the present invention, after photographing and the image-forming development that follows, it is possible to incorporate another method to reduce adverse effects which occur when image information is read. The undeveloped silver halide in particular is known to cause high-level haze in the film, and to increase the background density of images. These adverse effects are thought to be remarkably suppressed by use of the silver halide of the present invention. The details of the mechanism, however, will be clarified in future studies.

In order to produce prints on a sheet of color printing paper or a photosensitive material for heat development by use of the color photographic material for photographing of the present invention, the methods described in JP-A Nos. 5-241,251, 5-19,364 and 5-19,363 can be used.

EXAMPLES

In order to better explain the present invention, the following examples are given by way of illustration and not by way of limitation.

Example 1

Preparation of Pure Silver Chloride Grains Having a Normal Crystal Habit 600 ml of a silver nitrate aqueous solution (21.3 g of silver nitrate) and 600 ml of a sodium chloride aqueous solution (7.74 g of sodium chloride) were added to a vessel containing a mixture of 4.8 g of sodium chloride and 30 g of inert gelatin in 1 liter of water kept at 60° C. while stirring by means of a double jet method over a period of 20 minutes. 5 minutes after the completion of the addition, a crystal habit controlling agent shown in Table 1 was added to the reaction mixture (the numerals indicated in the column of the crystal habit controlling agent mean numerals attached to the crystal habit controlling agents illustrated previously with the exception that the crystal habit controlling agent-31 is described below). Then, 5 minutes after the completion of the addition of the crystal habit controlling agent, 300 ml of an aqueous silver nitrate solution (112.5 g of silver nitrate) and 300 ml of an aqueous sodium chloride solution (40.14 g of sodium chloride) were added to the reaction mixture over a time period of 60 minutes.

After the completion of the addition, $4.0\times10^{-3}$ mol of potassium thiocyanate per one mol of silver was added to the reaction mixture at 60° C. Further, 10 minutes after the addition, the sensitizing dye-1 shown below was added to the reaction mixture and the temperature of the reaction mixture was raised to 75° C., and thereafter the stirring of the reaction mixture was continued for 10 minutes.

The temperature of the reaction mixture was then lowered to 40° C., and thereafter an aqueous solution containing the make the total volume 3.5 liters. Then, the pH of the reaction mixture was lowered by the addition of sulfuric acid to a value (pH-3.8) which caused the silver halide to precipitate. Then, 83% of the supernatant liquid (supernatant liquid 1 (Si)) was removed (1st water washing). Distilled water of the same volume as that of the removed liquid was added to the reaction mixture, and thereafter sulfuric acid was added to the reaction mixture until silver halide precipitated. Again, 83% of the supernatant liquid (supernatant liquid 2 (S2)) was removed (2nd water washing). Distilled water of the same volume as that of the removed liquid was added to the reaction mixture, and thereafter sulfuric acid was added to the reaction mixture until silver halide precipitated. Yet again, 83% of the supernatant liquid (supernatant liquid 3 (S3)) was removed (3rd water washing). In this way, the desalting procedure ended.

Sensitizing dye-1

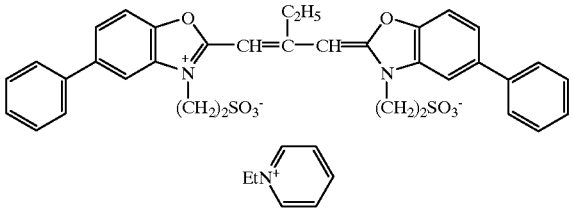

crystal habit controlling agent-31

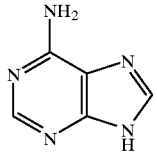

flocculant-31

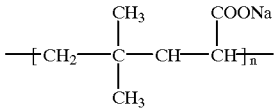

average molecular weight: 120,000

Then, 67 g of gelatin, 80 ml of phenol (5%) and 150 ml of distilled water were added to the reaction mixture, which was adjusted so as to have a pH of 6.2 and a pAg of 7.5 by using a sodium hydroxide solution and a silver nitrate solution. In this way, emulsions R1 to R4 (photosensitive silver halide) containing pure silver chloride grains having an average equivalent-sphere diameter of 0.55 μm were prepared.

It was found that a (111) plane comprised 0%, 100%, 100% and 100% of the exterior faces of the photosensitive silver halide grain of the obtained emulsions R1 to R4, respectively. Further, it was found that the above-described photosensitive silver halide grains accounted for nearly 100% of the total projected area in the respective emulsions R1 to R4 (photosensitive silver halide).

TABLE 1

| Emulsion | Crystal habit controlling agent | Adding amount (mol/mol of silver) | Shape |
|---|---|---|---|
| R1 | Bank | — | Cube |
| R2 | 1 | $3.0 \times 10^{-3}$ | Octahedron |
| R3 | 23 | $1.5 \times 10^{-3}$ | Octahedron |
| R4 | 31 | $3.0 \times 10^{-3}$ | Octahedron |
| R5 | 1 | $3.0 \times 10^{-3}$ | Tetradecahedron |

Example 2

Preparation of Pure Silver Chloride Tetradecahedral Grains

Emulsion R5 (photosensitive silver halide) was prepared by repeating the procedure of Example 1 except that the crystal habit controlling agent shown in Table 1 was added to the reaction mixture at the time when 50 g of silver nitrate was added.

It was found that the obtained photosensitive silver halide grains were tetradecahedrons having an average equivalent-sphere diameter of 0.55 μm and that a (111) plane comprised 60% of the exterior faces of the photosensitive silver halide grains. Further, it was found that the above-described photosensitive silver halide grains comprised 95% of the total projected area in the emulsion R5.

Example 3

Preparation of Pure Silver Chloride (100) Tabular Grains 1,200 ml of aqueous gelatin solution having a pH value of 4.3, which comprised 25 g of deionized and alkali processed ossein gelatin containing a methionine about 40 μmol/g of methionine, 1 g of sodium chloride and 4.5 ml of 1N nitric acid, was placed in a reaction vessel, and thereafter the temperature of the solution was raised to 40° C. To this solution, which was vigorously stirred, there were added 36 ml of an aqueous solution (A) containing 20 g of silver nitrate per 100 ml and 36 ml of an aqueous solution (B) containing 0.71 g of potassium bromide and 6.67 g of sodium chloride per 100 ml simultaneously over a period of 45 seconds. After the completion of the addition, the reaction mixture was stirred for 3 minutes and was admixed with 43.4 ml of an aqueous solution (C) containing 1.1 g of potassium bromide per 100 ml over a period of 30 seconds. After the completion of the addition, the temperature of the reaction mixture was lowered to 30° C. in 3 minutes and was kept at that temperature. Then, 108 ml of the aqueous solution (A) and 108 ml of an aqueous solution (D) containing 7.02 g of sodium chloride per 100 ml were added to the reaction mixture simultaneously over a period of 2 minutes and 15 seconds. After the completion of the addition, the reaction mixture was stirred for 1 minute and was admixed with 20 ml of a 10% sodium chloride aqueous solution and 7 ml of 1N sodium hydroxide aqueous solution so that the reaction mixture had a pH value of 6.5 and a silver potential of 80 mV with respect to a saturated calomel electrode. After that, 2 ml of a hydrogen peroxide solution (35%) was added to the reaction mixture. Then, the temperature of the reaction mixture was raised to 75° C. After the reaction mixture was ripened for 5 minutes at 75° C., 1,086 g of an emulsion (containing 108.7 g of silver), which comprised silver chlorobromide cubic grains containing 5 mol % of silver bromide having an average granular side length of 0.06 μm, was added to the reaction mixture over a period of 45 minutes, while the silver potential was kept at 140 mV. After the completion of the addition, 27 ml of 1% potassium thiocyanate, a sensitizing dye 2 in an amount of $4.5\times10^{-4}$ mol per mol of silver and a sensitizing dye 3 in an amount of $5\times10^{-5}$ mol per mol of silver were added to the reaction mixture, and the resultant mixture was stirred for 10 minutes. Then, the temperature of the reaction mixture was lowered to 35° C., and the salts were removed from the reaction mixture using a standard method.

The obtained emulsion (photosensitive silver halide) was found to be an emulsion (hereinafter referred to as Σ1) made up of silver chlorobromide (100) tabular grains having an average equivalent-sphere diameter of 0.92 μm, an average grain thickness of 0.128 μm, an aspect ratio of 15.9 and a silver bromide content of 5 mol %.

sensitizing dye 2

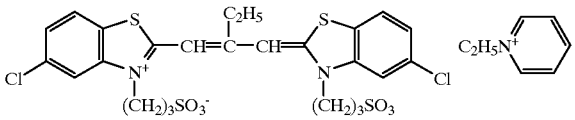

sensitizing dye 3

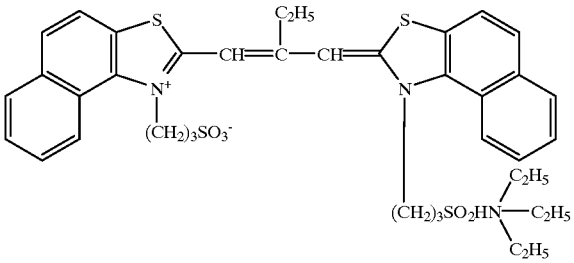

Example 4

Preparation of Pure Silver Chloride (111) Tabular Grains 60 ml of an aqueous silver nitrate solution (9 g of silver nitrate) and 60 ml of a sodium chloride aqueous solution (3.2 g of sodium chloride) were added to a vessel containing a mixture of 2.0 g of sodium chloride and 2.4 g of inert gelatin in 1.2 liters of water kept at 35° C. while stirring by means of a double jet method over a period of 1 minute. 1 minute after the completion of the addition, 1 mmol of the crystal habit controlling agent-i was added to the reaction mixture. Then, after 1 minute, 3.0 g of sodium chloride was added to the reaction mixture. Then, the temperature of the reaction mixture was raised to 60° C. in 25 minutes. After the reaction mixture was ripened for 16 minutes at 60° C., 290 g of a 10% aqueous phthalated gelatin solution was added to the reaction mixture. After that, 754 ml of silver nitrate aqueous solution (113 g of silver nitrate) and 768 ml of sodium chloride aqueous solution (41.3 g of sodium chloride) were added to the reaction mixture at a flow rate with acceleration over a period of 40 minutes, wherein at a point 37 minutes after the start of the addition, 34 ml of a 10% KBr aqueous solution was added to the reaction mixture, and, meanwhile, at a period of 30 to 40 minutes after the start of the addition, 30 ml of a 0.25M sodium chloride aqueous solution containing 11 mg of potassium ferrocyanide was added to the reaction mixture.

After the completion of the addition, 27 ml of 1% potassium thiocyanate, $4.5\times10^{-4}$ mol of the sensitizing dye 2 and $5.0\times10^{-5}$ mol of the sensitizing dye 3 per one mol of silver were added to the reaction mixture. Then, the temperature of the reaction mixture was raised to 75° C., and thereafter the stirring of the reaction mixture was continued for 10 minutes.

The temperature of the reaction mixture was then lowered to 40° C., and thereafter an aqueous solution containing 0.3 g of the flocculant-1 was added to the reaction mixture to make the total volume 3.5 liters. Next, the flocculation method of Example 1 was repeated and water washing was performed.

After the water washing stage, 67 g of gelatin, 80 ml of phenol (5%) and 150 ml of distilled water were added to the reaction mixture, which was adjusted so as to have a pH of 6.2 and a pAg of 7.5 by using a sodium hydroxide solution and a silver nitrate solution. In this way, an emulsion (hereinafter referred to as Σ2) was obtained which was made up of pure silver chloride tabular grains having an average equivalent-sphere diameter of 0.85 μm and an average grain thickness of 0.14 μm.

It was found that the obtained silver halide grain had an aspect ratio of 12.2 and the major plane comprising 86% of the exterior faces of the grain was a (111) plane. Further, it was found that the above-described photosensitive silver halide grains accounted for nearly 95% of the total projected area of the emulsion Σ2 (photosensitive silver halide).

Example 5

Preparation of Pure Silver Chloride (111) Tabular Grains

An emulsion (hereinafter referred to as Σ3) was prepared by repeating the procedure of Example 4 except that 1.44 mmol of the crystal habit controlling agent-31 was added in place of the crystal habit controlling agent-1. The grains in the obtained emulsion had an average equivalent-sphere diameter of 0.85 μm and an average grain thickness of 0.12 μm.

It was found that the obtained photosensitive silver halide grains had an aspect ratio of 15.4 and the major plane comprising 88.5% of the exterior faces of the grain was a (111) plane. Further, it was found that the above-described photosensitive silver halide grains accounted for 90% of the total projected area of the emulsion Σ3 (photosensitive silver halide).

Example 6

Chemical Sensitization

The optimal chemical sensitization of the emulsions R1 to R5 were effected at 60° C. by use of 4-hydroxy-6-methyl-1,3,3a, 7-tetraazindene, sodium thiosulfate and chloroauric acid.

In addition, the optimal chemical sensitization of the emulsions Σ1 to Σ3 were effected at 60° C. by use of 4-hydroxy-6-methyl-1,3,3a, 7-tetraazindene, sodium thiosulfonate, sodium thiosulfate, the selenium compound-1 shown below, chloroauric acid and the compound-1 shown below.

Compound-1

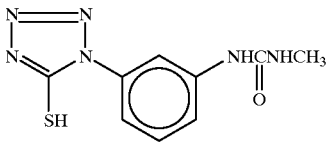

Example 7

Using the emulsions R1 to R5 which were chemically sensitized in Example 6, photographic characteristics were evaluated.

Firstly, a dispersion of zinc hydroxide serving as a base precursor in the heat development was prepared. A mixture, which comprised 31 g of zinc hydroxide powder having an average diameter of primary grains of 0.2 μm, 1.6 g of carboxymethylcellulose and 0.4 g of sodium polyacrylate as dispersants, 8.5 g of lime-processed ossein gelatin and 158.5 ml of water, was dispersed for one hour by means of a mill with glass beads. After filtering off the glass beads from the mixture, 188 g of a dispersion of zinc hydroxide was obtained.

Next, an emulsified dispersion of a magenta dye forming coupler was prepared in the following way. A mixture, which comprised 7.80 g of magenta dye forming coupler (a1), 5.45 g of a developing agent (b1), 2 mg of an anti-fogging agent (c), 8.21 g of an organic solvent having a high boiling point (d) and 24 ml of ethyl acetate, was dissolved at 60° C. The solution was blended into 150 g of an aqueous solution comprising 12 g of a lime-processed gelatin and 0.6 g of sodium dodecylbenzenesulfonate. The resultant mixture was emulsified by means of a dissolver-type mixing device rotating at 10,000 revolutions per minute over a period of 20 minutes. After the emulsification, distilled water was added to the emulsion so that the total volume became 300 g, and the resultant liquid was mixed at 2,000 revolutions per minute for 10 minutes.

Magenta dye forming coupler (a1)

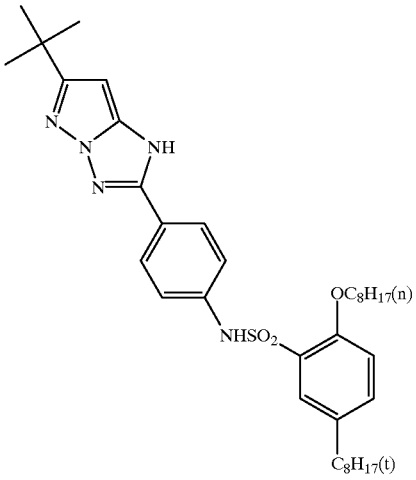

Developing agent (b1)

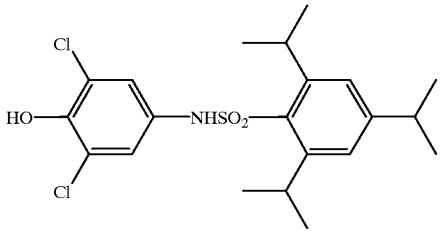

Anti-fogging agent (c)

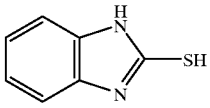

Organic solvent having a high boiling point (d)

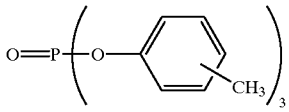

Other dispersions of magenta dye forming coupler were prepared by repeating the above procedure except that the developing agent was replaced with a developing agent (b2) (4.15 g) or with a developing agent (b3) (4.73 g).

Developing agent (b2)

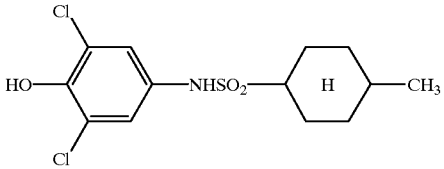

Developing agent (b3)

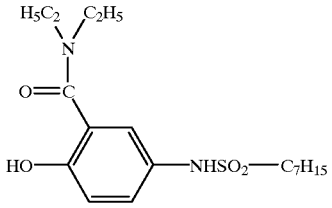

Samples 701 to 710 of photographic photosensitive materials for use in heat development were prepared by combining the above-described dispersions with the aforedescribed silver halide emulsions as shown in Tables 2 to 4. The constituent layers were coated onto a transparent PET support having a thickness of 120 $\mu$m.

TABLE 2

The indicated amounts are all based on mg/m$^2$

| Sample No. | | 701 Comparative | 702 Present invention | 703 Present invention | 704 Present invention |
|---|---|---|---|---|---|
| Protective layer | Lime-processed gelatin | 1000 | 1000 | 1000 | 1000 |
| | Matting agent (silica) | 50 | 50 | 50 | 50 |
| | Surfactant (f) | 100 | 100 | 100 | 100 |
| | Surfactant (g) | 300 | 300 | 300 | 300 |
| | Water-soluble polymer (h) | 15 | 15 | 15 | 15 |
| | Hardener (i) | 40 | 40 | 40 | 40 |
| Intermediate layer | Lime-processed gelatin | 375 | 375 | 375 | 375 |
| | Surfactant (g) | 15 | 15 | 15 | 15 |
| | Zinc hydroxide | 1100 | 1100 | 1100 | 1100 |
| | Water-soluble polymer (h) | 15 | 15 | 15 | 15 |
| Emulsion layer | Lime-processed gelatin | 2000 | 2000 | 2000 | 2000 |
| | Emulsion (in amounts based on silver) | 1726 | 1726 | 1726 | 1726 |
| | (Name of emulsion) | (R1) | (R2) | (R3) | (R4) |
| | Magenta dye forming coupler (al) | 637 | 637 | 637 | 637 |
| | Developing agent (b1) | 444 | 444 | 444 | 444 |
| | Developing agent (b2) | — | — | — | — |
| | Developing agent (b3) | — | — | — | — |
| | Anti-fogging agent (c) | 0.20 | 0.20 | 0.20 | 0.20 |
| | Organic solvent having a high boiling point (d) | 670 | 670 | 670 | 670 |
| | Surfactant (e) | 33 | 33 | 33 | 33 |
| | Water-soluble polymer (h) | 14 | 14 | 14 | 14 |

TABLE 3

| Sample No. | | 705 Present invention | 706 Comparative | 707 Comparative | 708 Comparative |
|---|---|---|---|---|---|
| Protective layer | Lime-processed gelatin | 1000 | 1000 | 1000 | 1000 |
| | Matting agent (silica) | 50 | 50 | 50 | 50 |
| | Surfactant (f) | 100 | 100 | 100 | 100 |
| | Surfactant (g) | 300 | 300 | 300 | 300 |
| | Water-soluble polymer (h) | 15 | 15 | 15 | 15 |
| | Hardener (i) | 40 | 40 | 40 | 40 |

TABLE 3-continued

| Sample No. | | 705 Present invention | 706 Comparative | 707 Comparative | 708 Comparative |
|---|---|---|---|---|---|
| Intermediate layer | Lime-processed gelatin | 375 | 375 | 375 | 375 |
| | Surfactant (g) | 15 | 15 | 15 | 15 |
| | Zinc hydroxide | 1100 | 1100 | 1100 | 1100 |
| | Water-soluble polymer (h) | 15 | 15 | 15 | 15 |
| Emulsion layer | Lime-processed gelatin | 2000 | 2000 | 2000 | 2000 |
| | Emulsion (in amounts based on silver) | 1726 | 1726 | 1726 | 1726 |
| | (Name of emulsion) | (R5) | (R1) | (R2) | (R4) |
| | Magenta dye forming coupler (al) | 637 | 637 | 637 | 637 |
| | Developing agent (b1) | 444 | — | — | — |
| | Developing agent (b2) | — | 338 | 338 | 338 |
| | Developing agent (b3) | — | — | — | — |
| | Developing agent (c) | 0.20 | 0.20 | 0.20 | 0.20 |
| | Organic solvent having a high boiling point (d) | 670 | 670 | 670 | 670 |
| | Surfactant (e) | 33 | 33 | 33 | 33 |
| | Water-soluble polymer (h) | 14 | 14 | 14 | 14 |

TABLE 4

| Sample No. | | 709 Present invention | 710 Present invention |
|---|---|---|---|
| Protective layer | Lime-processed gelatin | 1000 | 1000 |
| | Matting agent (silica) | 50 | 50 |
| | Surfactant (f) | 100 | 100 |
| | Surfactant (g) | 300 | 300 |
| | Water-soluble polymer (h) | 15 | 15 |
| | Hardener (i) | 40 | 40 |
| Intermediate layer | Lime-processed gelatin | 375 | 375 |
| | Surfactant (g) | 15 | 15 |
| | Zinc hydroxide | 1100 | 1100 |
| | Water-soluble polymer (h) | 15 | 15 |
| Emulsion layer | Lime-processed gelatin | 2000 | 2000 |
| | Emulsion (in amounts based on silver) | 1726 | 1726 |
| | (Name of emulsion) | (R2) | (R4) |
| | Magenta dye forming coupler (al) | 637 | 637 |
| | Developing agent (b1) | — | — |
| | Developing agent (b2) | — | — |
| | Developing agent (b3) | 385 | 385 |
| | Anti-fogging agent (c) | 0.20 | 0.20 |
| | Organic solvent having a high boiling point (d) | 670 | 670 |
| | Surfactant (e) | 33 | 33 |
| | Water-soluble polymer (h) | 14 | 14 |

Surfactant (e)

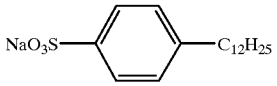

Surfactant (f)

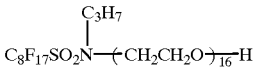

Surfactant (g)

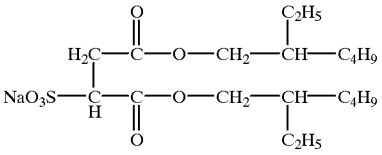

-continued

Water- soluble polymer (h)

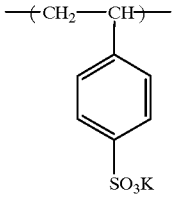

Hardener (i)

Further, a processing material P-1 as shown in Table 5 was prepared.

TABLE 5

| Constituent layer | Added substance | Amount added |
|---|---|---|
| 4th layer: Protective layer | Acid-processed gelatin | 220 |
| | Water-soluble polymer (j) | 60 |
| | Water-soluble polymer (k) | 200 |
| | Additive (l) | 80 |
| | Palladium sulfide | 3 |
| | Potassium nitrate | 12 |
| | Matting agent (m) | 10 |
| | Surfactant (g) | 7 |
| | Surfactant (n) | 7 |
| | Surfactant (o) | 10 |
| 3rd layer: Intermediate layer | Lime-processed gelatin | 240 |
| | Water-soluble polymer (k) | 24 |
| | Hardener (p) | 180 |
| | Surfactant (e) | 9 |
| 2nd layer: Base generating layer | Lime processed gelatin | 2400 |
| | Water-soluble polymer (k) | 360 |
| | Water-soluble polymer (q) | 700 |
| | Water-soluble polymer (r) | 600 |
| | Organic solvent having a high boiling point (s) | 2000 |
| | Additive (t) | 20 |
| | Potassium hydantoin, | 260 |
| | Guanidine Picolinate | 2910 |
| | Potassium quinolinate | 225 |
| | Sodium quinolinate | 180 |
| | Surfactant (e) | 24 |
| 1st layer: Undercoat layer | Lime-processed gelatin | 280 |
| | Water-soluble polymer (j) | 12 |
| | Surfactant (g) | 14 |
| | Hardener (p) | 185 |
| | Transparent support A (63 μm) | |

Water-soluble polymer (j) : κ-carrageenan water-soluble polymer (k): Sumikagel L-5H (from Sumitomo Chemical Co., Ltd.)

Additive (l)

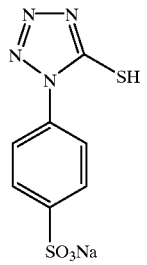

Matting Agent (m): SYLOID 79 (from Fuji-Davison Chemical Co., Ltd.)

Surfactant (n)

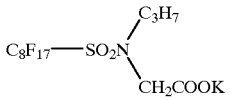

Surfactant (o)

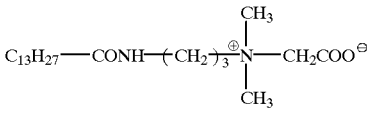

Hardener (p)

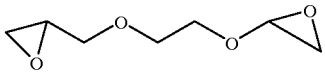

Water-soluble polymer (g): Dextran (molecular weight: 70,000)

Water-soluble polymer (r): MP Polymer MP 102 (from Kuraray Co. Ltd.)

Organic solvent having a high boiling point (s): EMPARA 40 (from Ajinomoto Co., Ltd.)

Additive (t)

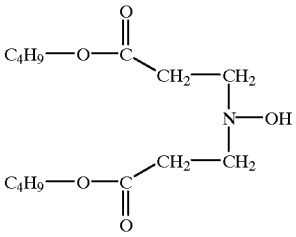

These photosensitive materials were exposed to light of 1,000 lux for 1/100 second through an optical wedge and a green filter.

After the exposure, heat development was carried out by the procedure comprising supplying 15 ml/m$^2$ of warm water at 40° C. to the photosensitive layer of the photographic silver halide photosensitive material, placing the photosensitive material and the processing layer of a processing material face to face so that the layers faced each other and thereafter heating the materials to 83° C. for 30 seconds by use of a heat drum. A magenta colored wedge-shaped image was obtained in the samples 701 to 710 when the procesing material was removed from the photosensitive materials after the above-described procedure.

The colored samples were subjected to a stabilizing treatment by the processing material P-2 shown in Table 6 indicated below.

TABLE 6

| Constituent layer | Added substance | Amount added |
|---|---|---|
| 4th layer | Acid-treated gelatin | 180 |
| | Water-soluble polymer (j) | 60 |
| | Water-soluble polymer (k) | 200 |

TABLE 6-continued

| Constituent layer | Added substance | Amount added |
|---|---|---|
| | Potassium nitrate | 12 |
| | Matting agent (m) | 10 |
| | Surfactant (g) | 7 |
| | Surfactant (n) | 7 |
| | Surfactant (o) | 10 |
| 3rd layer | Lime-processed gelatin | 240 |
| | Water-soluble polymer (k) | 24 |
| | Hardener (p) | 180 |
| | Surfactant (e) | 9 |
| 2nd layer | Lime-processed gelatin | 2400 |
| | Water-soluble polymer (k) | 120 |
| | Water-soluble polymer (q) | 700 |
| | Water-soluble polymer (r) | 600 |
| | Organic solvent having a high boiling point (s) | 2000 |
| | Additive A | 1270 |
| | Additive B | 683 |
| | Surfactant (e) | 20 |
| 1st layer | Gelatin | 190 |
| | Water-soluble polymer (j) | 12 |
| | Surfactant (g) | 14 |
| | Hardener (p) | 185 |
| | Transparent support A (63 μm) | |

Additive A

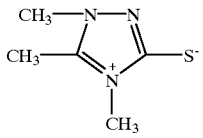

Additive B

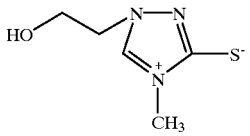

The composition of the support A of the processing material P-2 is shown in Table 7.

TABLE 7

| Name of layer | Composition | Weight (mg/m$^2$) |
|---|---|---|
| Undercoat layer on the front side | Gelatin | 100 |
| Polymer layer | Polyethylene terephthalate | 62500 |
| Undercoat layer on the reverse side | Methyl methacrylate/styrene/2-ethylhexyl acrylate/methacrylic acid copolymer, | 1000 |
| | PMMA late (average particle diameter: 12 μm) | 120 |
| | | 63720 |

The stabilizing processing comprised supplying 10 ml/m$^2$ of water to the processing material P-2, placing the processing P-2 and the color developed samples so that the layers thereof faced each other and thereafter heating at 60° C. for 30 seconds.

The colored samples were subjected to the transmission density measurement to obtain the so-called characteristic curve. The sensitivity was expressed as the reciprocal of an exposing light amount at a density 0.15 higher than fogging density. The results are shown in Table 8. Sensitivity is indicated in relative values by taking the sensitivity of the sample 701 as 100. Fog is indicated by relative values by taking the maximum density as 1.

TABLE 8

Sensitivity is indicated in relative values by taking the sensitivity of the sample 701 as 100. Fog is indicated by taking the maximum density as 1.

| Sample No. | Relative sensitivity | Fog | Emulsion | Developing agent |
|---|---|---|---|---|
| 701 Comparative example | 100 | 0.18 | R1 | b1 |
| 702 Example of the present invention | 141 | 0.08 | R2 | b1 |
| 703 Example of the present invention | 130 | 0.09 | R3 | b1 |
| 704 Example of the present invention | 105 | 0.08 | R4 | b1 |
| 705 Example of the present invention | 120 | 0.11 | R5 | b1 |
| 706 Comparative example | 25 | 0.11 | R1 | b2 |
| 707 Comparative example | 22 | 0.11 | R2 | b2 |
| 708 Comparative example | 16 | 0.10 | R4 | b2 |
| 709 Example of the present invention | 101 | 0.08 | R2 | b3 |
| 710 Example of the present invention | 95 | 0.08 | R4 | b3 |

The results shown in Table 8 elucidate the following. Among the green-sensitized emulsions R1 to R5, the emulsions R2 to R5 whose constituent grains are octahedral or tetradecahedral grains in which a (111) plane comprises 50% or more of the exterior faces of the grains have a higher sensitivity and lower level of fogging than the emulsion R1 whose constituent grains are cubic having a (100) plane. These results were only obtained only when the developing agent (b1) and (b3) of the present invention were used. Further, in the case where the developing agent of the present invention is used, the developing agent (b1) which has a substituent bearing a ballast group having 8 or more carbon atoms exhibits better photographic characteristics than the developing agent (b3) which has no ballast group.

Example 8

Using the emulsions Σ1 to Σ3 which were prepared in Example 6, photographic characteristics were evaluated.

Firstly, an emulsified dispersion of a cyan dye forming coupler was prepared in the following way. A mixture, which comprised 10.7 g of cyan dye forming coupler (a2), 5.45 g of a developing agent (b1), 2 mg of an anti-fogging agent (c), 8.21 g of an organic solvent having a high boiling point (d) and 24 ml of ethyl acetate, was made into a solution at 60° C. The solution was blended into 150 g of an aqueous solution comprising 12 g of a lime-processed gelatin and 0.6 g of sodium dodecylbenzenesulfonate. The resultant mixture was emulsified by means of a dissolver-type mixing device rotating at 10,000 revolutions per minute over a period of 20 minutes. After the emulsification, distilled water was added to the emulsion so that the total volume became 300 g, and the resultant liquid was mixed at 2,000 revolutions per minute for 10 minutes. Cyan dye forming coupler (a2)

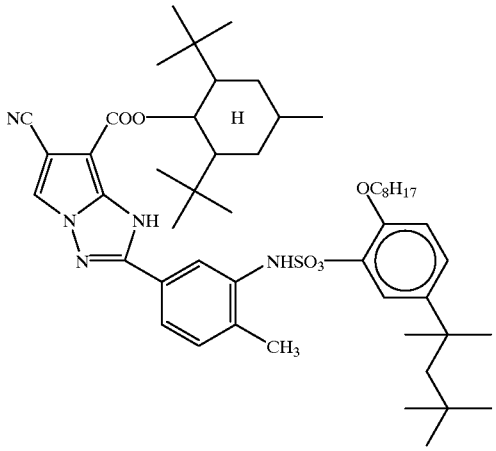

In addition, a dispersion of zinc hydroxide was prepared as in Example 7.

Samples 801 to 803 for use in heat development were prepared by combining the above-described dispersions with the silver halide emulsions as shown in Table 9. The constituent layers were coated onto a transparent PET support having a thickness of 120 μm.

TABLE 9

The indicated amounts are all based on mg/m².

| Sample No. | | 801 Comparative | 802 Present invention | 803 Present invention |
|---|---|---|---|---|
| Protective layer | Lime-processed gelatin | 1000 | 1000 | 1000 |
| | Matting agent (silica) | 50 | 50 | 50 |
| | Surfactant (f) | 100 | 100 | 100 |
| | Surfactant (g) | 300 | 300 | 300 |
| | Water-soluble polymer (h) | 15 | 15 | 15 |
| | Hardener (i) | 40 | 40 | 40 |
| Intermediate layer | Lime-processed gelatin | 375 | 375 | 375 |
| | Surfactant (g) | 15 | 15 | 15 |
| | Zinc hydroxide | 1100 | 1100 | 1100 |
| | Water-soluble polymer (h) | 15 | 15 | 15 |
| Emulsion layer | Lime-processed gelatin | 2000 | 2000 | 2000 |
| | Emulsion (in amounts based on silver) | 1726 | 1726 | 1726 |
| | Name of emulsion | (Σ1) | (Σ2) | (Σ3) |
| | Cyan dye forming coupler (a2) | 872 | 872 | 872 |
| | Developing agent (b1) | 444 | 444 | 444 |
| | Anti-fogging agent (c) | 0.20 | 0.20 | 0.20 |
| | Organic solvent having a high boiling point (d) | 670 | 670 | 670 |
| | Surfactant (e) | 33 | 33 | 33 |
| | Water-soluble polymer (h) | 14 | 14 | 14 |

These photosensitive materials were exposed to light of 1,000 lux for 1/100 second through an optical wedge and a red filter.

Further, the heat development and stabilizing processing were carried out as in Example 7.

The colored samples were subjected to the transmission density measurement to obtain the so-called characteristic curve. The sensitivity was expressed as the reciprocal of an exposing light amount at a density 0.15 higher than fogging density. The results are shown in Table 10. Sensitivity is indicated in relative values by taking the sensitivity of the sample 801 as 100. Fog is indicated by relative values by taking the maximum density as 1.

TABLE 10

Sensitivity is indicated in relative values by taking the sensitivity of the sample 801 as 100. Fogging is indicated by relative values by taking the maximum density as 1.

| Sample No. | Relative sensitivity | Fog | Emulsion | Developing agent |
|---|---|---|---|---|
| 801 Comparative example | 100 | 0.19 | Σ1 | b1 |
| 802 Example of the present invention | 134 | 0.09 | Σ2 | b1 |
| 803 Example of the present invention | 111 | 0.09 | Σ3 | b1 |

The results shown in Table 10 elucidate the following. Also in the case of red-sensitization, the emulsions Σ2 and Σ3 composed of tabular grains in which a (111) plane comprises 50% or more of the exterior faces of the grains have a higher sensitivity and lower level of fogging than the emulsion Σ1 whose constituent grains are tabular having a (100) plane.

The effect of the present invention is apparent from the results of Examples 7 and 8.

Example 9

The preparation procedure for the emulsion Σ1 in Example 3 was repeated, except that the amount and the adding speed of the reaction solutions to be added were changed to obtain an emulsion Σ1-1 composed of grains having an average grain size expressed in the equivalent-sphere diameter of 0.67 μm and an average aspect ratio of 12.4 and an emulsion Σ1-2 composed of grains having an average grain size 0.43 μm and an average aspect ratio of 6.3. Further, the preparation procedures for the emulsions Σ2 and Σ3 in Example 3 were repeated, except that the amount of gelatin and the reaction solutions at the time of nuclei formation were changed to obtain emulsions Σ2-1 and Σ3-1 composed of grains having an average grain size of 0.65 μm and an average aspect ratio of 12 and emulsions Σ2-2 and Σ3-2 composed of grains having an average grain size of 0.45 μm and an average aspect ratio of 6.

In the preparation of these emulsions, however, the following changes were made in the use of the spectral sensitizing dye. That is, a sensitizing dye I for blue-sensitive emulsion was employed for the preparation of a blue-sensitive emulsion; sensitizing dyes II, III and IV for green-sensitive emulsion were employed for the preparation of green-sensitive emulsions; and sensitizing dyes V, VI and VII for red-sensitive emulsion were employed for the preparation of red-sensitive emulsions. The colors to which the emulsions were sensitive, e.g., blue, green and red, were indicated with suffixes b, g and red, respectively. The amounts of sensitizing dyes were selected in proportion to the surface areas of the grains. The conditions for Σ1-1, Σ2-1 and Σ3-1 are given below together with the structural formulas of the compounds used.

sensitizing dye I for blue-sensitive emulsions

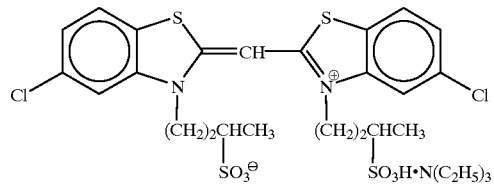

$6.0\times10^{-4}$ mol/mol of silver for the emulsions Σ1-1b, Σ2-1b and Σ3-1b sensitizing dye II for green-sensitive emulsions

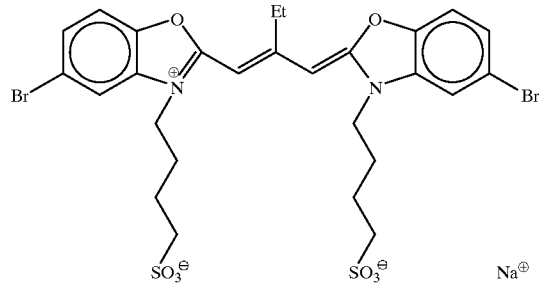

$8.4\times10^{-4}$ mol/mol of silver for the emulsions Σ1-1g, Σ2-1g and Σ3-1g sensitizing dye III for green-sensitive emulsions

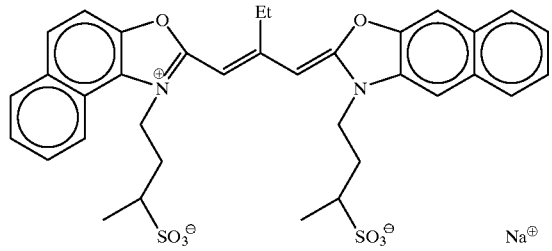

$2.2\times10^{-4}$ mol/mol of silver for the emulsions Σ1-1g, Σ2-1g and 3-1g sensitizing dye IV for green-sensitive emulsions

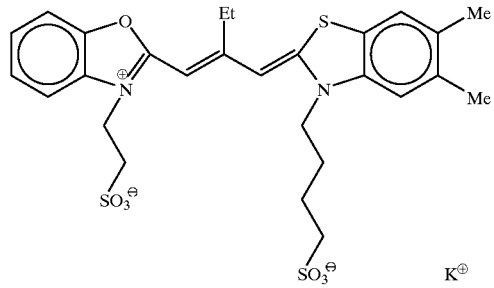

$3.2\times10^{-4}$mol/mol of silver for the emulsions Σ1-1g, Σ2-1g and Σ3-1g sensitizing dye V for red-sensitive emulsions

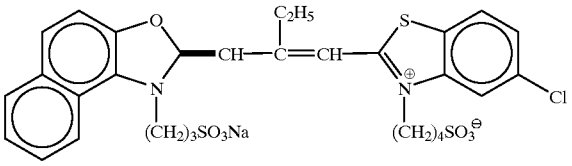

$\Sigma 3.5\times10^{-4}$ mol/mol of silver for the emulsions Σ1-1r, Σ2-1r and Σ3-1r sensitizing dye VI for red-sensitive emulsions

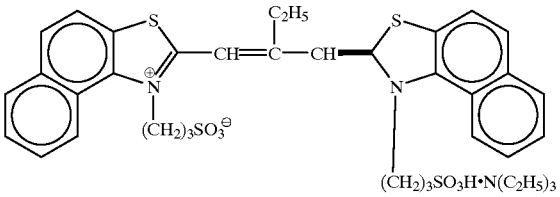

$1.6\times10^{-4}$ mol/mol of silver for the emulsions Σ1-1r, Σ2-1r and X3-1r sensitizing dye VII for red-sensitive emulsions

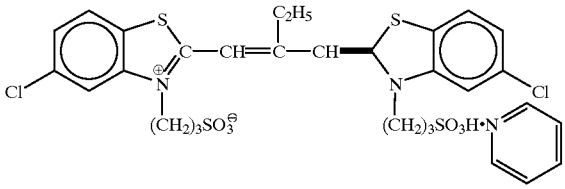

$5.1\times10^{-4}$ mol/mol of silver for the emulsions Σ1-1r, Σ2-1r and Σ3-1r

In addition, in order to form coloring layers which lose color at the time of heat development, colorant dispersions were also prepared by combining the following yellow, magenta and cyan leuco dyes with a complex of zinc. By use of the thus prepared silver halide emulsions, coupler dispersions and colorant dispersions, samples of the multilayered silver halide color photosensitive materials (901 to 903) were prepared as shown in Tables 11 to 13 (Table 12 shows the portion continuous with the bottom of Table 11, while Table 13 shows the portion continuous with the bottom of Table 12).

TABLE 11

| | | Sample 901 | Sample 902 | Sample 903 |
|---|---|---|---|---|
| Protective layer | Lime-processed gelatin | 1000 | 1000 | 1000 |
| | Matting agent(silica) | 50 | 50 | 50 |
| | Surfactant (f) | 100 | 100 | 100 |
| | Surfactant (g) | 300 | 300 | 300 |
| | Water-soluble polymer (h) | 15 | 15 | 15 |
| | Hardener (i) | 98 | 98 | 98 |
| Intermediate layer | Lime-processed gelatin | 375 | 375 | 375 |
| | Surfactant (g) | 15 | 15 | 15 |
| | Zinc hydroxide | 1100 | 1100 | 1100 |
| | Water-soluble polymer (h) | 15 | 15 | 15 |

TABLE 11-continued

| | | Sample 901 | Sample 902 | Sample 903 |
|---|---|---|---|---|
| Yellow color forming layer | Lime-processed gelatin | 150 | 150 | 150 |
| | Emulsion (based on the weight of coated silver) | $\Sigma_1$b 647 | $\Sigma_2$ b 647 | $\Sigma_3$b 647 |
| | Yellow dye forming coupler (u) | 57 | 57 | 57 |
| | Developing agent (v) | 41 | 41 | 41 |
| | Anti-fogging agent (w) | 4 | 4 | 4 |
| | Organic solvent having a high boiling point (b) | 50 | 50 | 50 |
| | Surfactant (e) | 3 | 3 | 3 |
| | Water-soluble polymer (h) | 1 | 1 | 1 |
| Yellow color forming layer | Lime-processed gelatin | 220 | 220 | 220 |
| | Emulsion (based on the weight of coated silver) | $\Sigma_{1-1}$b 475 | $\Sigma_{2-1}$b 475 | $\Sigma_{3-1}$b 475 |
| | Yellow dye forming coupler (u) | 84 | 84 | 84 |
| | Developing agent (v) | 60 | 60 | 60 |
| | Anti-fogging agent (w) | 6 | 6 | 6 |
| | Organic solvent having a high boiling point (b) | 74 | 74 | 74 |
| | Surfactant (e) | 4 | 4 | 4 |
| | Water-soluble polymer (h) | 2 | 2 | 2 |
| Yellow color forming layer | Lime-processed gelatin | 1400 | 1400 | 1400 |
| | Emulsion (based on the weight of coated silver) | $\Sigma_{1-2}$b 604 | $\Sigma_{2-2}$b 604 | $\Sigma_{3-2}$b 604 |
| | Yellow dye forming coupler (u) | 532 | 532 | 532 |
| | Developing agent (v) | 382 | 382 | 382 |
| | Anti-fogging agent (w) | 40 | 40 | 40 |
| | Organic solvent having a high boiling point (b) | 469 | 469 | 469 |
| | Surfactant (e) | 23 | 23 | 23 |
| | Water-soluble polymer (h) | 10 | 10 | 10 |

TABLE 12

| | | | | |
|---|---|---|---|---|
| Intermediate layer | Lime-processed gelatin | 750 | 750 | 750 |
| | Surfactant (e) | 15 | 15 | 15 |
| | Leuco dye (x) | 303 | 303 | 303 |
| | Color developer (y) | 433 | 433 | 433 |
| | Water-soluble polymer (h) | 15 | 15 | 15 |
| Magenta color forming layer | Lime-processed gelatin | 150 | 150 | 150 |
| | Emulsion (based on the weight of coated silver) | $\Sigma_1$g 647 | $\Sigma_2$g 647 | $\Sigma_3$g 647 |
| | Magenta dye forming coupler (a) | 48 | 48 | 48 |
| | Developing agent (b1) | 33 | 33 | 33 |
| | Anti-fogging agent (c) | 0.02 | 0.02 | 0.02 |
| | Organic solvent having a high boiling point (d) | 50 | 50 | 50 |
| | Surfactant (e) | 3 | 3 | 3 |
| | Water-soluble polymer (h) | 1 | 1 | 1 |
| Magenta color forming layer | Lime-processed gelatin | 220 | 220 | 220 |
| | Emulsion (based on the weight of coated silver) | $\Sigma_{1-1}$g 475 | $\Sigma_{2-1}$g 475 | $\Sigma_{3-1}$g 475 |
| | Magenta dye forming coupler (a) | 70 | 70 | 70 |
| | Developing agent (b1) | 49 | 49 | 49 |
| | Anti-fogging agent (c) | 0.02 | 0.02 | 0.02 |
| | Organic solvent having a high boiling point (d) | 74 | 74 | 74 |
| | Surfactant (e) | 4 | 4 | 4 |
| | Water-soluble polymer (h) | 2 | 2 | 2 |
| Magenta color forming layer | Lime-processed gelatin | 1400 | 1400 | 1400 |
| | Emulsion (based on the weight of coated silver) | $\Sigma_{1-2}$g 604 | $\Sigma_{2-2}$g 604 | $\Sigma_{3-2}$g 604 |
| | Yellow dye forming coupler (a) | 446 | 446 | 446 |
| | Developing agent (b1) | 311 | 311 | 311 |
| | Anti-fogging agent (c) | 0.14 | 0.14 | 0.14 |
| | Organic solvent having a high boiling point (d) | 469 | 469 | 469 |
| | Surfactant (e) | 23 | 23 | 23 |
| | Water-soluble polymer (h) | 10 | 10 | 10 |

TABLE 13

| | | | | |
|---|---|---|---|---|
| Inter-mediate layer | Lime-processed gelatin | 900 | 900 | 900 |
| | Surfactant (e) | 15 | 15 | 15 |
| | Leuco dye (z) | 345 | 345 | 345 |
| | Color developer (y) | 636 | 636 | 636 |
| | Zinc hydroxide | 1100 | 1100 | 1100 |
| | Water-soluble polymer (h) | 15 | 15 | 15 |
| Cyan color forming layer | Lime-processed gelatin | 150 | 150 | 150 |
| | Emulsion (based on the weight of coated silver) | $\Sigma_1 r$ 647 | $\Sigma_2 r$ 647 | $\Sigma_3 r$ 647 |
| | Cyan dye forming coupler (aa) | 65 | 65 | 65 |
| | Developing agent (b1) | 33 | 33 | 33 |
| | Anti-fogging agent (c) | 0.03 | 0.03 | 0.03 |
| | Organic solvent having a high boiling point (d) | 50 | 50 | 50 |
| | Surfactant (e) | 3 | 3 | 3 |
| | Water-soluble polymer (h) | 1 | 1 | 1 |
| Cyan color forming layer | Lime-processed gelatin | 220 | 220 | 220 |
| | Emulsion (based on the weight of coated silver) | $\Sigma_{1-1} r$ 475 | $\Sigma_{2-1} r$ 475 | $\Sigma_{3-1} r$ 475 |
| | Cyan dye forming coupler (aa) | 96 | 96 | 96 |
| | Developing agent (b1) | 49 | 49 | 49 |
| | Anti-fogging agent (c) | 0.05 | 0.05 | 0.05 |
| | Organic solvent having a high boiling point (d) | 74 | 74 | 74 |
| | Surfactant (e) | 4 | 4 | 4 |
| | Water-soluble polymer (h) | 2 | 2 | 2 |
| Cyan color forming layer | Lime-processed gelatin | 1400 | 1400 | 1400 |
| | Emulsion (based on the weight of coated silver) | $\Sigma_{1-2} r$ 604 | $\Sigma_{2-2} r$ 604 | $\Sigma_{3-2} r$ 604 |
| | Cyan dye forming coupler (aa) | 610 | 610 | 610 |
| | Developing agent (b1) | 311 | 311 | 311 |
| | Anti-fogging agent (c) | 0.32 | 0.32 | 0.32 |
| | Organic solvent having a high boiling point (d) | 469 | 469 | 469 |
| | Surfactant (e) | 23 | 23 | 23 |
| | Water-soluble polymer (h) | 10 | 10 | 10 |
| Anti-hala-tion layer | Lime-processed gelatin | 750 | 750 | 750 |
| | Surfactant (e) | 15 | 15 | 15 |
| | Leuco dye (ab) | 243 | 243 | 243 |
| | Color developer (y) | 425 | 425 | 425 |
| | Water-soluble polymer (h) | 15 | 15 | 15 |
| | Transparent PET support (120 μm) | | | |

Yellow dye forming coupler (u)

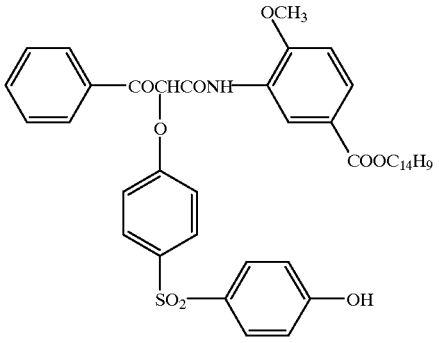

-continued

Developing agent (v)

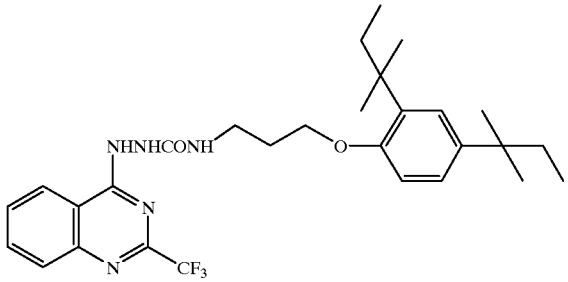

Anti-fogging agent (w)

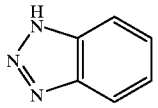

Cyan dye forming coupler (aa)

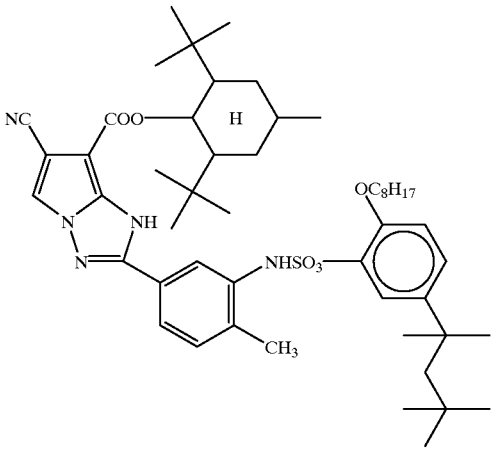

Leuco dye (ab)

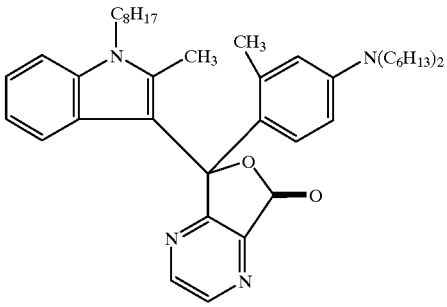

Yellow color forming leuco dye (x)

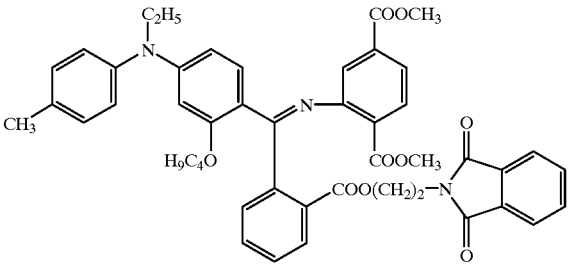

-continued

Color developer (y)

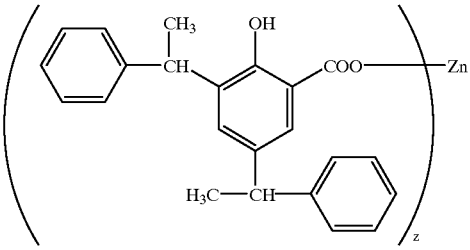

Magenta color forming leuco dye (z)

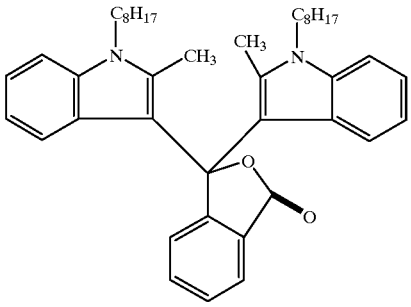

The photographic characteristics of these photosensitive materials were examined in the same way as in Example 7. First, these photosensitive materials were exposed to light of 1,000 lux for 1/100 second through an optical wedge and through a blue filter, a green filter and a red filter, respectively. After the exposure, heat development was carried out by the procedure comprising supplying 15 ml/m$^2$ of warm water at 40° C. to the photosensitive layer of the photosensitive material, placing the photosensitive material and the processing layer of processing material P-1 employed in Example 7 so that the layers faced each and thereafter heating the materials by use of a heat drum at 83° C. for 30 seconds. A yellow colored wedge-shaped image was obtained when the sample was exposed through the blue filter, a magenta colored wedge-shaped image was obtained when the sample was exposed through the green filter, and a cyan colored wedge-shaped image was obtained when the sample was exposed through the red filter, when the processing material was removed from the photosensitive material after the above-described procedure. Then, a stabilizing processing was performed by use of the processing material P-2 as in Example 7. The colored samples were subjected to the transmission density measurement to obtain characteristic values as in Example 7. Sensitivity is expressed as a relative value by taking the blue sensitivity, green-sensitivity and red-sensitivity of Sample 901 as 100. respectively.

TABLE 14

Sensitivity is indicated in relative values by taking the sensitivity of the sample 901 as 100. Fogging is indicated by relative values by taking the maximum density as 1.

| Sample No. | Sensitive color | Relative sensitivity | Fog | Developing agent |
|---|---|---|---|---|
| 901 Comparative example | Blue | 100 | 0.19 | v |
| | Green | 100 | 0.15 | v |
| | Red | 100 | 0.16 | v |

TABLE 14-continued

Sensitivity is indicated in relative values by taking the sensitivity of the sample 901 as 100. Fogging is indicated by relative values by taking the maximum density as 1.

| Sample No. | Sensitive color | Relative sensitivity | Fog | Developing agent |
|---|---|---|---|---|
| 902 Example of the present invention | Blue | 128 | 0.10 | b1 |
| | Green | 134 | 0.07 | b1 |
| | Red | 151 | 0.08 | b1 |
| 903 Example of the present invention | Blue | 108 | 0.11 | b1 |
| | Green | 115 | 0.08 | b1 |
| | Red | 130 | 0.08 | b1 |

The results shown in Table 14 show clearly the effect of the present invention, i.e., high sensitivity and low level fog. This effect is remarkable in a silver halide color photosensitive material (902) which employs (111) silver chloride tabular grains (Σ2) prepared by use of a pyridinium crystal habit controlling agent.

Example 10

The method for preparing emulsions (of the present invention) H-1, H-2 and H-3 composed of silver chloride rich tabular grains composed of a (100) plane is described below.

A mixture of 25.2 g of gelatin having an average molecular weight of 15,000, 0.37 g of sodium chloride, 8.8 ml of (1N) sulfuric acid and 1,100 ml of distilled water was placed in a reaction vessel, and thereafter the temperature of the mixture was raised to 35° C. To this solution, which was vigorously stirred, were added 30 ml of an aqueous solution containing 6.1 g of silver nitrate and 30 ml of an aqueous solution containing 2.00 g of sodium chloride and 0.21 g of potassium bromide over a period of 45 seconds. Next, an aqueous solution containing 5.0 g of polyvinyl alcohol having an average degree of polymerization of 300 to 700 (KURAREPOVAL 105 manufactured by Kraray Co., Ltd.) to the solution. Then, 40 ml of an aqueous solution containing 0.55 g of potassium bromide was added to the resultant solution. Further, 100 ml of an aqueous solution containing 18.3 g of silver nitrate and 100 ml of an aqueous solution containing 6.30 g of sodium chloride were added to the solution over a period of 3 minutes. Then, 6.0 ml of (1N) sodium hydroxide aqueous solution was added to the solution, and thereafter the temperature of the solution was raised to 75° C. After that, 10.0 g of gelatin together with 100 ml of distilled water were added to the solution. Then, 750 ml of an aqueous solution containing 145.4 g of silver nitrate and a 7.0% aqueous solution of sodium chloride were added to the solution over a period of 45 minutes in such a manner that the flow rate of the addition was gradually increased and that the silver potential of the reaction mixture was105 mV with respect to a saturated calomel electrode. After the completion of the addition, 0.08 mg of potassium hexachloroiridate was added to the solution and the temperature of the solution was kept at 75° C. for 30 minutes. Then, the temperature of the solution was lowered and the salts were removed from the solution through a standard method.

The obtained emulsion comprised silver chlorobromide having a silver bromide content of 0.64 mo %. The emulsion was found to be an emulsion made up of (100) tabular silver chlorobromide grains having an average grain size expressed in an equivalent-sphere diameter of 0.67 μm and a value of 7.1 (an aspect ratio) obtained by dividing the diameter of a circle equivalent to the average projected area of grain by an average thickness of the grains, and having the projected area in the shape of a rectangle with an average length to width ratio of 1:1.25. This emulsion was designated as emulsion H-1. Further, by altering the molecular weight and the amount of the gelatin to be used at an initial stage of the reaction, emulsions H-2 and H-3 which had respective equivalent-sphere diameters of 0.50 μm and 0.31 μm were also prepared, and these emulsions were used in Example 11.

The spectral sensitization and the chemical sensitization of the emulsions H-1, H-2 and H-3 are described below. That is, the spectral sensitization and the chemical sensitization of these emulsions were performed by the addition thereto of the following spectral sensitizing dyes I, II and III, compound I, potassium thiocyanate, chloroauric acid and sodium thiosulfate. In the sensitizing operation, the amounts of the spectral sensitizing dyes varied in proportion to the surface areas of the grains in the emulsions. Further, pAg values and the amounts of the chemical sensitizers were adjusted so that the levels of the chemical sensitization of the emulsions were optimized.

The emulsions prepared in the procedures described above, were designated, for example, as H-1g by adding suffix g for a green-sensitive emulsion.

sensitizing dye I for green-sensitive emulsions

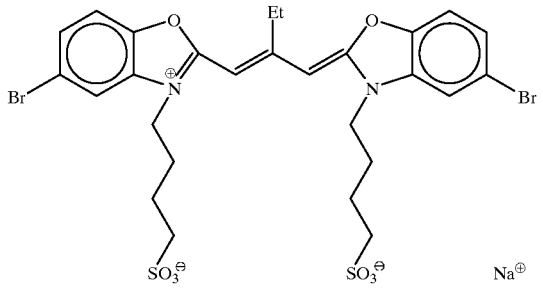

$8.4\times10^{-4}$ mol/mol of silver for the emulsions sensitizing dye II for green-sensitive emulsions

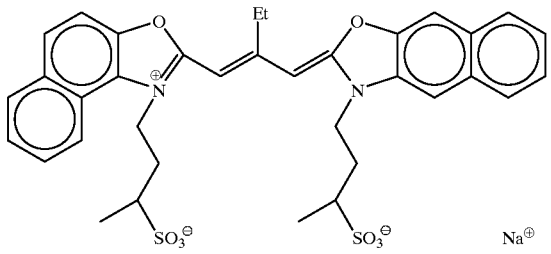

$2.2\times10^{-4}$ mol/mol of silver for the emulsions sensitizing dye III for green-sensitive emulsions

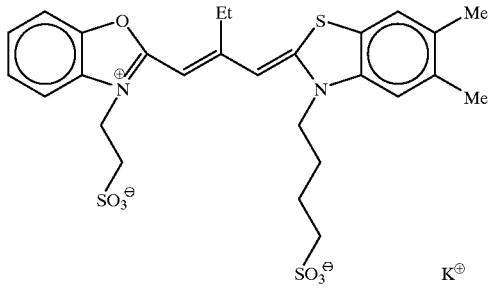

$3.2\times10^{-4}$ mol/mol of silver for the emulsions compound I

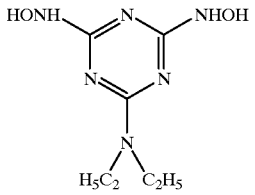

A method for preparing emulsions (present invention) B-1, B-2 and B-3 composed of silver chloride rich tabular grains having a (111) plane is described below.

1,200 ml of a gelatin aqueous solution containing 2.4 g of deionized and alkali processed ossein gelatin treated and 1.75 g of sodium chloride was placed in a reaction vessel and the solution was kept at 30° C. To this solution, which was vigorously stirred, were simultaneously added 60 ml of an aqueous solution (A) containing 165 g of silver nitrate in 1.100 ml and 60 ml of an aqueous solution (B) containing 59.1 g of sodium chloride in 1,100 ml over a period of one minute and 30 seconds. Meanwhile, 50 ml of an aqueous solution (C) containing 0.28 g of the compound (3) was prepared. 40 ml of the solution (C) was added to the above-mentioned reaction mixture containing the solutions (A) and (B), and 30 ml of a 10% sodium chloride aqueous solution was also added to the reaction mixture one minute after the completion of the addition of the solution (C). After the completion of the addition, the temperature of the reaction mixture was raised to 65° C. over 27 minutes, and, 19 minutes later, 290 ml of an aqueous gelatin solution containing 29 g of phthalated gelatin was added to the reaction mixture, and another 3 minutes later, 10 ml of the solution (C) was added to the reaction mixture. Next, one minute later, 768 ml of the aqueous solution (A) and 768 ml of the aqueous solution (B) were added to the reaction mixture simultaneously at an initial rate of 2.85 ml/minute and at an acceleration of 0.818 ml/(minute)$^2$. 10 minutes before the completion of the addition of the solutions (A) and (B), the addition of a solution (D), i.e., a 270 ml aqueous solution containing 3.9 g of sodium chloride and 0.11 g of potassium ferrocyanide, started so that the addition of the solution (D) was complete in 12 minutes. Further, 2 minutes before the completion of the addition of the solutions (A) and (B), the addition of 34 ml of an aqueous 10% potassium bromide solution started so that the addition of this solution was complete in 3 seconds. 3 minutes after the addition of the solutions (A) and (B), 30 ml of an aqueous 1% potassium thiocyanate solution and 45 ml of a liquid, which comprised 100 g of gelatin and having dispersed therein 570 mg of the sensitizing dye I for green-sensitive emulsions, 60 mg of sensitizing dye II for green-sensitive emulsions and 120 mg of sensitizing dye III for green-sensitive emulsions, were added to the reaction mixture. One minute after the addition, the temperature of the reaction mixture was raised to 75° C., and this temperature was held for 10 minutes. The temperature of the reaction mixture was then lowered to 40° C., and the desalting process of the reaction mixture was performed through a standard method by use of the flocculant (1). Then, the reaction product was dispersed in 67 g of a deionized and alkali processed ossein gelatin blended with zinc nitrate and phenoxyethanol to obtain an emulsion, which was adjusted to a pH of 6.3 and a pAg of 7.7.

It was found that the obtained emulsion comprised grains made up of (111) tabular silver chlorobromide grains having an average grain size expressed in an equivalent-sphere diameter of 0.74 μm, an average aspect ratio of 8.7. an average ratio of the lengths of the neighboring sides of the projected shape of 1:1.6. and a silver bromide content of 5 mol %. FIG. 1 is an electron microscopic photograph illustrating the grain structure of the above-mentioned grains (the photograph was taken together with latex spheres having a diameter of 0.2 μm in order to confirm the size of the sample). This emulsion was designated as emulsion B-1.

The emulsion B-1 was chemically sensitized at 60° C. to impart the maximum sensitivity to the emulsion by the successive addition of 4-hydroxy-6-methyl-1,3,3a, 7-tetraazindene, sodium thiosulfate, a selenium sensitizer, chloroauric acid and sodium benzenethiosulfonate. The chemical sensitization was terminated by the addition of the compounds (4) and (5). The emulsion prepared in the procedures described above was designated as B-1g by adding suffix g for a green-sensitive emulsion.

Compound (3)

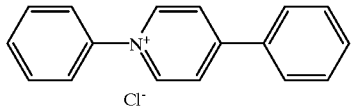

Flocculant (1)

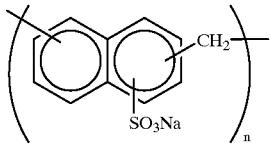

Compound (4)

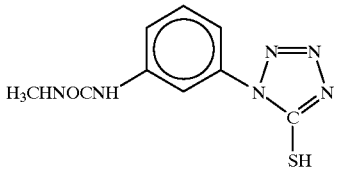

Compound (5)

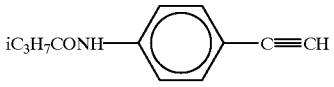

-continued

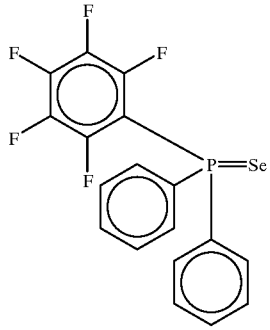

Selenium sensitizer

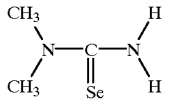

1:1 (molar ratio) blend

Meanwhile, the initial amount of gelatin, and the amount of silver nitrate contained in the solution (A) and the amount of sodium chloride contained in the solution (B) were altered to prepare emulsions B-2g and B-3g each having grains comprising a (111) plane but having grain sizes different from those of the emulsion B-1g. The grain sizes of the emulsions B-2g and B-3g were 0.54 μm and 0.39 μm, respectively.

Next, a dispersion of zinc hydroxide serving as a base precursor was prepared.

A mixture, which comprised 31 g of zinc hydroxide powder having an average diameter of primary grains of 0.2 μm, 1.6 g of carboxymethylcellulose and 0.4 g of sodium polyacrylate as dispersants, 8.5 g of lime-processed ossein gelatin and 158.5 ml of water, was dispersed for one hour by means of a mill with glass beads. After filtering off the glass beads from the mixture, 188 g of a dispersion of zinc hydroxide was obtained.

Next, an emulsified dispersion of a magenta dye forming coupler (of the present invention) was prepared in the following way.

A mixture, which comprised 7.80 g of magenta dye forming coupler (a1), 5.45 g of a developing agent (b), 2 mg of an anti-fogging agent (c), 8.21 g of an organic solvent having a high boiling point (d) and 24 ml of ethyl acetate, was made into a solution at 60° C. The solution was blended into 150 g of an aqueous solution comprising 12 g of a lime-processed gelatin and 0.6 g of sodium dodecylbenzenesulfonate. The resultant mixture was emulsified by means of a dissolver-type mixing device rotating at 10,000 revolutions per minute over a period of 20 minutes while keeping the temperature of the emulsion at 50° C. After the emulsification, distilled water was added to the emulsion so that the total volume became 300 g, and the resultant emulsion was mixed at 2,000 revolutions per minute for 10 minutes.

Magenta coupler (a1) magenta coupler (coupler of the present invention)

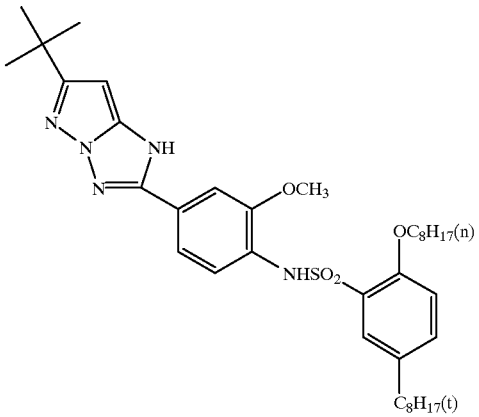

Developing agent (b)

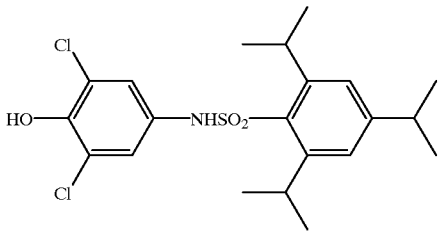

Anti-fogging agent (c)

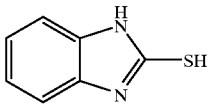

Organic solvent having a high boiling point (d)

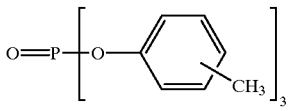

Next, an emulsified dispersion of a magenta dye forming coupler for the purpose of comparison was prepared in the following way.

A mixture, which comprised 8.10 g of magenta dye forming coupler (a2), 5.45 g of a developing agent (b), 2 mg of an anti-fogging agent (c), 8.21 g of an organic solvent having a high boiling point (d) and 24 ml of ethyl acetate, was dissolved at 60° C. The solution was blended into 150 g of an aqueous solution comprising 12 g of a lime-processed gelatin and 0.6 g of sodium dodecylbenzenesulfonate. The resultant mixture was emulsified by means of a dissolver-type mixing device rotating at 10,000 revolutions per minute over a period of 20 minutes while keeping the temperature of the emulsion at 50° C. After the emulsification, distilled water was added to the emulsion so that the total amount became 300 g. and the resultant emulsion was mixed at 2,000 revolutions per minute for 10 minutes.

Magenta dye forming coupler (a2) (for the purpose of comparison)

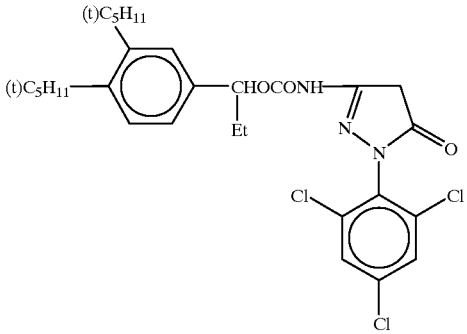

Four samples, i.e., samples 101 to 104 of magenta single-layered photographic photosensitive materials for use in heat development were prepared by combining the above-described dispersions with the silver halide emulsions as shown in Table 15.

TABLE 15

| | | (mg/m²) | | | |
|---|---|---|---|---|---|
| | | Sample 101 | Sample 102 | Sample 103 | Sample 104 |
| Protective layer | Lime-processed gelatin | 1000 | 1000 | 1000 | 1000 |
| | Matting agent(silica) | 50 | 50 | 50 | 50 |
| | Surfactant (f) | 100 | 100 | 100 | 100 |
| | Surfactant (g) | 300 | 300 | 300 | 300 |
| | Water-soluble polymer (h) | 15 | 15 | 15 | 15 |
| | Hardener (i) | 35 | 35 | 35 | 35 |
| Intermediate layer | Lime-processed gelatin | 375 | 375 | 375 | 375 |
| | Surfactant (g) | 30 | 30 | 30 | 30 |
| | Zinc hydroxide | 1100 | 1100 | 1100 | 1100 |
| | Water-soluble polymer (h) | 15 | 15 | 15 | 15 |
| Magenta color forming layer | Lime-processed gelatin | 2000 | 2000 | 2000 | 2000 |
| | Emulsion (based on the weight of coated silver) | H-1g 3000 | B-1g 3000 | H-1g 3000 | B-1g 3000 |
| | Magenta dye forming coupler (a1) | 637 | 637 | — | — |
| | Magenta dye forming coupler (a2) | — | — | 662 | 662 |
| | Developing agent (b) | 444 | 444 | 444 | 444 |
| | Anti-fogging agent (c) | 0.20 | 0.20 | 0.20 | 0.20 |
| | Organic solvent having a high boiling point (d) | 720 | 720 | 720 | 720 |
| | Surfactant (e) | 33 | 33 | 33 | 33 |
| | Water-soluble polymer (h) | 14 | 14 | 14 | 14 |
| Transparent PET support (120 μm) | | | | | |

Surfactant (f)

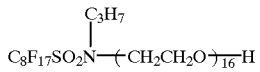

Surfactant (g)

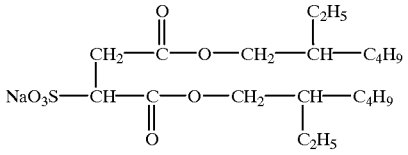

-continued

Water-soluble polymer (h)

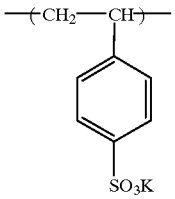

Hardener (i)

Further, processing materials P-1 and P-2 as shown in Tables 16 and 17 were prepared. The composition of the transparent support A is shown in Table 18.

TABLE 16

Composition of processing material P-1

| Layer structure | Added substance | Amount added (mg/m$^2$) |
|---|---|---|
| 4th layer: Protective layer | Acid-processed gelatin | 220 |
| | Water-soluble polymer (j) | 60 |
| | Water-soluble polymer (k) | 200 |
| | Additive (l) | 80 |
| | Potassium nitrate | 16 |
| | Matting agent (m) | 10 |
| | Surfactant (g) | 7 |
| | Surfactant (n) | 7 |
| | Surfactant (o) | 10 |
| 3rd layer: Intermediate layer | Lime-processed gelatin | 240 |
| | Water-soluble polymer (k) | 24 |
| | Hardener (p) | 180 |
| | Surfactant (e) | 9 |
| 2nd layer: Base generating layer | Lime-processed gelatin | 2100 |
| | Water-soluble polymer (k) | 360 |
| | Water-soluble polymer (q) | 700 |
| | Water-soluble polymer (r) | 600 |
| | Organic solvent having a high boiling point (s) | 2120 |
| | Additive (t) | 20 |
| | Guanidine Picolinate | 2613 |
| | Potassium quinolinate | 225 |
| | Sodium quinolinate | 192 |
| | Surfactant (e) | 24 |
| 1st layer: Undercoat layer | Lime-processed gelatin | 247 |
| | Water-soluble polymer (j) | 12 |
| | Surfactant (g) | 14 |
| | Hardener (p) | 178 |
| | Transparent support A (63 $\mu$m) | |

TABLE 17

Composition of processing material P-2

| Layer structure | Added substance | Amount added (mg/m$^2$) |
|---|---|---|
| 4th layer: Protective layer | Acid-processed gelatin | 220 |
| | Water-soluble polymer (j) | 60 |
| | Water-soluble polymer (k) | 200 |
| | Potassium nitrate | 12 |
| | Matting agent (m) | 10 |
| | Surfactant (g) | 7 |
| | Surfactant (n) | 7 |
| | Surfactant (o) | 10 |
| 3rd layer: Intermediate layer | Lime-processed gelatin | 240 |
| | Water-soluble polymer (k) | 24 |
| | Hardener (p) | 180 |
| | Surfactant (e) | 9 |
| 2nd layer: | Lime-processed gelatin | 2400 |

TABLE 17-continued

Composition of processing material P-2

| Layer structure | Added substance | Amount added (mg/m$^2$) |
|---|---|---|
| Base generating layer | Water-soluble polymer (k) | 120 |
| | Water-soluble polymer (q) | 700 |
| | Water-soluble polymer (r) | 600 |
| | Organic solvent having a high boiling point (s) | 2000 |
| | Additive A | 1270 |
| | Additive B | 683 |
| | Surfactant (e) | 20 |
| 1st layer: Undercoat layer | Gelatin | 280 |
| | Water-soluble polymer (j) | 12 |
| | Surfactant (g) | 14 |
| | Hardener (p) | 185 |
| | Transparent support A (63 $\mu$m) | |

TABLE 18

Composition of the support A

| Name of layer | Composition | Weight (mg/m$^2$) |
|---|---|---|
| Surface undercoat layer | Gelatin | 100 |
| Polymer layer | Polyethylene terephthalate | 62500 |
| Undercoat layer reverse side | Methyl methacrylate/styrene/2-ethylhexyl acrylate/methacrylic acid copolymer, | 1000 |
| | PMMA latex (average grain diameter: 12 $\mu$m) | 120 |
| | | 63720 |

Water-soluble polymer (j): κ-carrageenan

Water-soluble polymer (k): Sumikagel L-5H (from Sumitomo Chemical Co., Ltd.)

Additive (1)

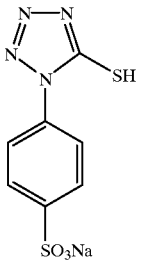

Surfactant (e)

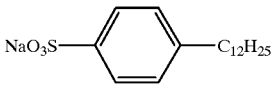

Matting Agent (m): SYLOID 79 (from Fuji-Davison Chemical Co., Ltd.)

Surfactant (n)

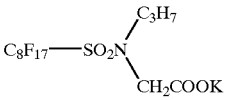

-continued

Surfactant (o)

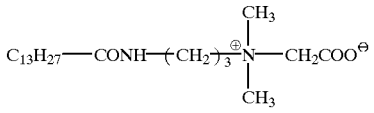

Hardener (p)

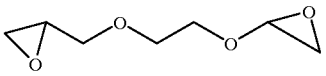

Water-soluble polymer (q): Dextran (molecular weight: 70,000)

Water-soluble polymer (r): MP Polymer MP 102 (from Kuraray Co., Ltd.)

Solvent having a high boiling point (s): EMPARA 40 (from Ajinomoto Co., Ltd.)

Additive (t)

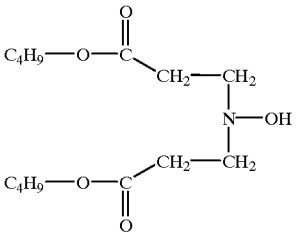

Additive A

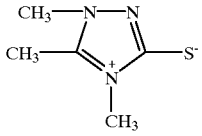

Additive B

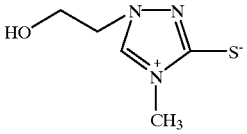

These photosensitive materials were exposed to light of 1,000 lux for 1/100 second through an optical wedge and a green filter.

After the exposure, heat development was carried out by supplying 18 ml/m$^2$of warm water at 40° C. to the photosensitive layer of the photosensitive material, placing the photosensitive layer of the photosensitive material and the processing layer of a first processing material (P-1) face to face so that the layers faced each other and thereafter heating the materials to 83° C. for 15 seconds (i.e., a time period between the face-to-face placing of the materials and separation of them from each other) by use of a heat drum. A magenta colored wedge-shaped image was obtained in the photosensitive materials when the processing material was removed from the photosensitive material after the above-described procedure.

For the purpose of fixation, a second step processing was performed by use of the processing material P-2. The second processing was carried out by supplying 12 ml/m$^2$ of water to the processing layer of the processing material P-2, placing the photosensitive layer of the photosensitive material which had undergone the first processing and the processing layer of the second processing material P-2 face to face so that the layers faced each other and thereafter heating the materials to 70° C. for 20 seconds.

The colored samples thus obtained were subjected to the transmission density measurement to obtain the so-called characteristic curve to determine the sensitivity of each photosensitive material. The sensitivity was expressed as the reciprocal of an exposing light amount at a density 0.15 higher than fogging density. The sensitivities of the photosensitive materials 101 to 104 were matching and fell within a deviation of ±0.1. Therefore, the sensitivities of these photosensitive materials were found to be nearly the same.

The maximum density of each of the samples was measured. None of the samples was subjected to the bleaching of silver. Generally the same result was obtained irrespective of the implementation of the fixation or omission of the fixation. Table 19 shows the results obtained without the implementation of the fixation.

TABLE 19

| Sample No. | Emulsion | Characteristics of emulsions | Coupler | Magenta maximum density | Remarks |
|---|---|---|---|---|---|
| 101 | H-1g | (100) AgCl tabular | a1 coupler (present invention) | 2.71 | present invention |
| 102 | B-1g | (111) AgCl tabular | a1 coupler (present | 2.67 | present invention |
| 103 | H-1g | (100) AgCl tabular | a1 coupler (comparative) | 0.42 | comparative |
| 104 | B-1g | (111) AgCl tabular | al coupler (comparative) | 0.42 | comparative |

It can be seen from the results of Table 19 that the photosensitive material of the present invention is an excellent photosensitive material having a high maximum density.

Example 11

The procedure of Example 10 was repeated except that the spectral sensitizing dyes were changed to the following dyes to prepare a blue-sensitive emulsion and a red-sensitive emulsion. The blue-sensitive emulsion prepared in the procedures described above was designated, for example, as M-1b; and the red-sensitive emulsion prepared in the procedures described above was designated, for example, as M-1r by adding the suffix b or r.

sensitizing dye IV for blue-sensitive emulsions

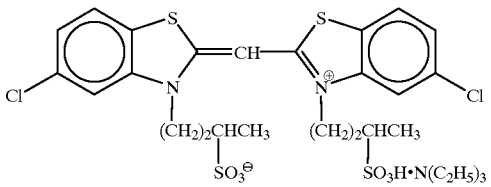

$6.0\times10^{-4}$ mol/mol of silver for the (-b) emulsions sensitizing dye V for red-sensitive emulsions

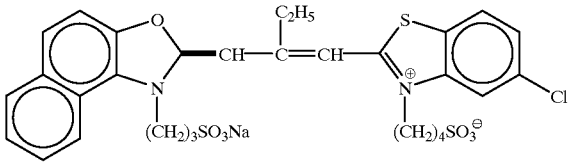

$3.5\times10^{-4}$ mol/mol of silver for the (-r) emulsions sensitizing dye VI for red-sensitive emulsions

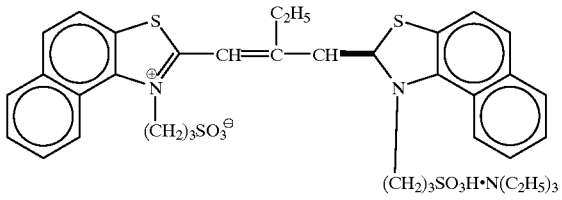

$1.6\times10^{-4}$ mol/mol of silver for the (-r) emulsions sensitizing dye VII for red-sensitive emulsions

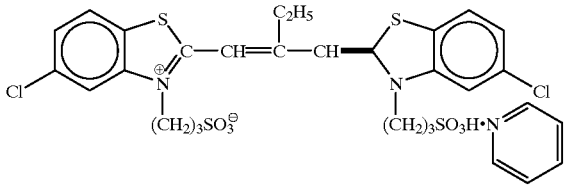

$5.1\times10^{-4}$ mol/mol of silver for the (-r) emulsions

In addition, a dispersion of a cyan dye forming coupler and a dispersion of a yellow dye forming coupler were also prepared according to the procedure for preparing the dispersions of couplers in Example 10.

Four multilayered color photographic materials 211 to 214 for use in heat development were prepared by combining the above-described silver halide emulsions, coupler dispersions and colorant dispersions as shown in Tables 20-1 to 20-4.

TABLE

| | (mg/m²) | 211 | 212 | 213 | 214 |
|---|---|---|---|---|---|
| Protective layer | Lime-processed gelatin | 1000 | 1000 | 1000 | 1000 |
| | Matting agent(silica) | 50 | 50 | 50 | 50 |
| | Surfactant (f) | 80 | 80 | 80 | 80 |
| | Surfactant (g) | 300 | 300 | 300 | 300 |
| | Water-soluble polymer (h) | 15 | 15 | 15 | 15 |
| | Hardener (i) | 91 | 91 | 91 | 91 |
| Intermediate layer | Lime-processed gelatin | 305 | 305 | 305 | 305 |
| | Surfactant (g) | 15 | 15 | 15 | 15 |
| | Zinc hydroxide | 1100 | 1100 | 1100 | 1100 |
| | Water-soluble polymer (h) | 15 | 15 | 15 | 15 |
| Yellow color forming layer | Lime-processed gelatin | 170 | 170 | 170 | 170 |
| | Emulsion EM-1Y (based on the weight of coated silver) | 705 | 705 | 705 | 705 |
| | Yellow dye forming coupler (u1) | 57 | 57 | — | — |
| | Yellow dye forming coupler (u2) | — | — | 55 | 55 |
| | Developing agent (v) | 41 | 41 | 41 | 41 |
| | Anti-fogging agent (w) | 4 | 4 | 4 | 4 |
| | Organic solvent having a high boiling point (d) | 50 | 50 | 50 | 50 |
| | Surfactant (e) | 3 | 3 | 3 | 3 |
| | Water-soluble polymer (h) | 2 | 2 | 2 | 2 |
| Yellow color forming layer | Lime-processed gelatin | 220 | 220 | 220 | 220 |
| | Emulsion EM-2Y (based on the weight of coated silver) | 440 | 440 | 440 | 440 |
| | Yellow dye forming coupler (u1) | 84 | 84 | — | — |
| | Yellow dye forming coupler (u2) | — | — | 81 | 81 |
| | Developing agent (v) | 60 | 60 | 60 | 60 |
| | Anti-fogging agent (w) | 6 | 6 | 6 | 6 |
| | Organic solvent having a high boiling point (d) | 74 | 74 | 74 | 74 |
| | Surfactant (e) | 4 | 4 | 4 | 4 |
| | Water-soluble polymer (h) | 2 | 2 | 2 | 2 |

TABLE 20-2

| | | 211 | 212 | 213 | 214 |
|---|---|---|---|---|---|
| Yellow color forming layer | Lime-processed gelatin | 1400 | 1400 | 1400 | 1400 |
| | Emulsion EM-3Y (based on the weight of coated silver) | 604 | 604 | 604 | 604 |
| | Yellow dye forming coupler (u1) | 532 | 532 | — | — |
| | Yellow dye forming coupler (u2) | — | — | 540 | 540 |
| | Developing agent (v) | 382 | 382 | 382 | 382 |
| | Anti-fogging agent (w) | 50 | 50 | 50 | 50 |
| | Organic solvent having a high boiling point (d) | 469 | 469 | 469 | 469 |
| | Surfactant (e) | 23 | 23 | 23 | 23 |
| | Water-soluble polymer (h) | 10 | 10 | 10 | 10 |
| Intermediate layer | Lime-processed gelatin | 750 | 750 | 750 | 750 |
| | Surfactant (e) | 15 | 15 | 15 | 15 |
| | Leuco dye (x) | 303 | 303 | 303 | 303 |
| | Color developer (y) | 433 | 433 | 433 | 433 |
| | Water-soluble polymer (h) | 15 | 15 | 15 | 15 |
| Magenta color forming layer | Lime-processed gelatin | 125 | 125 | 125 | 125 |
| | Emulsion EM-1M (based on the weight of coated silver) | 647 | 647 | 647 | 647 |
| | Magenta dye forming coupler (a1) | 48 | 48 | — | — |
| | Magenta dye forming coupler (a2) | — | — | 50 | 50 |
| | Developing agent (b) | 33 | 33 | 33 | 33 |
| | Anti-fogging agent (c) | | | | |
| | Organic solvent having a high boiling point (d) | 0.02 | 0.02 | 0.02 | 0.02 |
| | Surfactant (e) | 50 | 50 | 50 | 50 |
| | Water-soluble polymer (h) | 3 | 3 | 3 | 3 |
| | | 1 | 1 | 1 | 1 |
| Magenta color forming layer | Lime-processed gelatin | 220 | 220 | 220 | 220 |
| | Emulsion EM-2M (based on the weight of coated silver) | 475 | 475 | 475 | 475 |
| | Magenta dye forming coupler (a1) | 70 | 70 | — | — |
| | Magenta dye forming coupler (a2) | — | — | 73 | 73 |
| | Developing agent (b) | 49 | 49 | 49 | 49 |
| | Anti-fogging agent (c) | | | | |
| | Organic solvent having a high boiling point (d) | 0.02 | 0.02 | 0.02 | 0.02 |
| | Surfactant (e) | 74 | 74 | 74 | 74 |
| | Water-soluble polymer (h) | 4 | 4 | 4 | 4 |
| | | 2 | 2 | 2 | 2 |

TABLE 20-3

| | | 211 | 212 | 213 | 214 |
|---|---|---|---|---|---|
| Magenta color forming layer | Lime-processed gelatin | 1400 | 1400 | 1400 | 1400 |
| | Emulsion EM-3M (based on the weight of coated silver) | 604 | 604 | 604 | 604 |
| | Magenta dye forming coupler (a1) | 446 | 446 | — | — |
| | Magenta dye forming coupler (a2) | — | — | 446 | 446 |
| | Developing agent (b) | 311 | 311 | 311 | 311 |
| | Anti-fogging agent (c) | 0.14 | 0.14 | 0.14 | 0.14 |
| | Organic solvent having a high boiling point (d) | 469 | 469 | 469 | 469 |
| | Surfactant (e) | 23 | 23 | 23 | 23 |
| | Water-soluble polymer (h) | 10 | 10 | 10 | 10 |
| Intermediate layer | Lime-processed gelatin | 900 | 900 | 900 | 900 |
| | Surfactant (e) | 15 | 15 | 15 | 15 |
| | Leuco dye (z) | 345 | 345 | 345 | 345 |
| | Color developer (y) | 636 | 636 | 636 | 636 |
| | Zinc hydroxide | 1100 | 1100 | 1100 | 1100 |
| | Water-soluble polymer (h) | 15 | 15 | 15 | 15 |
| Cyan color forming layer | Lime-processed gelatin | 150 | 150 | 150 | 150 |
| | Emulsion EM-1C (based on the weight of coated silver) | 647 | 647 | 647 | 647 |
| | | 65 | 65 | 65 | 65 |

TABLE 20-3-continued

| | 211 | 212 | 213 | 214 |
|---|---|---|---|---|
| Cyan dye forming coupler (aa) | 33 | 33 | 33 | 33 |
| Developing agent (b) | | | | |
| Anti-fogging agent (c) | 0.03 | 0.03 | 0.03 | 0.03 |
| Organic solvent having a high boiling point (d) | 50 | 50 | 50 | 50 |
| Surfactant (e) | 3 | 3 | 3 | 3 |
| Water-soluble polymer (h) | 1 | 1 | 1 | 1 |

TABLE 20-4

| | | 211 | 212 | 213 | 214 |
|---|---|---|---|---|---|
| Cyan color forming layer | Lime-processed gelatin | 220 | 220 | 220 | 220 |
| | Emulsion EM-2C (based on the weight of coated silver) | 475 | 475 | 475 | 475 |
| | Cyan dye forming coupler (aa) | 96 | 96 | 96 | 96 |
| | Developing agent (b) | 49 | 49 | 49 | 49 |
| | Anti-fogging agent (c) | 0.05 | 0.05 | 0.05 | 0.05 |
| | Organic solvent having a high boiling point (d) | 74 | 74 | 74 | 74 |
| | Surfactant (e) | 4 | 4 | 4 | 4 |
| | Water-soluble polymer (h) | 2 | 2 | 2 | 2 |
| Cyan color forming layer | Lime-processed gelatin | 1400 | 1400 | 1400 | 1400 |
| | Emulsion EM-3C (based on the weight of coated silver) | 604 | 604 | 604 | 604 |
| | Cyan dye forming coupler (aa) | 610 | 610 | 610 | 610 |
| | Developing agent (b) | 300 | 300 | 300 | 300 |
| | Anti-fogging agent (c) | 0.65 | 0.65 | 0.65 | 0.65 |
| | Organic solvent having a high boiling point (d) | 469 | 469 | 469 | 469 |
| | Surfactant (e) | 23 | 23 | 23 | 23 |
| | Water-soluble polymer (h) | 10 | 10 | 10 | 10 |
| Antihalation layer | Lime-processed gelatin | 750 | 750 | 750 | 750 |
| | Surfactant (e) | 15 | 15 | 15 | 15 |
| | Leuco dye (ab) | 243 | 243 | 243 | 243 |
| | Color developer (y) | 425 | 425 | 425 | 425 |
| | Water-soluble polymer (h) | 15 | 15 | 15 | 15 |
| | Transparent PET support (120 μm) | | | | |

Yellow dye forming coupler (u1): a coupler of the present invention

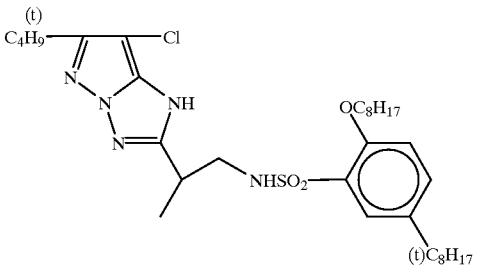

Developing agent (v)

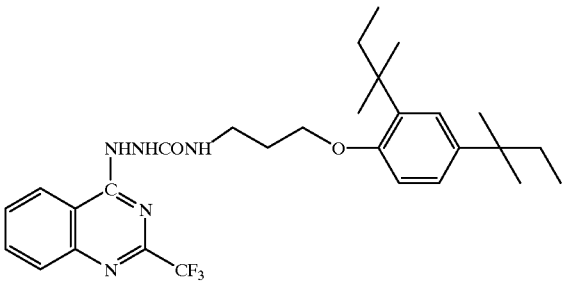

-continued

Anti-fogging agent (w)

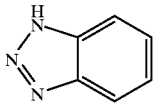

Yellow dye forming coupler (u2): a comparative coupler

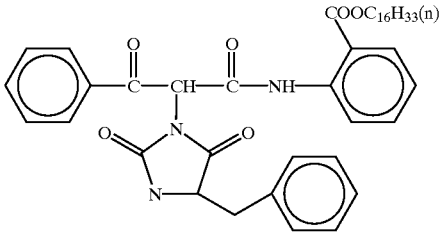

Cyan dye forming coupler (aa)

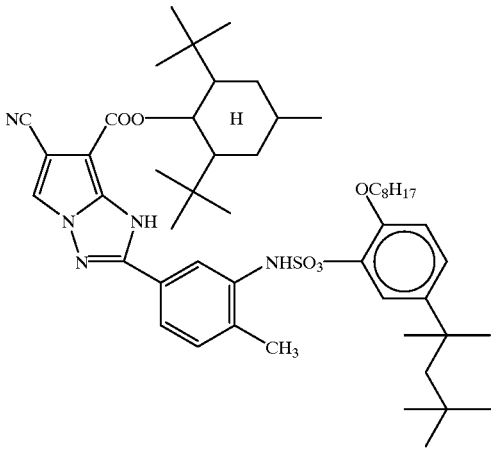

Leuco dye (ab)

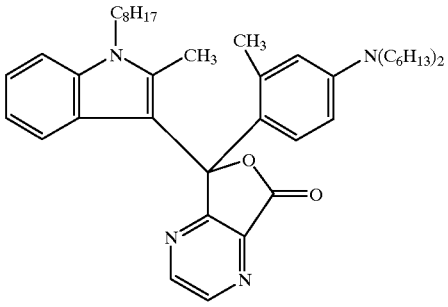

Yellow dye forming leuco dye (x)

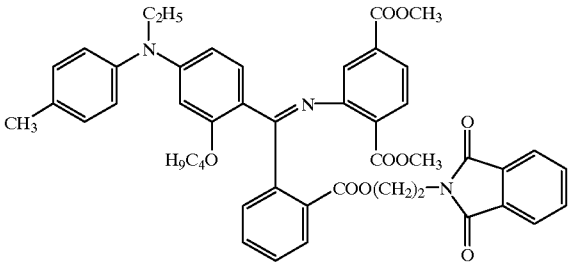

-continued

Color developer (y)

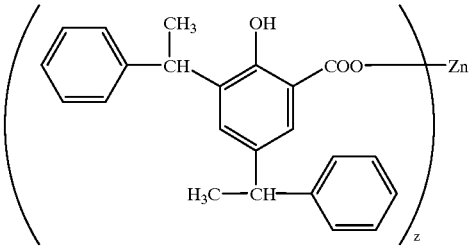

Magenta dye forming leuco dye (z)

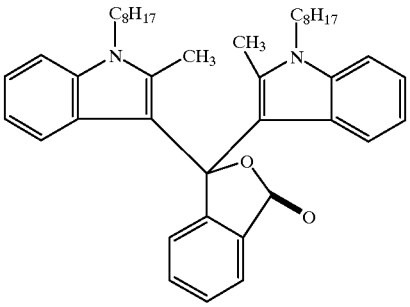

The emulsions to be used in the layers are summarized in the following Table 21.

TABLE 21

| Emulsion | Photosensitive materials No. 211 | 212 | 213 | 214 |
|---|---|---|---|---|
| EM-1Y | H-1b | B-1b | H-1b | B-1b |
| EM-2Y | H-2b | B-2b | H-2b | B-2b |
| EM-3Y | H-3b | B-3b | H-3b | B-3b |
| EM-1M | H-1g | B-1g | H-1g | B-1g |
| EM-2M | H-2g | B-2g | H-2g | B-2g |
| EM-3M | H-3g | B-3g | H-3g | B-3g |
| EM-1C | H-1r | B-1r | H-1r | B-1r |
| EM-2C | H-2r | B-2r | H-2r | B-2r |
| EM-3C | H-3r | B-3r | H-3r | B-3r |

In order to evaluate the photographic characteristics of these photosensitive materials, the photosensitive materials were examined in the same way as in Example 10. First, these photosensitive materials were exposed to light of 1,000 lux for 1/100 second via through an optical wedge and a blue filter, a green filter and a red filter, respectively.

After the exposure, heat development was carried out by supplying 15 ml/m$^2$ of warm water at 40° C. to the photosensitive layer of the photosensitive material, placing the photosensitive layer of the photosensitive material and the processing layer of the processing material P-1 employed in Example 1 so that these layers faced each other and thereafter heating the materials to 80° C. for 25 seconds (i.e., the time period between placing the materials together and separating them) by use of a heat drum. The fixation by means of the processing material P-2 was not performed. A yellow colored wedge-shaped image was obtained when the sample was exposed through the blue filter, a magenta colored wedge-shaped image was obtained when the sample was exposed through the green filter, and a cyan colored wedge-shaped image was obtained when the sample exposed through the red filter, when the processing material was removed from the photosensitive material after the above-described procedure. Based on these colored samples, the levels of color separation of the green-sensitive layer and of the red-sensitive layer from the blue light were visually evaluated.

In addition, the maximum density of these colored samples was measured. The fixation was not performed. The results are shown in Table 22.

TABLE 22

| Photo sensitive material No. | Emulsion No. | Characteristics of emulsions | Coupler | Maximum density | Remarks |
|---|---|---|---|---|---|
| 211 | H-1<br>H-2<br>H-3 | (100)<br>AgCl<br>tabular | u1 (Yellow dye forming coupler of the present invention)<br>a1 (Magenta dye forming coupler of the present invention)<br>aa (Cyan dye forming coupler) | B2.41<br>G2.53<br>R2.52 | Present invention |
| 212 | B-1<br>B-2<br>B-3 | (111)<br>AgCl<br>tabular | u1 (Yellow dye forming coupler of the present invention)<br>a1 (Magenta dye forming coupler of the present invention)<br>aa (Cyan dye forming coupler) | B2.43<br>G2.51<br>R2.45 | Present invention |
| 213 | H-1<br>H-2<br>H-3 | (100)<br>AgCl<br>tabular | u2 (Yellow dye forming coupler of comparative<br>a2 (Magenta dye forming coupler of comparative)<br>aa (Cyan dye forming coupler | B1.16<br>G0.41<br>R2.51 | Comparative |
| 214 | B-1<br>B-2<br>B-3 | (111)<br>AgCl<br>tabular | u2 (Yellow dye forming coupler of comparative)<br>a2 (Magenta dye forming coupler of comparative)<br>aa (cyan dye forming coupler) | B1.15<br>G0.40<br>R2.45 | Comparative |

The results show clearly that the present invention brings about a remarkable effect. That is, the same level of the maximum density as in Example 10 is also found when the color photographic photosensitive material for photographing has a construction made up of O, M and U layers for each of yellow, magenta and cyan layers corresponding to B, G and R lights, respectively.

Example 12

The procedure of Example 11 was repeated except that the yellow and magenta dye forming couplers for the photosensitive materials 201 and 202 were changed as shown in Table 23 to prepare the photosensitive materials 301 to 322. The same processing and tests were conducted. The results are shown in Table 23.

TABLE 23

| Photo-sensi-tive-Mater-ial | Emul-sion No. | Characteristics of emulsion | Coupler | Maxi-mum density | Remarks |
|---|---|---|---|---|---|
| 301 | H-1 | (100) AgCl tabular | a2 | 1.16 | Comparative |
| | H-2 | | R-1 | 1.77 | example |
| 302 | B-1 | (111) AgCl tabular | a2 | 1.2 | Comparative |
| | B-2 | | R1 | 1.79 | example |
| 303 | H-1 | (100) AgCl tabular | I-1 | 2.41 | Present |
| | H-2 | | I-5 | 2.53 | invention |
| 304 | B-1 | (111) AgCl tabular | I-1 | 2.42 | Present |
| | B-2 | | I-5 | 2.49 | invention |
| 305 | H-1 | (100) AgCl tabular | I-4 | 2.51 | Present |
| | H-2 | | I-14 | 2.5 | invention |
| 306 | B-1 | (111) AgCl tabular | I-4 | 2.44 | Present |
| | B-2 | | I-14 | 2.51 | invention |
| 307 | H-1 | (100) AgCl tabular | I-20 | 2.49 | Present |
| | H-2 | | I-18 | 2.15 | invention |
| 308 | B-1 | (111) AgCl tabular | I-20 | 2.48 | Present |
| | B-2 | | I-18 | 2.51 | invention |
| 309 | H-1 | (100) AgCl tabular | I-19 | 2.48 | Present |
| | H-2 | | I-31 | 2.5 | invention |
| 310 | B-1 | (111) AgCl tabular | I-19 | 2.48 | Present |
| | B-2 | | I-31 | 2.49 | invention |
| 311 | H-1 | (100) AgCl tabular | I-11 | 2.23 | Present |
| | H-2 | | I-34 | 2.49 | invention |
| 312 | B-1 | (111) AgCl tabular | I-11 | 2.51 | Present |
| | B-2 | | I-34 | 2.5 | invention |
| 313 | H-1 | (100) AgCl tabular | I-15 | 2.49 | Present |
| | H-2 | | I-33 | 2.44 | invention |
| 314 | B-1 | (111) AgCl tabular | I-15 | 2.42 | Present |
| | B-2 | | I-33 | 2.44 | invention |
| 315 | H-1 | (100) AgCl tabular | I-16 | 2.46 | Present |
| | H-2 | | I-35 | 2.48 | invention |
| 316 | B-1 | (111) AgCl tabular | I-15 | 2.41 | Present |
| | B-2 | | I-35 | 2.43 | invention |
| 317 | H-1 | (100) AgCl tabular | II-1 | 2.22 | Present |
| | H-2 | | I-38 | 2.44 | invention |
| 318 | H-1 | (111) AgCl tabular | II-1 | 2.12 | Present |
| | B-2 | | I-38 | 2.42 | invention |
| 319 | H-1 | (100) AgCl tabular | II-3 | 2.18 | Present |
| | H-2 | | II-2 | 2.22 | invention |
| 320 | B-1 | (111) AgCl tabular | II-3 | 2.18 | Present |
| | B-2 | | II-2 | 2.16 | invention |
| 321 | H-1 | (100) AgCl tabular | II-5 | 2.22 | Present |
| | H-2 | | II-4 | 2.23 | invention |
| 322 | B-1 | (111) AgCl tabular | II-8 | 2.21 | Present |
| | B-2 | | II-4 | 2.21 | invention |

Table 23 shows clearly that the photosensitive materials using the compounds of the present invention bring about a high maximum density (Dmax).

In the comparative examples, the aforesaid coupler a2 and the following coupler R-1 were used. R-1

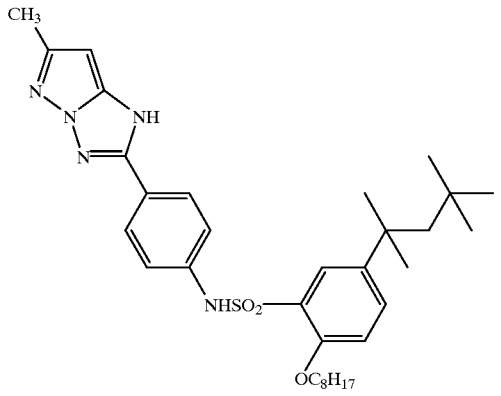

As stated above, the present invention provides a silver halide color photographic photosensitive material which produces a high-quality image and enables simple and rapid image formation without serious fogging while minimizing adverse effects on the environment.

Further, the present invention provides an excellent silver halide color photographic photosensitive material for photographing which provides satisfactory graininess and exposure latitude even in the case of simple and rapid processing, and in particular provides a silver halide color photographic photosensitive material for photographing which produces high-quality images with high maximum density.

What is claimed is:

1. A silver halide color photographic photosensitive material comprising a support and photographic constituent layers formed thereon, said photographic constituent layers comprising at least one photographic photosensitive layer comprising a photosensitive silver halide emulsion, a compound which forms a dye through a coupling reaction with an oxidized form of a developing agent, and a binder, the photosensitive layer of said silver halide color photographic photosensitive material after exposure thereof being put together with a processing layer of a processing material so that the photosensitive layer and the processing layer face each other, and being heated to form a color image in the silver halide color photographic photosensitive material, said at least one photosensitive layer comprising an emulsion comprising tabular silver halide grains having a silver chloride content of 50 mol % or more, wherein the tabular silver halide grains, which have the major exterior faces of the grains made up of a (111) plane and have a plane of projection of the grains in a shape of a hexagon with the ratio of the lengths of neighboring sides ranging from 1:1 to 1:5 to give an aspect ratio of 2 or greater, account for 50% or more of the total projected area of the silver halide grains of the emulsion, and said at least one photosensitive layer containing at least one of the pyrazolotriazole couplers represented by the following general formula VIII and IX:

(VIII)

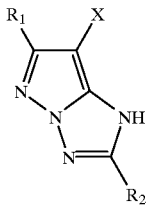

(IX)

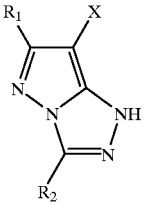

where $R_1$ represents a secondary or tertiary alkyl group, $R_2$ represents an alkyl or aryl group, and X represents a hydrogen atom or a group which can split off at the time when the coupler undergoes a coupling reaction with the oxidized form of the developing agent.

2. A silver halide color photographic photosensitive material according to claim 1, wherein the photosensitive layer of the silver halide color photographic photosensitive material comprises a developing agent and the processing layer of the processing material comprises a base and/or a base precursor and wherein, after the exposure of the photosensitive layer, the photosensitive layer of the photosensitive material is put together with the processing layer of the processing material after water is supplied to the photosensitive layer of the photosensitive material and/or to the processing layer of the processing material.

3. The silver halide color photographic photosensitive material according to claim 2, wherein water in an amount ranging from 1/10 to the equivalent of an amount which is required for the maximum swelling of the photosensitive layer of the silver halide color photographic photosensitive material and the processing layer of the processing material is supplied to the photosensitive layer of the silver halide color photographic photosensitive material and/or to the processing layer of the processing material.

* * * * *